US009701436B2

(12) United States Patent
Holley, Jr.

(10) Patent No.: US 9,701,436 B2
(45) Date of Patent: Jul. 11, 2017

(54) CARTON WITH ARTICLE PROTECTION FEATURE

(71) Applicant: Graphic Packaging International, Inc., Atlanta, GA (US)

(72) Inventor: John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 90 days.

(21) Appl. No.: 14/274,992

(22) Filed: May 12, 2014

(65) Prior Publication Data

US 2014/0305826 A1 Oct. 16, 2014

Related U.S. Application Data

(63) Continuation-in-part of application No. 14/248,650, filed on Apr. 9, 2014.

(Continued)

(51) Int. Cl.

*B65D 5/50* (2006.01)
*B31B 1/26* (2006.01)

(Continued)

(52) U.S. Cl.

CPC ..... *B65D 5/50* (2013.01); *B65B 21/242* (2013.01); *B65D 5/5002* (2013.01); *B65D 71/36* (2013.01);

(Continued)

(58) Field of Classification Search

CPC ..... B65D 71/10; B65D 71/36; B65D 71/16; B65D 71/26; B65D 5/5002; B65D 5/5007; B65D 5/50; B65D 5/5009; B65D 5/5004; B65D 2571/00141; B65D 2571/0066

USPC ..... 206/593, 784, 521, 139, 140, 147, 427, 206/433, 434, 591, 592, 193, 586; 53/456

See application file for complete search history.

(56) References Cited

U.S. PATENT DOCUMENTS 1,527,204 A 2/1925 McCormick
2,014,461 A 7/1935 Anton (Continued)

FOREIGN PATENT DOCUMENTS

BE 672 492 A 3/1966
EP 0 024 782 A1 3/1981

(Continued)

OTHER PUBLICATIONS

International Search Report and Written Opinion for PCT/US2014/037642 dated Sep. 5, 2014.

(Continued)

*Primary Examiner* — Andrew Perreault
(74) *Attorney, Agent, or Firm* — Womble Carlyle Sandridge & Rice, LLP

(57) ABSTRACT

A carton for containing at least one article. The carton comprises at least one panel that can form an interior of the carton. The carton comprises at least one protection feature for protecting the articles from breakage. The article protection feature can comprise at least one feature in end flaps of the carton. The article protection feature can comprise an article protection flap foldably connected to the at least one panel. The article protection flap can be moveable between a first position and a second position wherein the article protection flap is folded relative to the at least one panel.

26 Claims, 45 Drawing Sheets

Related U.S. Application Data

(60) Provisional application No. 61/853,715, filed on Apr. 10, 2013, provisional application No. 61/855,305, filed on May 13, 2013, provisional application No. 61/959,162, filed on Aug. 16, 2013, provisional application No. 61/963,653, filed on Dec. 10, 2013.

(51) Int. Cl.
*B65D 71/36* (2006.01)
*B65B 21/24* (2006.01)

(52) U.S. Cl.
CPC ..... *B65D 2571/0045* (2013.01); *B65D 2571/0066* (2013.01); *B65D 2571/00141* (2013.01); *B65D 2571/00265* (2013.01); *B65D 2571/00302* (2013.01); *B65D 2571/00518* (2013.01); *B65D 2571/00753* (2013.01); *B65D 2571/00882* (2013.01)

(56) References Cited

U.S. PATENT DOCUMENTS 2,196,502 A 4/1940 Kells
2,331,137 A 10/1943 Rous
2,877,894 A 3/1959 Forrer
2,899,051 A 8/1959 Barnby
2,926,782 A 3/1960 Andre
2,933,867 A 4/1960 Gentry
2,974,454 A 3/1961 Andre et al.
3,013,796 A 12/1961 Currie, Jr. et al.
3,015,923 A 1/1962 Dotzenroth
3,016,663 A 1/1962 Holmes
3,032,945 A 5/1962 Currie, Jr. et al.
3,034,270 A 5/1962 Nigrelli et al.
3,045,401 A 7/1962 Ganz
3,108,414 A 10/1963 Schleicher et al.
3,128,034 A 4/1964 Weiss
3,142,378 A 7/1964 Lengsfield, Jr.
3,152,688 A 10/1964 Mahon
3,166,879 A 1/1965 Chidsey, Jr. et al.
3,167,214 A 1/1965 Mahon
3,176,902 A 4/1965 Champlin
3,186,136 A 6/1965 Ganz
3,190,193 A 6/1965 Randles, Jr.
3,196,588 A 7/1965 Chidsey, Jr.
3,197,937 A 8/1965 Ganz
3,203,153 A 8/1965 Wood
3,206,097 A 9/1965 Holmes
3,229,892 A 1/1966 Weiss
3,252,649 A 5/1966 Graser et al.
3,253,381 A 5/1966 Wood
3,255,919 A 6/1966 Koolnis
RE26,083 E 9/1966 Forrer
3,300,947 A 1/1967 Fahrenbach
3,306,519 A 2/1967 Wood
3,332,199 A 7/1967 Wong
3,337,043 A 8/1967 Parker
D208,591 S 9/1967 Bozek
3,355,012 A 11/1967 Weiss
D209,786 S 1/1968 Schwartz
3,367,557 A 2/1968 Farquhar
3,385,429 A 5/1968 Becker
3,386,570 A 6/1968 Lock
3,386,643 A 6/1968 Gentry
3,387,428 A 6/1968 Currie, Jr.
3,415,033 A 12/1968 Perry et al.
3,432,029 A 3/1969 Brown
3,474,590 A 10/1969 Ganz
3,478,951 A 11/1969 Graser
3,517,876 A 6/1970 Stout
3,543,473 A 12/1970 Cato
3,543,474 A 12/1970 Hasselo
3,572,003 A 3/1971 Perry et al.
3,604,614 A 9/1971 Sternfeld
3,627,193 A 12/1971 Helmes
3,640,448 A 2/1972 Wood
3,669,342 A 6/1972 Funkhouser
3,670,950 A 6/1972 Rossi
3,679,121 A 7/1972 Morgese
3,687,282 A 8/1972 Owen
3,701,231 A 10/1972 Standley
3,715,029 A 2/1973 Wood
3,747,801 A 7/1973 Graser
3,760,555 A 9/1973 Calvert
3,767,042 A 10/1973 Ganz
3,797,729 A 3/1974 Holmes
3,815,320 A 6/1974 Ganz
3,897,872 A 8/1975 Graser
3,921,895 A 11/1975 Ziche
3,923,235 A 12/1975 Roccaforte
3,940,907 A 3/1976 Ganz
3,942,631 A 3/1976 Sutherland et al.
3,952,633 A 4/1976 Nakai
3,963,121 A 6/1976 Kipp
3,977,518 A 8/1976 Arneson
3,986,319 A 10/1976 Puskarz
4,012,887 A 3/1977 Calvert et al.
4,029,204 A 6/1977 Manizza
4,034,852 A 7/1977 Forrer
4,056,223 A 11/1977 Williams
4,093,068 A 6/1978 Smrt
4,093,116 A 6/1978 Watkins et al.
4,095,693 A 6/1978 Killy
4,095,735 A 6/1978 Stone
4,101,069 A 7/1978 Wood
4,131,230 A 12/1978 Koehlinger et al.
4,146,168 A 3/1979 Hartline
4,184,626 A 1/1980 Graser
4,185,744 A 1/1980 Peterson
4,186,867 A 2/1980 Wood
4,202,446 A 5/1980 Sutherland
4,219,147 A 8/1980 Kohler
4,234,081 A 11/1980 Champlin
4,256,226 A 3/1981 Stone
4,274,187 A 6/1981 Painter et al.
4,285,185 A 8/1981 Collura et al.
4,295,562 A 10/1981 Wood
4,324,328 A 4/1982 Champlin
4,328,891 A 5/1982 Elward
4,330,079 A 5/1982 Wood
4,338,760 A 7/1982 Kuhn
4,373,630 A 2/1983 Oliff
4,394,903 A 7/1983 Bakx
4,396,118 A 8/1983 Watson
4,398,631 A 8/1983 Graser
4,421,232 A 12/1983 Konaka
4,424,901 A 1/1984 Lanier
4,437,569 A 3/1984 Sorenson
4,437,606 A 3/1984 Graser
4,438,843 A 3/1984 Graser
4,463,852 A 8/1984 Stone
4,465,180 A 8/1984 Klygis
4,470,503 A 9/1984 Stone
4,498,581 A 2/1985 Dutcher
4,498,618 A 2/1985 Sutherland
4,505,696 A 3/1985 Wright et al.
4,512,135 A 4/1985 Scott et al.
4,512,755 A 4/1985 Stone
4,533,047 A 8/1985 Calvert
4,545,485 A 10/1985 Oliff
4,571,923 A 2/1986 Le Bras
4,574,997 A 3/1986 Ikeda
4,597,523 A 7/1986 Schuster
4,600,140 A 7/1986 Milliens
4,612,753 A 9/1986 Taylor et al.
4,708,284 A 11/1987 Sutherland et al.
4,723,699 A 2/1988 Brown et al.
4,773,533 A 9/1988 Greene
4,883,168 A 11/1989 Dreyfus
4,890,737 A 1/1990 Kadleck et al.
4,890,738 A 1/1990 Carer
4,901,849 A 2/1990 Wilson
4,919,266 A 4/1990 McIntosh, Jr. et al.
4,925,019 A 5/1990 Ganz et al.

(56) References Cited

U.S. PATENT DOCUMENTS 5,002,186 A 3/1991 Cooper
5,002,225 A 3/1991 Bienaime
D316,672 S 5/1991 Wood
5,020,668 A 6/1991 Schuster
5,022,525 A 6/1991 Schuster
5,031,770 A 7/1991 Chaussadas
5,044,503 A 9/1991 Wein
5,080,280 A 1/1992 Kraus
5,094,347 A 3/1992 Schuster
5,107,986 A 4/1992 Cooper
5,131,588 A 7/1992 Oliff
5,140,803 A 8/1992 Biggs et al.
5,145,067 A 9/1992 Carver
5,158,177 A 10/1992 Negelen et al.
5,167,325 A 12/1992 Sykora
5,246,112 A 9/1993 Stout et al.
5,297,673 A 3/1994 Sutherland
5,310,050 A 5/1994 Sutherland
5,311,984 A 5/1994 Harris
5,328,080 A 7/1994 Holley, Jr.
5,360,104 A 11/1994 Sutherland
5,360,113 A 11/1994 Harris
5,385,234 A 1/1995 Stout et al.
5,390,784 A 2/1995 Sutherland
5,390,848 A 2/1995 Gungner et al.
5,402,889 A 4/1995 Hermann et al.
5,437,363 A 8/1995 Gungner
5,439,112 A 8/1995 De Guglielmo et al.
5,443,203 A 8/1995 Sutherland
5,472,090 A 12/1995 Sutherland
5,476,217 A 12/1995 Moncrief et al.
5,484,059 A 1/1996 Sutherland
5,485,915 A 1/1996 Harris
5,509,549 A 4/1996 Marandola
5,520,283 A 5/1996 Sutherland
5,524,756 A 6/1996 Sutherland
5,549,197 A 8/1996 Sutherland
5,577,365 A 11/1996 Reuteler
5,579,904 A 12/1996 Holley, Jr.
5,582,289 A 12/1996 Wright
5,592,804 A 1/1997 Reuteler
5,595,291 A 1/1997 Negelen
5,595,292 A 1/1997 Bates
5,595,299 A 1/1997 LeBras
5,605,228 A 2/1997 Baxter
5,620,094 A 4/1997 Naumann
5,638,659 A 6/1997 Moncrief et al.
5,638,956 A 6/1997 Sutherland
5,653,340 A 8/1997 Daniel
5,664,401 A 9/1997 Portrait et al.
5,669,203 A 9/1997 Muller
5,671,587 A 9/1997 Robinson
5,671,845 A 9/1997 Harris
D385,791 S 11/1997 Forsyth
5,682,984 A 11/1997 Hoell
5,699,957 A 12/1997 Blin et al.
5,765,685 A 6/1998 Roosa
5,775,572 A 7/1998 Oliff
5,778,630 A 7/1998 Portrait et al.
5,927,053 A 7/1999 Donovan et al.
5,941,389 A 8/1999 Gomes
5,947,367 A 9/1999 Miller et al.
5,975,286 A 11/1999 Oliff
5,975,287 A 11/1999 Negelen
5,979,645 A 11/1999 Holley, Jr.
5,984,086 A 11/1999 Fousghee et al.
6,044,627 A 4/2000 De Guglielmo
6,149,002 A 11/2000 Tiramani et al.
6,155,412 A 12/2000 LeBras et al.
6,170,741 B1 1/2001 Skolik et al.
6,173,889 B1 1/2001 Sutherland
6,179,115 B1 1/2001 De Guglielmo et al.
6,186,931 B1 2/2001 Calvert et al.
6,189,687 B1 2/2001 Bakx
6,213,297 B1 4/2001 Gale
6,223,892 B1 5/2001 Bakx
6,241,083 B1 6/2001 Harrelson
6,247,585 B1 6/2001 Holley, Jr.
6,273,330 B1 8/2001 Oliff et al.
6,295,789 B1 10/2001 Muller
6,315,111 B1 11/2001 Sutherland
6,315,123 B1 11/2001 Ikeda
6,378,697 B1 4/2002 Sutherland
6,520,316 B2 2/2003 De Guglielmo et al.
6,527,102 B2 3/2003 De Guglielmo et al.
6,527,108 B1 3/2003 Blin et al.
6,536,656 B2 3/2003 Auclair et al.
6,615,984 B2 9/2003 Saulas et al.
6,662,933 B2 12/2003 De Guglielmo et al.
6,669,083 B2 12/2003 Bates
6,695,137 B2 2/2004 Jones et al.
6,877,600 B2 4/2005 Sutherland
6,896,129 B2 5/2005 Marco
6,896,130 B2 5/2005 Theelen
6,942,140 B2 9/2005 Merzeau
6,948,293 B1 9/2005 Eckermann et al.
6,983,874 B2 1/2006 Bakx
6,997,372 B2 2/2006 Gasparowicz
7,028,839 B2 4/2006 Belloli et al.
7,048,113 B2 5/2006 Gomes
7,055,671 B2 6/2006 De Guglielmo et al.
7,063,208 B2 6/2006 Lebras
7,070,045 B2 7/2006 Theelen
7,073,705 B2 7/2006 Auclair et al.
7,134,547 B2 11/2006 Auclair
D535,877 S 1/2007 Tanninen
7,175,020 B2 2/2007 Sutherland et al.
7,234,591 B2 6/2007 LeBras et al.
7,278,538 B2 10/2007 Chargueraud
7,374,038 B2 5/2008 Smalley
7,427,010 B2 9/2008 Sutherland
7,467,729 B2 12/2008 Lown et al.
7,699,215 B2 4/2010 Spivey, Sr.
7,703,666 B2 4/2010 Hand et al.
7,721,878 B2 5/2010 Requena
7,743,968 B2 6/2010 Theelen
7,780,067 B2 8/2010 Holley, Jr.
7,913,844 B2 3/2011 Spivey, Sr.
8,056,709 B2 11/2011 Sutherland
8,061,587 B2 11/2011 Blin
8,070,052 B2 12/2011 Spivey, Sr.
8,079,471 B2 12/2011 Tokarski et al.
D652,300 S 1/2012 Anderson
D658,060 S 4/2012 Anderson
8,162,135 B2 4/2012 Oliveira
8,376,214 B2 2/2013 Spivey et al.
8,453,919 B2 6/2013 Eckermann
D686,913 S 7/2013 Kirk
8,496,162 B2 7/2013 Hettinger
8,523,048 B1 9/2013 Spiegelman
D696,108 S 12/2013 De Pra
8,978,889 B2 3/2015 Fitzwater et al.
9,022,277 B2 5/2015 Hendricks
9,284,090 B2 3/2016 Lettre
2001/0017315 A1 8/2001 Baroudi
2004/0000494 A1 1/2004 Sutherland
2004/0164135 A1 8/2004 Gong et al.
2007/0056869 A1 3/2007 Tokarski
2007/0181658 A1 8/2007 Sutherland
2007/0215682 A1 9/2007 Bates et al.
2007/0277481 A1 12/2007 LeBras
2008/0093366 A1 4/2008 McKahan
2008/0203143 A1 8/2008 Holley
2008/0257942 A1 10/2008 LeBras
2009/0032425 A1 2/2009 Perkinson
2009/0065559 A1 3/2009 Parkes
2009/0101526 A1 4/2009 Sutherland et al.
2009/0236408 A1 9/2009 Spivey, Sr. et al.
2010/0108544 A1 5/2010 Biundo
2010/0140336 A1 6/2010 Ho Fung
2011/0011924 A1 1/2011 Spivey, Sr. et al.
2011/0065558 A1 3/2011 Smalley
2011/0233091 A1 9/2011 Block et al.
2011/0284622 A1 11/2011 Boukredine

(56) References Cited

U.S. PATENT DOCUMENTS

| | | | |
|---|---|---|---|
| 2011/0290867 | A1 | 12/2011 | Schemmel et al. |
| 2012/0279897 | A1 | 11/2012 | Schmal et al. |
| 2013/0097974 | A1 | 4/2013 | Disrud et al. |
| 2013/0220873 | A1 | 8/2013 | Holley, Jr. |
| 2013/0284628 | A1 | 10/2013 | Moncrief |
| 2014/0260095 | A1 | 9/2014 | Oliveira |
| 2014/0305825 | A1 | 10/2014 | Holley, Jr. |
| 2015/0001116 | A1 | 1/2015 | Schmal et al. |
| 2015/0048150 | A1 | 2/2015 | Bahr |

FOREIGN PATENT DOCUMENTS

| | | | |
|---|---|---|---|
| EP | 332 153 | B1 | 9/1991 |
| EP | 630 825 | A2 | 12/1994 |
| EP | 0 541 334 | B1 | 4/1995 |
| EP | 0 715 596 | B1 | 6/1995 |
| EP | 0 820 404 | B1 | 4/1996 |
| EP | 0 901 969 | B1 | 4/2000 |
| EP | 1 065 151 | A1 | 1/2001 |
| EP | 0 954 470 | B1 | 9/2002 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 151 935 | B1 | 8/2006 |
| EP | 1 513 737 | B1 | 11/2006 |
| EP | 2 055 648 | A1 | 5/2009 |
| EP | 1 749 755 | B1 | 12/2011 |
| FR | 2584677 | | 1/1987 |
| FR | 2619363 | A1 | 2/1989 |
| FR | 2684078 | A3 | 5/1993 |
| GB | 1 049 429 | A | 11/1966 |
| JP | S43-022550 | | 9/1943 |
| JP | H05-330502 | | 12/1993 |
| JP | H11-503693 | | 3/1999 |
| JP | 11-124129 | A | 5/1999 |
| JP | 3039805 | | 3/2000 |
| JP | 2008 213894 | A | 9/2008 |
| JP | 2009-120248 | | 6/2009 |
| KR | 20-2010-0010 | | 10/2010 |
| WO | WO 92/09498 | | 6/1992 |
| WO | WO 93/14991 | A1 | 8/1993 |
| WO | WO 95/08489 | A1 | 3/1995 |
| WO | WO 96/32322 | | 10/1996 |
| WO | WO 2005/042370 | A1 | 5/2005 |
| WO | WO 2005/094471 | A2 | 10/2005 |
| WO | WO 2011/022145 | A1 | 2/2011 |
| WO | WO 2011/049947 | A1 | 4/2011 |

OTHER PUBLICATIONS

International Search Report and Written Opinion for PCT/US2014/033445 dated Sep. 5, 2014.

Supplementary European Search Report for EP 12 78 2928 dated Mar. 11, 2015.

International Search Report and Written Opinion for PCT/US2013/030776 dated Jun. 27, 2013.

Supplementary European Search Report for EP 12 84 0937 dated Jun. 3, 2015.

Supplementary European Search Report for EP 12 78 2928 dated Nov. 28, 2014.

International Search Report and Written Opinion for PCT/US2012/060948 dated Mar. 28, 2013.

International Search Report and Written Opinion for PCT/US2013/031205 dated Nov. 26, 2013.

International Search Report and Written Opinion for PCT/US2012/029022 dated Sep. 26, 2012.

International Search Report and Written Opinion for PCT/US2013/031288 dated Jun. 13, 2013.

1105
M
1103
C

C
C
C
C 1113
1103
1113

1205
M
1218
1226
C

C
1222
1220
1218
1226
C
1224

1222
1214
1220
1218
1213
1203
1224
1213

1325
1321
1343
1305
1307
1337

1321
C
1343
1325
1333
1317
1337

1347
1325
1337
1317
1349
1333
1315
1313
1339
1343
1303
1335
1321
1313
1345

CARTON WITH ARTICLE PROTECTION FEATURE

CROSS-REFERENCE TO RELATED APPLICATIONS

This application is a continuation-in-part of U.S. patent application Ser. No. 14/248,650, filed Apr. 9, 2014, which claims the benefit of U.S. Provisional Patent Application No. 61/853,715, filed Apr. 10, 2013. This application claims the benefit of U.S. Provisional Patent Application No. 61/855,305, filed May 13, 2013, U.S. Provisional Patent Application No. 61/959,162, filed Aug. 16, 2013, and U.S. Provisional Patent Application No. 61/963,653, filed Dec. 10, 2013.

INCORPORATION BY REFERENCE

The disclosures of U.S. Provisional Patent Application No. 61/855,305, which was filed on May 13, 2013, U.S. Provisional Patent Application No. 61/959,162, which was filed on Aug. 16, 2013, U.S. Provisional Patent Application No. 61/963,653, which was filed on Dec. 10, 2013, U.S. patent application Ser. No. 13/419,740, filed Mar. 14, 2012, U.S. Provisional Application No. 61/518,504, filed May 6, 2011, U.S. Provisional Application No. 61/572,638, filed Jul. 19, 2011, U.S. Provisional Application No. 61/672,249, filed Oct. 7, 2011, U.S. Provisional Application No. 61/548,779, filed Oct. 19, 2011, U.S. Provisional Application No. 61/570,044, filed Dec. 13, 2011, and U.S. Provisional Patent Application No. 61/853,715, filed Apr. 10, 2013 are hereby incorporated by reference as if presented herein in their entirety.

BACKGROUND OF THE DISCLOSURE

The present disclosure generally relates to cartons for holding beverage containers or other types of articles. More specifically, the present disclosure relates to cartons having an article protection feature and/or article protection flap that protects the containers or articles from breakage.

SUMMARY OF THE DISCLOSURE

In general, one aspect of the disclosure is directed to a carton for containing at least one article. The carton comprises at least one panel at least partially forming an interior of the carton. At least one article protection flap is for protecting the at least one article. The at least one article protection flap is foldably connected to the at least one panel and moveable between a first position that is substantially parallel to the at least one panel and a second position wherein the article protection flap is folded relative to the at least one panel. The article protection flap has features for preventing folding of the article protection flap from the second position to the first position.

In another aspect, the disclosure is generally directed to a blank for forming a carton for containing at least one article. The blank comprises at least one panel for at least partially forming an interior of the carton formed from the blank. At least one article protection flap is for protecting the at least one article. The at least one article protection flap is foldably connected to the at least one panel and moveable between a first position that is substantially parallel to the at least one panel and a second position wherein the article protection flap is folded relative to the at least one panel. The article protection flap has features for preventing folding of the article protection flap from the second position to the first position in the carton formed from the blank.

In another aspect, the disclosure is generally direct to a method of forming a carton. The method comprises obtaining a blank comprising at least one panel and at least one article protection flap foldably connected to the at least one panel. The method comprises positioning the at least one panel to at least partially form an interior space of the carton, loading at least one article in the interior space, and folding the at least one article protection flap relative to the at least one panel after the loading the at least one article. The folding comprises moving the article protection flap from a first position that is substantially parallel to the at least one panel to a second position wherein the article protection flap is folded relative to the at least one panel.

In another aspect, the disclosure is generally directed to a carton for containing at least one article. The carton can comprise at least one panel at least partially forming an interior of the carton and at least one article protection flap for protecting the at least one article. The at least one article protection flap can be foldably connected to the at least one panel along a lateral fold line and moveable between a first position that is substantially parallel to the at least one panel and a second position wherein the at least one article protection flap is folded relative to the at least one panel. The at least one article protection flap comprises a longitudinal crease, a first corner spaced apart from the longitudinal crease by a first distance, and a second corner spaced apart from the longitudinal crease by a second distance. The second distance can be greater than the first distance.

In another aspect, the disclosure is generally directed to a blank for forming a carton for containing at least one article. The blank can comprise at least one panel for at least partially forming an interior of the carton formed from the blank and at least one article protection flap for protecting the at least one article. The at least one article protection flap can be foldably connected to the at least one panel along a lateral fold line and moveable between a first position that is substantially parallel to the at least one panel and a second position wherein the at least one article protection flap is folded relative to the at least one panel. The at least one article protection flap comprises a longitudinal crease, a first corner spaced apart from the longitudinal crease by a first distance, and a second corner spaced apart from the longitudinal crease by a second distance. The second distance can be greater than the first distance.

In another aspect, the disclosure is generally direct to a method of forming a carton. The method can comprise obtaining a blank comprising at least one panel and at least one article protection flap foldably connected to the at least one panel along a lateral fold line. The at least one article protection flap comprises a longitudinal crease, a first corner spaced apart from the longitudinal crease by a first distance, and a second corner spaced apart from the longitudinal crease by a second distance. The second distance can be greater than the first distance. The method further can include positioning the at least one panel to at least partially form an interior space of the carton, and folding the at least one article protection flap relative to the at least one panel. The folding comprises moving the at least one article protection flap from a first position that is substantially parallel to the at least one panel to a second position wherein the at least one article protection flap is folded relative to the at least one panel.

In another aspect, the disclosure is generally directed to a carton for containing at least one article. The carton can comprise at least one panel at least partially forming an interior of the carton and at least one article protection flap for protecting the at least one article. The at least one article protection flap can be foldably connected to the at least one panel and can be moveable between a first position that is substantially parallel to the at least one panel and a second position wherein the at least one article protection flap is folded relative to the at least one panel. The at least one article protection flap can comprise features for preventing folding of the at least one article protection flap from the second position to the first position. The features can comprise at least one stop edge that selectively engages the at least one panel.

In another aspect, the disclosure is generally directed to a blank for forming a carton for containing at least one article. The blank can comprise at least one panel for at least partially forming an interior of the carton formed from the blank and at least one article protection flap for protecting the at least one article. The at least one article protection flap can be foldably connected to the at least one panel and moveable between a first position that is substantially parallel to the at least one panel and a second position wherein the at least one article protection flap is folded relative to the at least one panel. The at least one article protection flap can be at least partially defined by a line of weakening and can comprise features for preventing folding of the article protection flap from the second position to the first position in the carton formed from the blank. The features can comprise at least one stop edge for being at least partially formed by the line of weakening of the at least one article protection flap. The stop edge can be for selectively engaging the at least one panel when the carton is formed from the blank.

In another aspect, the disclosure is generally direct to a method of forming a carton. The method can comprise obtaining a blank comprising at least one panel and at least one article protection flap foldably connected to the at least one panel and at least partially separable from the at least one panel along a line of weakening. The method further can comprise positioning the at least one panel to at least partially form an interior space of the carton and folding the at least one article protection flap relative to the at least one panel. The folding can comprise moving the at least one article protection flap from a first position that is substantially parallel to the at least one panel to a second position wherein the at least one article protection flap is folded relative to the at least one panel. The folding further can comprise forming a stop edge of the at least one article protection flap from the line of weakening, the stop edge selectively engaging the at least one panel.

In another aspect, the disclosure is generally directed to a carton for containing at least one article. The carton can comprise at least one panel at least partially forming an interior of the carton and at least one article protection flap for protecting the at least one article. The at least one article protection flap can be foldably connected to the at least one panel along a lateral fold line and moveable between a first position that is substantially parallel to the at least one panel and a second position wherein the at least one article protection flap is folded relative to the at least one panel. The article protection flap comprises at least one tab extending laterally from a central portion of the at least one article protection flap.

In another aspect, the disclosure is generally directed to a blank for forming a carton for containing at least one article. The blank can comprise at least one panel for at least partially forming an interior of the carton formed from the blank and at least one article protection flap for protecting the at least one article. The at least one article protection flap can be foldably connected to the at least one panel along a lateral fold line and moveable between a first position that is substantially parallel to the at least one panel and a second position wherein the at least one article protection flap is folded relative to the at least one panel. The article protection flap can comprise at least one cut for forming at least one tab extending laterally from a central portion of the at least one article protection flap when the carton is formed from the blank.

In another aspect, the disclosure is generally direct to a method of forming a carton. The method can comprise obtaining a blank comprising at least one panel and at least one article protection flap foldably connected to the at least one panel along a lateral fold line, positioning the at least one panel to at least partially form an interior space of the carton, and folding the at least one article protection flap relative to the at least one panel. The folding can comprise moving the at least one article protection flap from a first position that is substantially parallel to the at least one panel to a second position wherein the at least one article protection flap is folded relative to the at least one panel. The folding further can comprise forming at least one tab extending laterally from a central portion of the at least one article protection flap.

In another aspect, the disclosure is generally directed to a carton for containing at least one article. The carton comprises a plurality of panels that extends at least partially around an interior of the carton. At least two end flaps are respectively foldably connected to respective panels of the plurality of panels. The end flaps are for being at least partially overlapped to close an end of the carton. At least one article protection feature is for protecting the at least one article. The at least one article protection feature is positioned between the at least two end flaps.

In another aspect, the disclosure is generally directed to a blank for forming a carton for containing at least one article. The blank comprises a plurality of panels for extending at least partially around an interior of the carton formed from the blank. At least two end flaps respectively foldably connected to respective panels of the plurality of panels. The end flaps are for being at least partially overlapped to close an end of the carton formed from the blank. At least one article protection feature is for protecting the at least one article. The at least one article protection feature is for being positioned between the at least two end flaps.

In another aspect, the disclosure is generally directed to a method of forming a carton for containing at least one article. The method comprises obtaining a blank comprising a plurality of panels and at least two end flaps respectively foldably connected to a respective panel of the plurality of panels. The method comprises positioning the plurality of panels to form an interior space of the carton, loading at least one article in the interior space, at least partially overlapping the at least two end flaps to close an end of the carton, and forming an article protection feature that is positioned between the at least two end flaps.

In another aspect, the disclosure is generally directed to a method of forming a carton. The method comprises obtaining a blank comprising a panel and at least one article protection flap foldably connected to the panel. The method comprises positioning at least two articles to be in contact with the panel and folding the at least one article protection flap relative to the panel after the positioning the at least two articles. The folding comprises moving the article protection flap from a first position that is substantially parallel to the panel to a second position wherein the article protection flap is folded relative to the panel.

In another aspect, the disclosure is generally directed to a carton for containing at least one article. The carton comprises at least one panel at least partially forming an interior of the carton. At least two end flaps are at least partially overlapped to at least partially close the interior of the carton. At least one article protection feature is for protecting the at least one article. The at least one article protection feature is positioned between the at least two end flaps. At least one article protection flap is for protecting the at least one article. The at least one article protection flap is foldably connected to the at least one panel and is moveable between a first position that is substantially parallel to the at least one panel and a second position wherein the article protection flap is folded relative to the at least one panel.

In another aspect, the disclosure is generally directed to a method of forming a carton. The method comprises obtaining a blank comprising at least one panel, at least one article protection flap foldably connected to the at least one panel, and at least two end flaps. The method comprises positioning the at least one panel to at least partially form an interior space of the carton, loading at least one article in the interior space, at least partially overlapping the at least two end flaps to close and end of the carton, forming an article protection feature that is positioned between the at least two end flaps, and folding the at least one article protection flap relative to the at least one panel after the loading the at least one article. The folding comprises moving the article protection flap from a first position that is substantially parallel to the at least one panel to a second position wherein the article protection flap is folded relative to the at least one panel.

In another aspect, the present disclosure is generally directed to a carton having at least one protection feature.

In another aspect, the present disclosure is generally directed to a blank for forming a carton having at least one protection feature.

In another aspect, the present disclosure is generally directed to a method of forming a carton having at least one protection feature for protecting articles held in the carton from breakage.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain a single article or a plurality of articles such as containers, bottles, cans, etc., and protection features of such cartons that protect the article or articles or containers from breakage, damage, or deformation. The article(s) can be used for packaging food and beverage products, for example, or any other item. The article(s) can be made from materials suitable in composition for packaging the particular food or beverage item, or other item, and the materials can include, but are not limited to, glass or other breakable material; aluminum and/or other metals; plastics such as PET, LDPE, LLDPE, HDPE, PP, PS, PVC, EVOH, and Nylon; paperboard; and the like, or any combination thereof, or any other suitable material.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
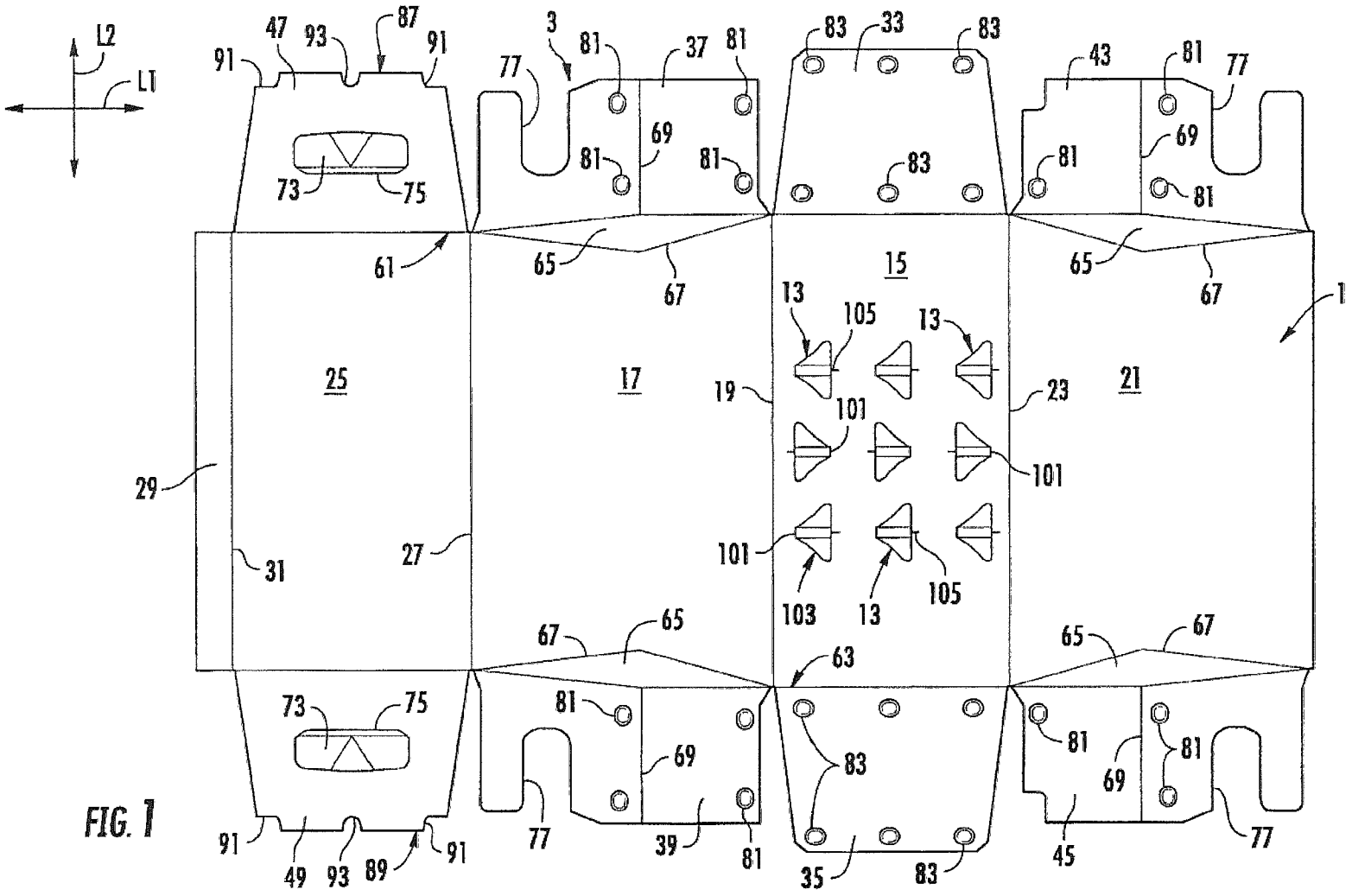
FIG. 1 is a plan view of an exterior surface of a blank for forming a carton according to a first embodiment of the disclosure.
Figure 3:
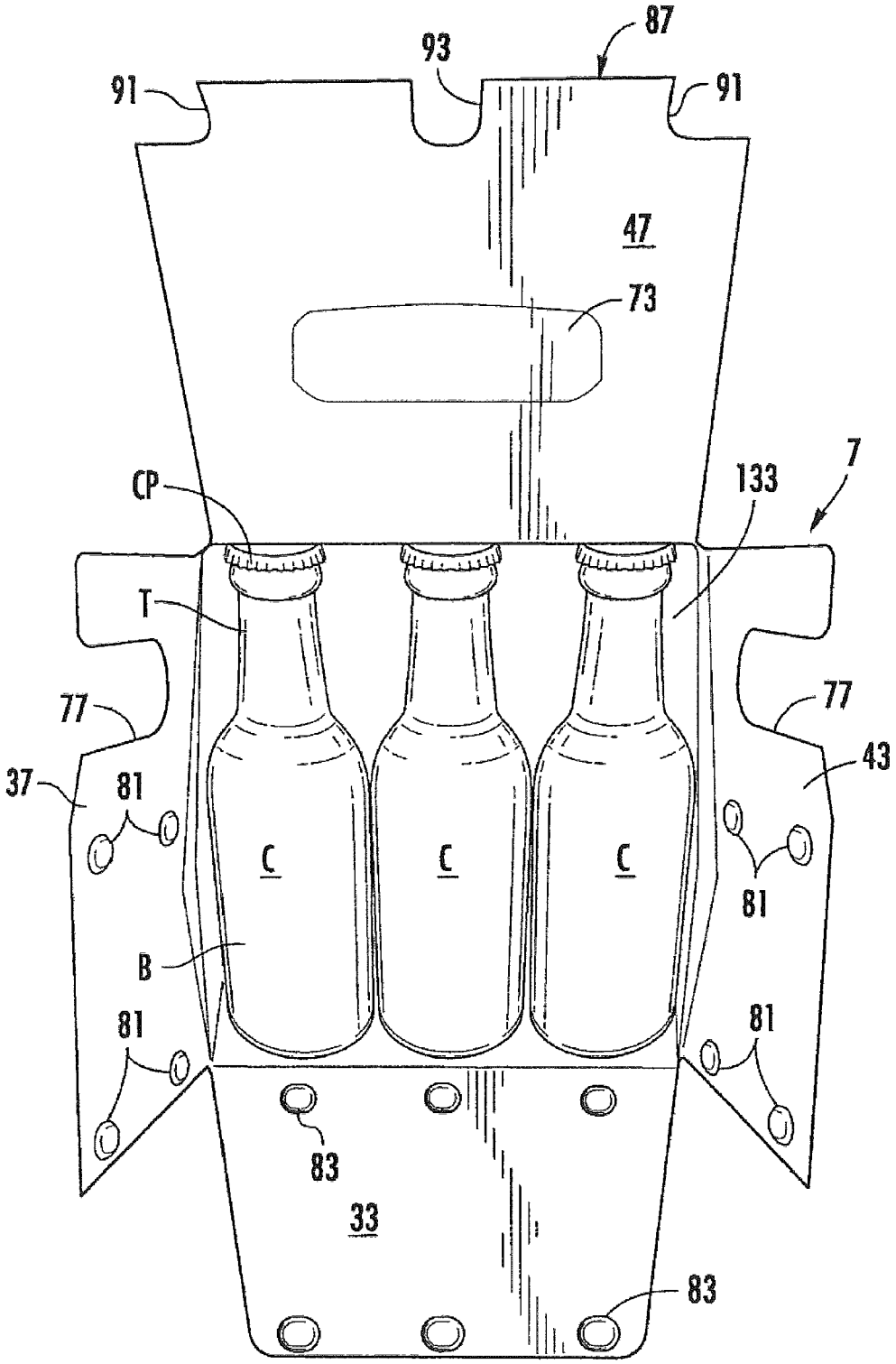
FIG. 3 is an end view similar to FIG. 2 with articles added to the partially assembled carton.

FIG. 1 is a plan view of the exterior side 1 of a blank, generally indicated at 3, used to form a carton 5 (FIG. 8) according to a first exemplary embodiment of the disclosure. The carton 5 can be used to house a plurality of articles such as containers C (FIG. 3). In the illustrated embodiment, the containers C are bottles having a wide bottom B and a narrow top T including a cap CP. In the illustrated embodiment, the carton 5 is sized to house eighteen containers C in a single layer in a 3×6 arrangement, but it is understood that the carton 5 may be sized and shaped to hold containers of a different or same quantity in more than one layer and/or in different row/column arrangements (e.g., 1×6, 2×6, 4×6, 3×8, 2×6×2, 3×4×2, 2×9, 3×4, etc.), or just a single article.

In one embodiment, the carton 5 has a first end 7 and a second end 9 each having article protection features 11, 11A, 11B (FIG. 8) for protecting at least one article C of the plurality of articles. Alternative, only a single article C could be provided in the carton 5. As will be further discussed below, the carton 5 of the first embodiment may have article protection flaps 13 for protecting the at least one article. The article protection features 11 cushion the ends 7, 9 of the carton and prevent or reduce the likelihood of breakage of the containers C. In one embodiment, the article protection flaps 13 are moveable between a first position (FIG. 10A) and a second position (FIGS. 8A and 10B) placed between adjacent containers C in the carton to reduce movement of the containers in the carton and prevent breakage of the containers. The carton 5 can have other features (e.g., handle, dispenser, etc.) without departing from the disclosure.

The blank 3 has a longitudinal axis L1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27, and foldably connected to an adhesive panel 29 at a lateral fold line 31.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The top panel 25 is foldably connected to a first top end flap 47 and a second top end flap 49. In one embodiment, when the carton 5 is erected, the end flaps 33, 37, 43, 47, close the first end 7 of the carton, and the end flaps 35, 39, 45, 49 close the second end 9 of the carton. In accordance with an alternative embodiment of the present disclosure, different flap arrangements can be used for closing the ends 7, 9 of the carton 5.

The end flaps 33, 37, 43, 47 extend along a first marginal area of the blank 3, and are foldably connected at a first longitudinal fold line 61 that extends along the length of the blank. The end flaps 35, 39, 45, 49 extend along a second marginal area of the blank 3, and are foldably connected at a second longitudinal fold line 63 that also extends along the length of the blank. The longitudinal fold lines 61, 63 may be, for example, substantially straight, or offset at one or more locations to account for blank thickness or for other factors. In one embodiment, the side panels 17, 21 have respective diamond panels 65 that are formed by a fold line 67 that is spaced inwardly from the respective longitudinal fold line 61, 63. Also, the side end flaps 37, 39, 43, 45 have a respective lateral fold line 69 extending from a diamond panel 65 to allow a respective end 7, 9 to angle inwardly so that the top of the carton 5 at each end (the portion of the fold line 61, 63 connecting the top end flap 47, 49) is closer to the center of the carton than the bottom of the carton at each end (the portion of the fold line 61, 63 connecting the bottom end flap 33, 35). In this way, the ends 7, 9 are tapered ends, but it is understood that the ends of the carton 5 could be otherwise shaped, arranged, and/or configured (e.g., straight or non-tapered) without departing from the disclosure.

In the embodiment of FIG. 1, the blank 3 has handle features for forming a handle 71. In the illustrated embodiment, the handle features comprise handle flaps 73 foldably connected to a respective top end flap 47, 49 at a longitudinal fold line 75, and notches or openings 77 in the side end flaps 37, 39, 43, and 45. The openings 77 cooperate to provide an opening at a respective closed end 7, 9 to allow a respective handle flap 73 to be inwardly folded so that the carton 5 can be grasped at a respective end. The blank 3 can have other features for forming the handle 71, or the blank and/or carton 5 can have a handle that is alternatively shaped, arranged, and/or configured without departing from the disclosure. Further, the handle 71 can be omitted without departing from the disclosure.

In one embodiment, the blank 3 has features for forming the article protection features 11 of the carton 5. As shown in FIG. 1, the side end flaps 37, 39, 43, 45 have deformations in the form of indentations 81 on the exterior surface of the blank 3 such that the indentations from a protrusion on the interior surface of the blank. The bottom end flap 33, 35 each have two rows of deformations in the form of indentations 83 on the interior surface of the blank 3 such that the indentations on the interior surface form a protrusion on the exterior surface 1 of the blank 3. As shown in FIG. 1, the top end flaps 47, 49 each have a respective distal edge 87, 89 having corner notches 91 and a center notch 93. The indentations 81, 83 can be any deformation on a surface of a respective side end flaps 37, 39, 43, 45 or bottom end flap 33, 35 such that the deformation can be any suitable shape (e.g., a concave depression or protrusion, convex depression or protrusion, flat depression or protrusion, embossed area, debossed area, etc., or any other suitable shape). Furthermore, the indentations 81, 83 could be formed on the interior or exterior surface of one or more of the first side panel 17, second side panel 21, top panel 25, bottom panel 15, or top end flaps 47, 49 without departing from the disclosure.

In the first embodiment, the blank 3 includes nine article protection flaps 13 arranged in a 3×3 arrangement, but the blank could have more or less than nine article protection flaps, and the flaps could be otherwise arranged in other suitable row/column arrangements or in a random configuration on the bottom panel 15, including a single row or single column configuration, or any other suitable configuration. The description herein will describe the detailed arrangement and configuration of a single article protection flap 13; however, the arrangement and configuration of the other article protection flaps will be similar or identical. In other embodiments, the blank 3 can include article protection flaps that are different, similar, or identical to other article protection flaps without departing from the disclosure. In the embodiment of FIG. 1, the middle row of article protection flaps 13 are oriented 180 degrees relative to a row of article protection flaps that are closer to a respective fold line 61, 63. In other embodiments, the article protection flaps 13 could be otherwise shaped, arranged, and/or configured without departing from the disclosure.

Figure 10A:
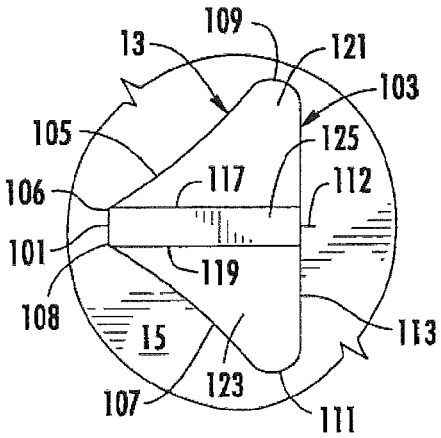
FIG. 10A is a top plan view of an enlarged portion of a bottom panel of FIG. 1 showing an article protection flap in a first position.

As shown in FIGS. 1 and 10A, the article protection flaps 13 are each foldably connected to the bottom panel 15 at a respective lateral fold line 101 and are each at least partially defined by a line of weakening 103 in the bottom panel. In one embodiment, the line of weakening 103 is a cut, but the line of weakening could comprises other forms of weakening (e.g., a tear line that comprises cut lines separated by breakable nicks, a tear line that is formed by a series of spaced apart cuts, etc.) that allows the article protection flap 13 to separate from the bottom panel 15 without departing from the disclosure. The cut 103 has a first portion 105 that is generally curved and extending from a first end 106 of the fold line 101 and a second portion 107 that is generally curved and extending from a second end 108 of the fold line 101. Both the first portion 105 and the second portion 107 of the cut 103 extend away from the fold line 101 and form a respective rounded corner 109, 111 of the cut that transitions to a third portion 113 of the cut. The third portion 113 is generally straight and extends in the lateral direction L2 between the two rounded corners 109, 111. In one embodiment, a slit or cut 112 is located adjacent the third portion 113 of the cut 103. As show in FIGS. 1 and 10A, the article protection flap 13 comprises a second fold line 117 extending from the first end 106 of the first fold line 101 and a third fold line 119 extending from the second end 108 of the first fold line. In the first embodiment, the second and third fold lines 117, 119 are longitudinal fold lines that are generally parallel and extend in the longitudinal direction L1 of the blank 3. The fold lines 101, 117, 119 and cuts 103, 105 could be otherwise shaped, arranged, configured, and/or omitted such that the article protection flap 13 has any other suitable shape or configuration without departing from the disclosure.

In one embodiment, the first portion 105 of the cut 103, the rounded corner 109 of the cut, a portion of the third portion 113 of the cut, and the second fold line 117 at least partially define a first portion 121 of the article protection flap 13. The second portion 107 of the cut 103, the rounded corner 111 of the cut, a portion of the third portion 113 of the cut, and the third fold line 119 at least partially define a second portion 123 of the article protection flap. A central portion 125 of the article protection flap is at least partially defined by the first fold line 101, second fold line 117, third fold line 119, and a portion of the third portion 113 of the cut 103. The first portion 121 of the article protection flap 13 is foldably connected to the central portion 125 at the second fold line 117. The second portion 123 of the article protection flap 13 is foldably connected to the central portion 125 at the third fold line 119. The first portion 121 and the second portion 123 are foldable relative to each other and the central portion 125 by way of the fold lines 117, 119. Alternatively, the first portion 121 and second portion 123 could be foldably connected at a single fold line without departing from the disclosure.

Figure 2:
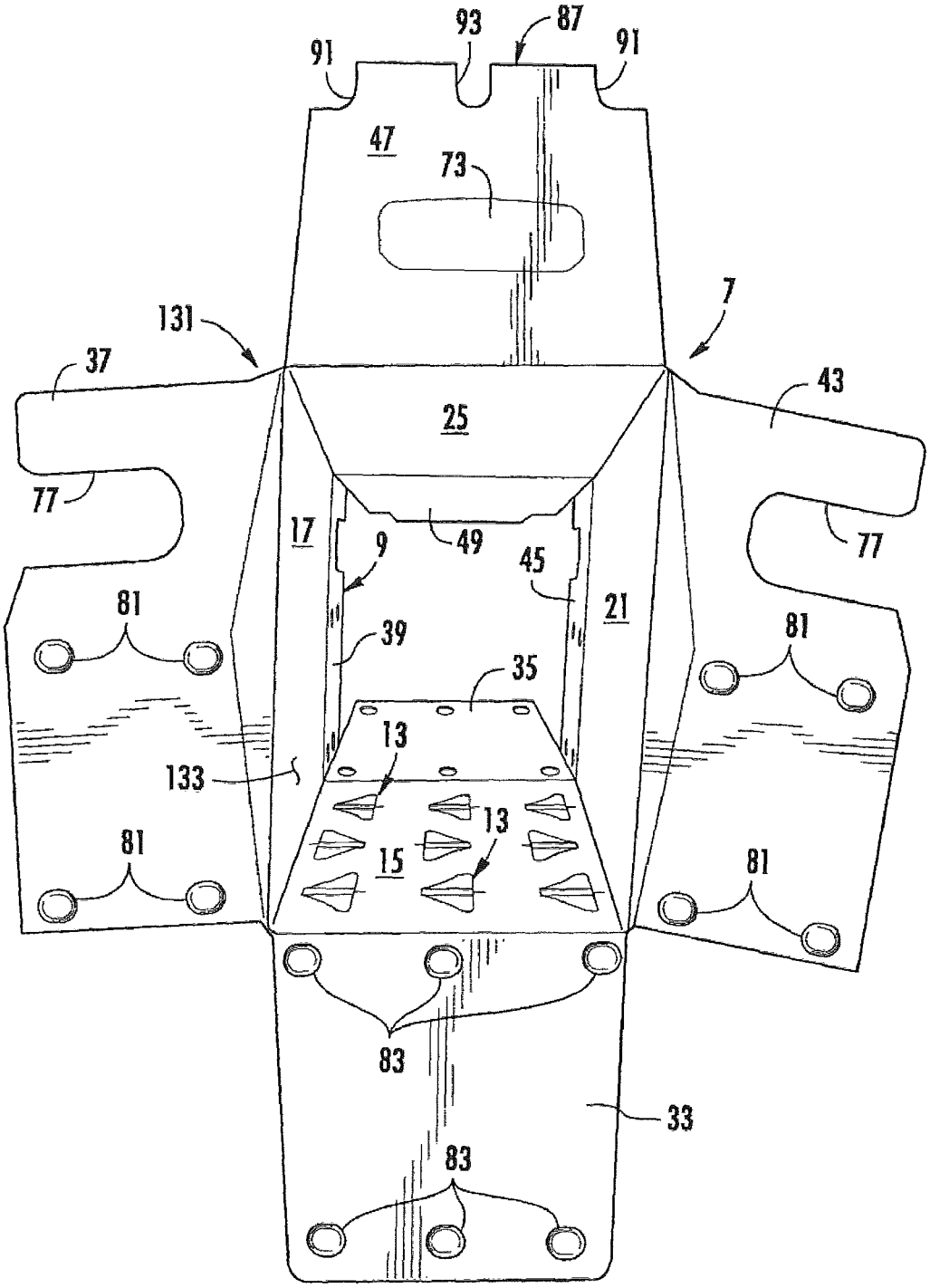
FIG. 2 is an end perspective of the partially assembled carton of the first embodiment.

FIGS. 2-8 show one exemplary method of forming the carton 5 and the article protection features 11. As shown in FIG. 2, the blank 3 can be formed into a sleeve 131 having open ends 7, 9 by folding the bottom panel 15, side panels 17, 21, and top panel 25 along respective fold lines 19, 23, 27, 31. The adhesive panel 29 can be adhesively secured to the second side panel 21 by glue or other suitable adhesive. As shown in FIG. 3, containers C can be placed into an interior space 133 of the sleeve 131. One of the ends 7, 9 can be closed prior to loading the containers C or both of the ends 7, 9 can be closed after loading the containers into the interior space 133. The closing of the first end 7 is described below, but it is understood that the second end 9 can be closed in a similar manner, with the article protection features 11 in the second end being formed in a similar manner as the article protection features in the first end. Alternatively, the second end 9 could have different flap closing sequence or arrangement and the article protection features 11 could be otherwise shaped, arranged, configured, and/or omitted without departing from the disclosure.

Figure 4:
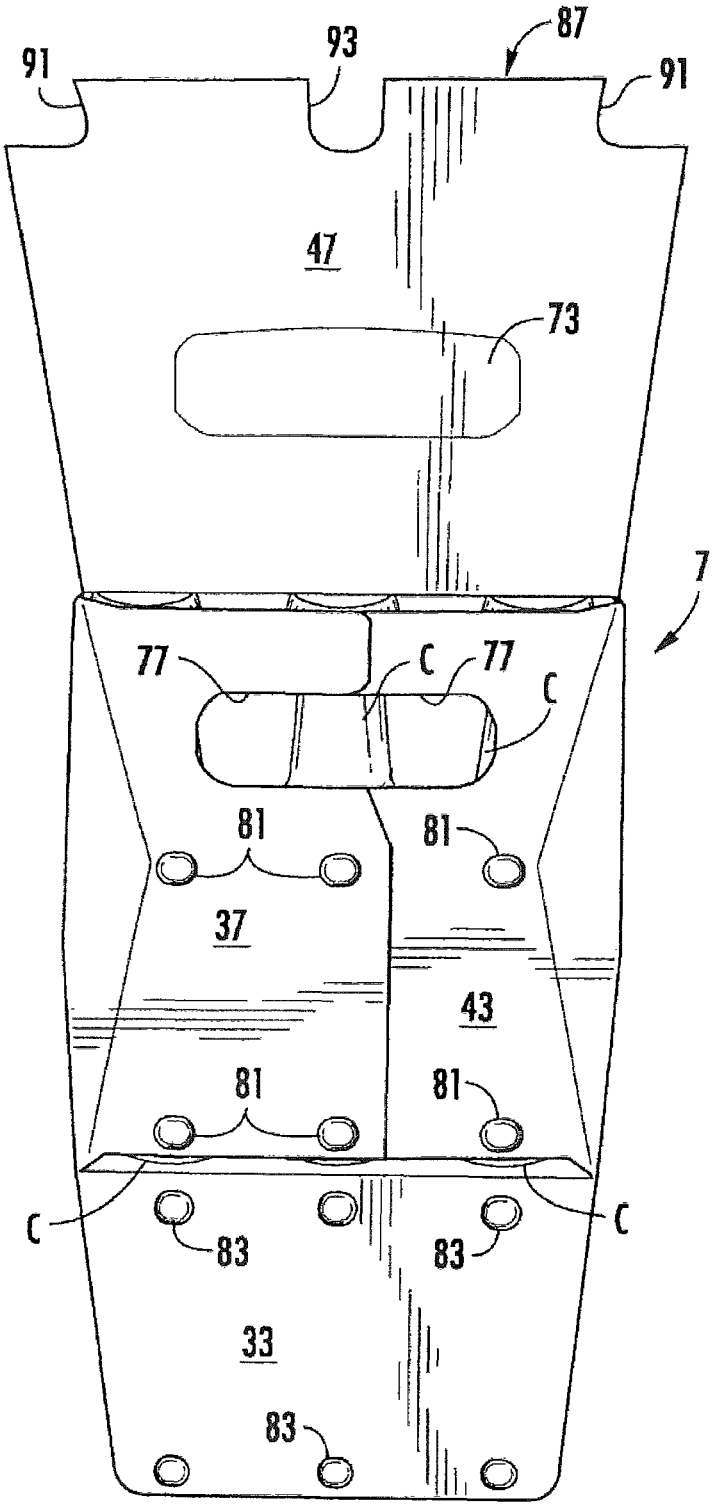
FIG. 4 is a view similar to FIG. 3 but showing the carton further assembled.
Figure 5:
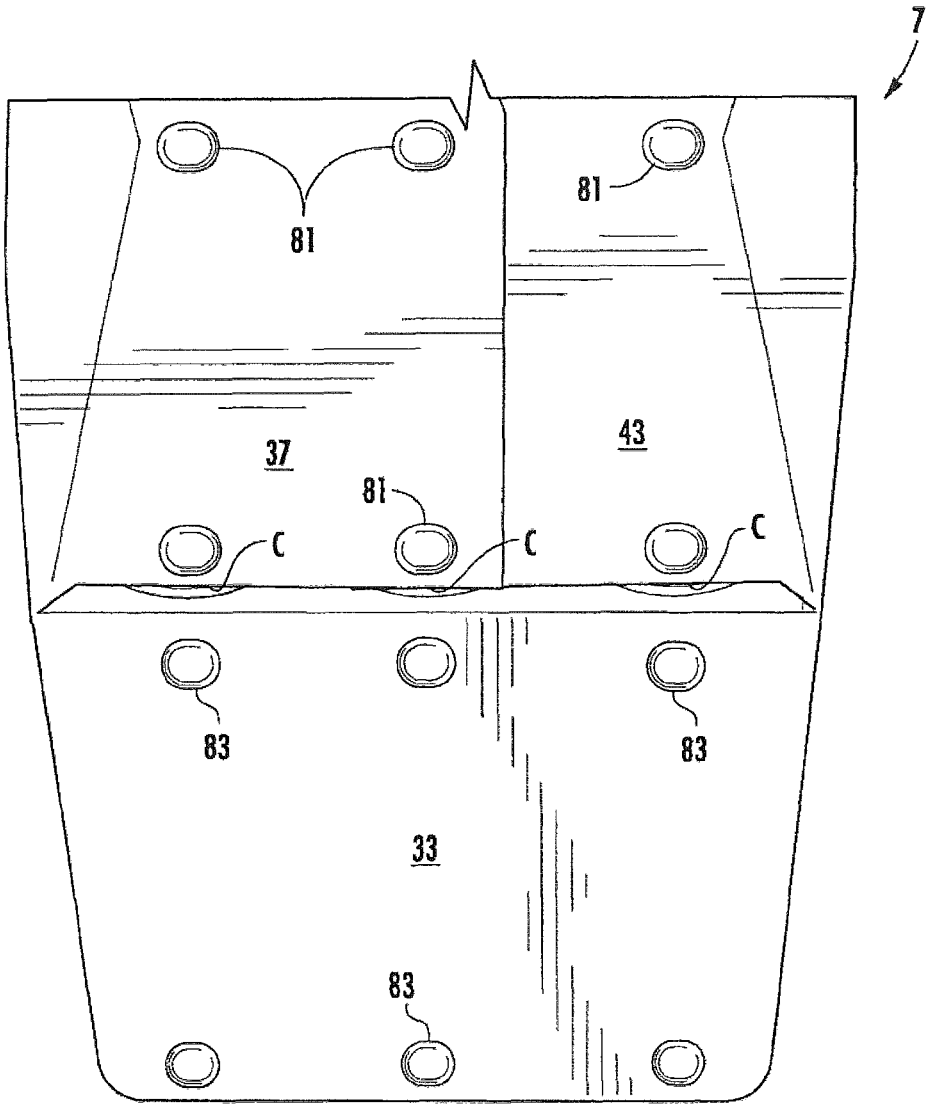
FIG. 5 is an enlarged portion view of FIG. 4.
Figure 6:
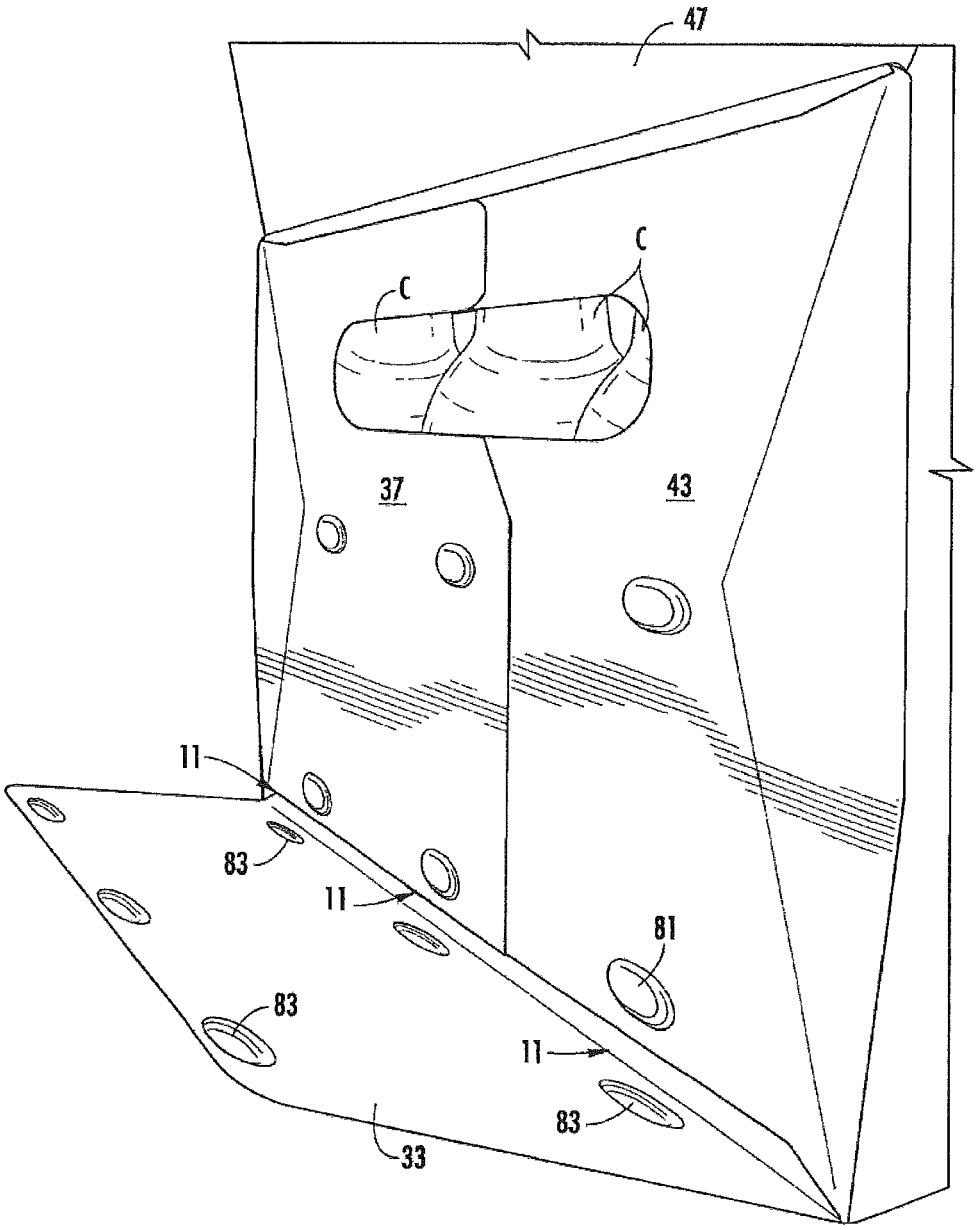
FIG. 6 is a side perspective showing the carton of FIG. 5 further assembled.
Figure 7:
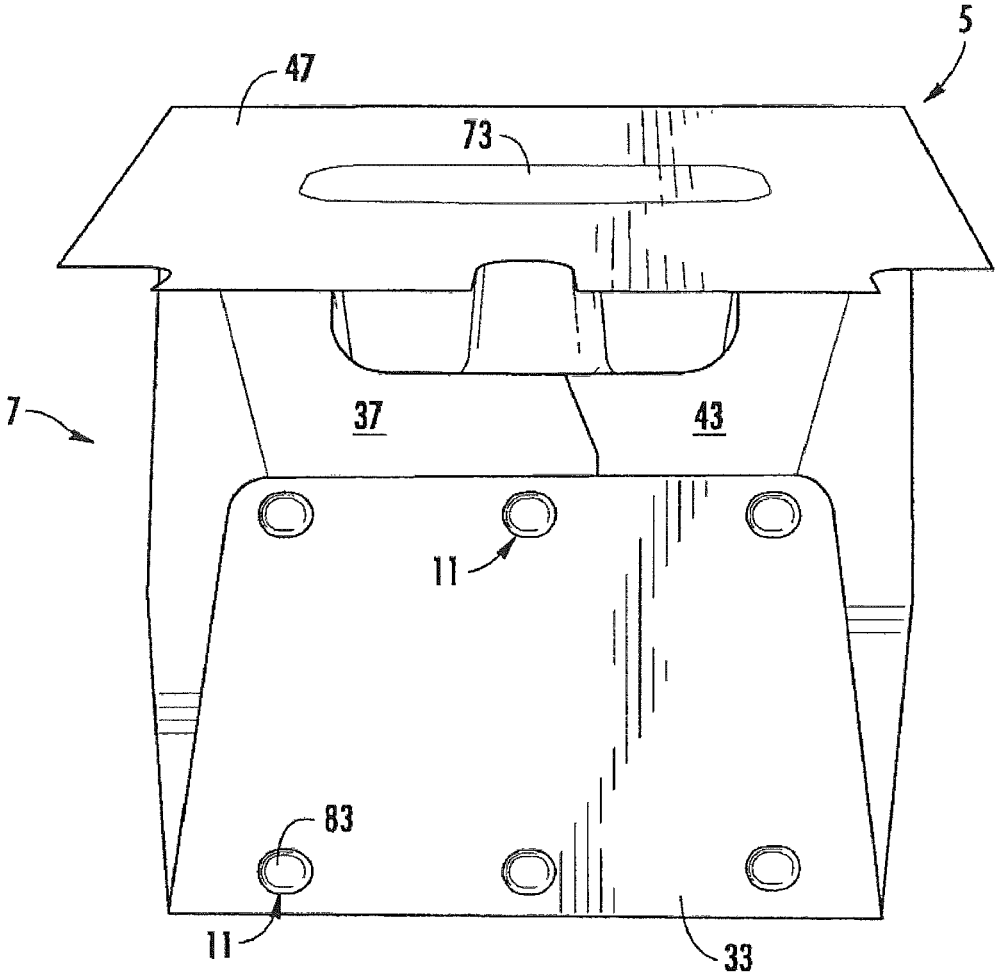
FIG. 7 is an end view showing the carton of FIG. 6 further assembled.
Figure 8:
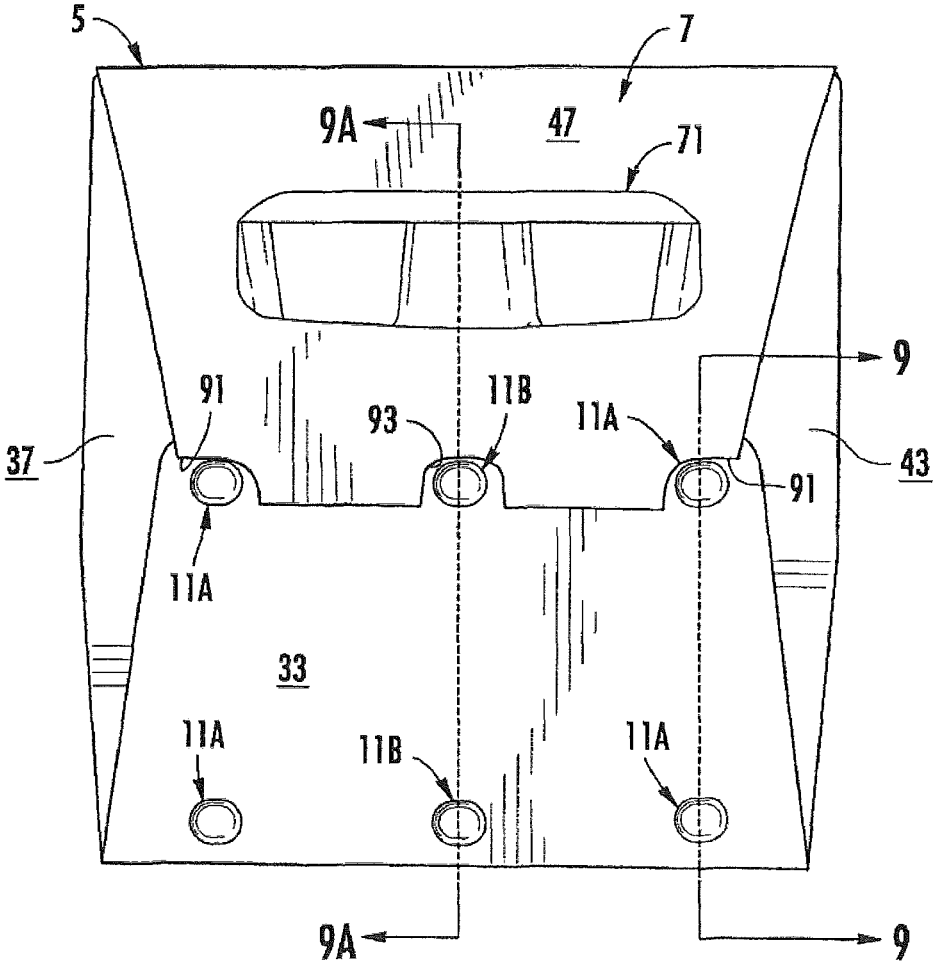
FIG. 8 is an end view showing the carton further assembled.
Figure 9:
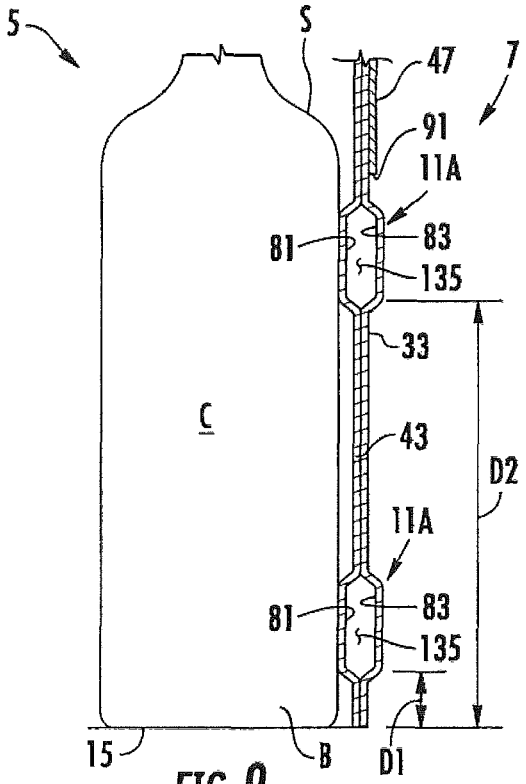
FIG. 9 is a cross-section taken along the plane 9-9 of FIG. 8.

As shown in FIGS. 3 and 4, the first end 7 is closed by first inwardly folding the side end flaps 37, 43. As shown in FIGS. 5-7, the bottom end flap 33 is upwardly folded and the top end flap 47 is downwardly folded to close the end 7 of the carton 5. The article protection features 11 in the first end of the carton 5 are formed during the closing of the end flaps 33, 37, 43, 47. As shown in FIG. 6, the indentations 81 on the exterior surface of the side end flaps 37, 43 are aligned with the indentations 83 on the interior surface of the bottom end flap 33 to form a respective article protection feature 11. As shown in FIGS. 8 and 9, the outermost article protection features (when viewing the end 7 as shown in FIG. 9) are identified by reference number 11A and are formed by the indentation 81 on the side end flap 43 and the indentation 83 on the bottom end flap 33 that cooperate to form a pocket 135 in the overlapped end flaps. In one embodiment, the width of the pocket 135 as viewed in FIG. 9 is approximately equal to the combined amount of depression of each of the indentations 81, 83. The indentations 81 are on the exterior surface of the side end flaps 37, 43 and the indentations 83 are on the interior surface of the bottom end flap 33 so that the indentations 81, 83 cooperate to form the pocket 135. Alternatively, the article protection features 11 could comprise only a single indentation 81, 83, or one of the indentations 81, 83 could be larger or smaller than the other, or the indentations 81, 83 could be offset from one another, without departing from the disclosure. Moreover, the indentations 81, 83 could be arranged such that the protrusions are in direct contact with each other.

Figure 9A:
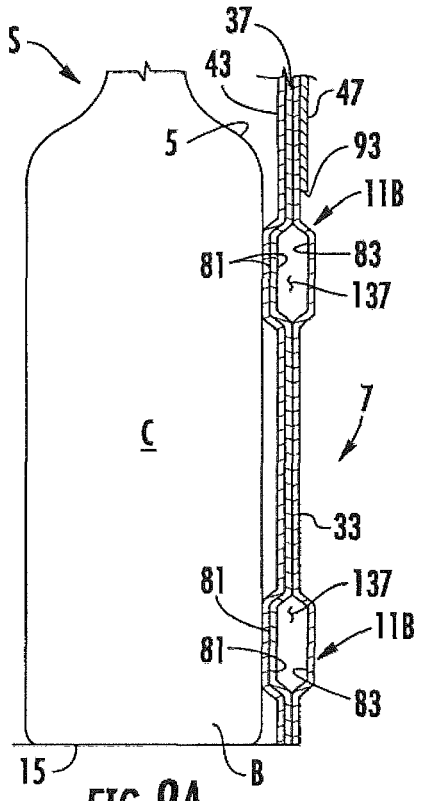
FIG. 9A is a cross-section taken along the plane 9A-9A of FIG. 8.

In one embodiment, the middle article protection features 11B (FIGS. 8 and 9A) are formed by an indentation 81 on each of the side end flaps 37, 43 and an indentation on the bottom end flap 33. As shown in FIG. 9A, the indentation 81 near the edge of the inner side end flap 43 receives the indentation 81 near the edge of the outer side end flap 37, and the indentation 83 on the bottom end flap 33 cooperates with the indentation on the outer side end flap 37 to form the pocket 137. The article protection features 11A, 11B, and pockets 135, 137 could be otherwise shaped, arranged, positioned, and/or configured without departing from the disclosure.

Figure 9B:
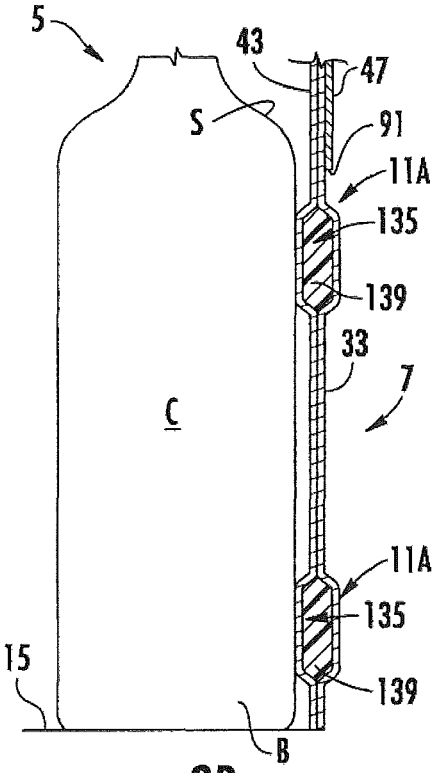
FIG. 9B is a view similar to FIG. 9 but showing alternative features of the carton.
Figure 9C:
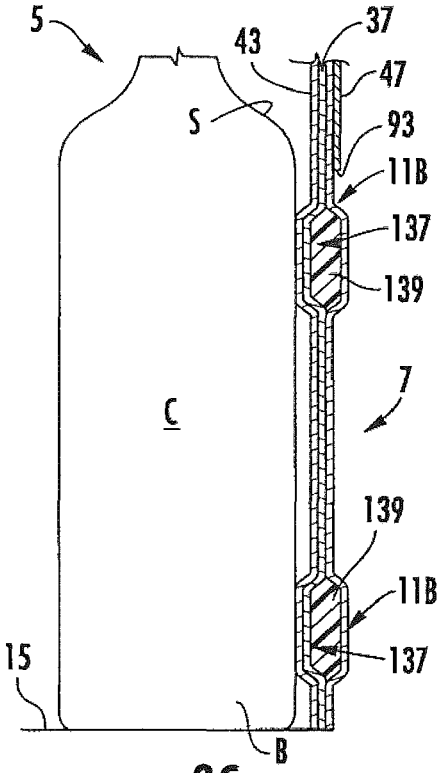
FIG. 9C is a view similar to FIG. 9A but showing alternative features of the carton.

FIGS. 9B and 9C show alternative configurations of the article protection features 11A, 11B having pockets 135, 137 similar to the embodiments of FIGS. 9 and 9A but filled with shock absorbing material 139. In one embodiment, the shock absorbing material 139 is a thermoplastic adhesive. The shock absorbing material 139 can comprise thermoplastic adhesive that can be hot-melt adhesive including a low temperature hot melt thermoplastic adhesive or a high temperature hot melt thermoplastic adhesive such as are commercially available. Such hot melt adhesive can include ethylene vinyl acetate (EVA) or any other suitable material. For example, the shock absorbing material 139 can comprise any suitable foam, gel, liquid, or solid, that can be located in the pocket 135, 137 and provide cushioning of the impact forces exerted on the carton 5. For example, the shock absorbing material could comprise any suitable heat activation material, UV activation material, laser activation material, Styrofoam, thermoplastic, hot melt adhesive, or any material that takes up space in the pocket 135, 137 to provide cushioning to the containers C. The article protection features 11 can comprise the same or different thermoplastic adhesive that is used to form and close the carton 5 without departing from the disclosure. In one embodiment, the adhesive used to form the shock absorbing material 139 can be further applied to one or more of the end flaps 33, 37, 43, 47 to secure the end flaps in the closed configuration of the end 7.

As shown in FIG. 9, the lower article protection feature 11, 11A, 11B is spaced apart from the bottom panel 15 by a first distance D1 and the upper article protection feature 11, 11A, 11B is spaced apart from the bottom panel by a second distance D2. In one embodiment, the second distance D2 is greater than the first distance D1. The distances D1 can be selected so that the lower article protection feature 11 contacts the container C near a bottom portion B of the container. The distance D2 can be selected so that the upper article protection feature 11 contacts the container C near the shoulder S of the container. The positioning of the upper and lower article protection features 11 provides a respective container C with two contact points with the shock absorbing features at the end 7 of the carton 5 so that each respective container C is stabilized and cushioned against impacts occurring at the end of the carton. The article protection features could be otherwise arranged and positioned without departing from the disclosure.

Figure 4A:
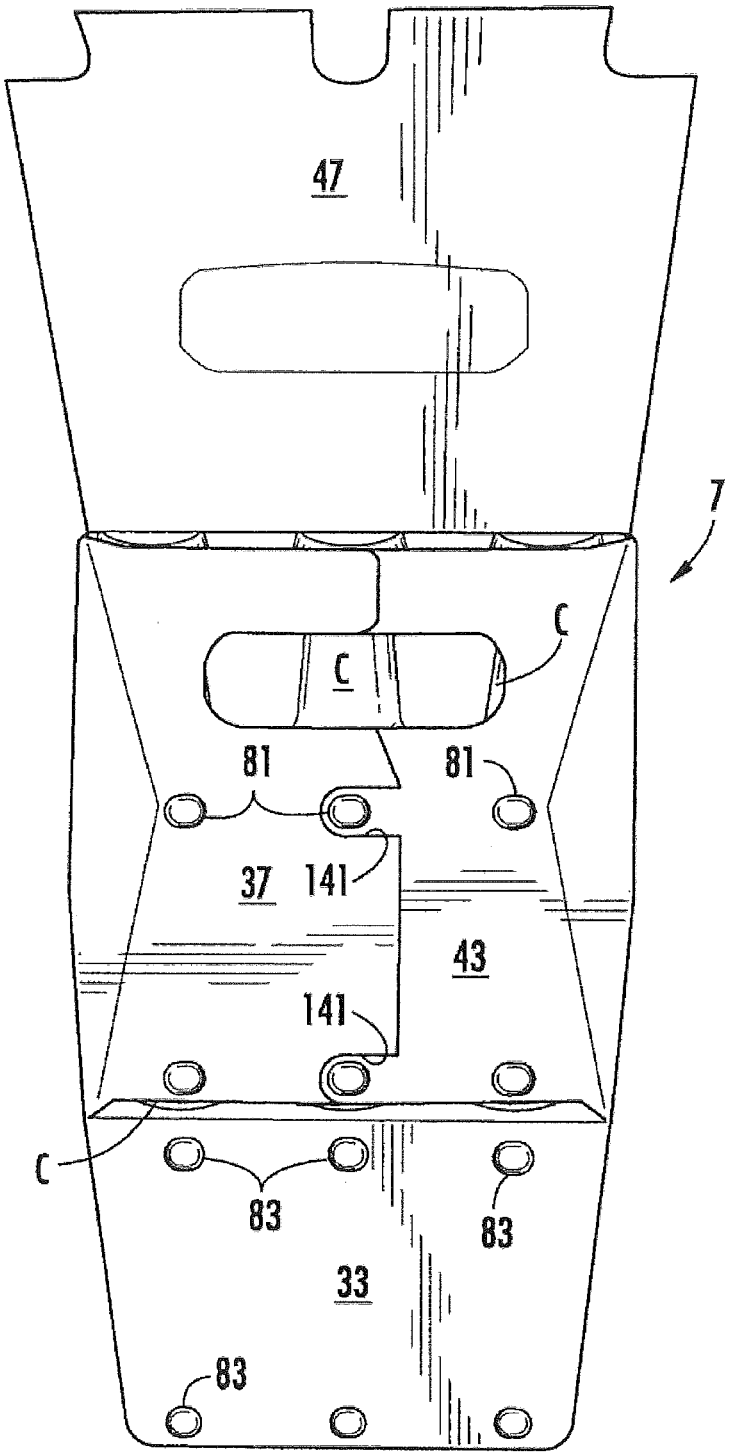
FIG. 4A is a view similar to FIG. 4 but showing alternative features of the carton.

FIG. 4A shows an alternative configuration of the end 7 wherein the side end flap 37 has two notches 141 instead of the indentations 81. The notches 141 allow the indentations 81 near the edge of the exterior surface of the side end flap 43 to cooperate with the middle indentations 83 on the bottom end flap 33 to form a pocket similar to the pocket 135 shown in FIG. 9, but with the pocket 135 being wider as a result of the intervening layer of material from the side end flap 37.

Figure 5A:
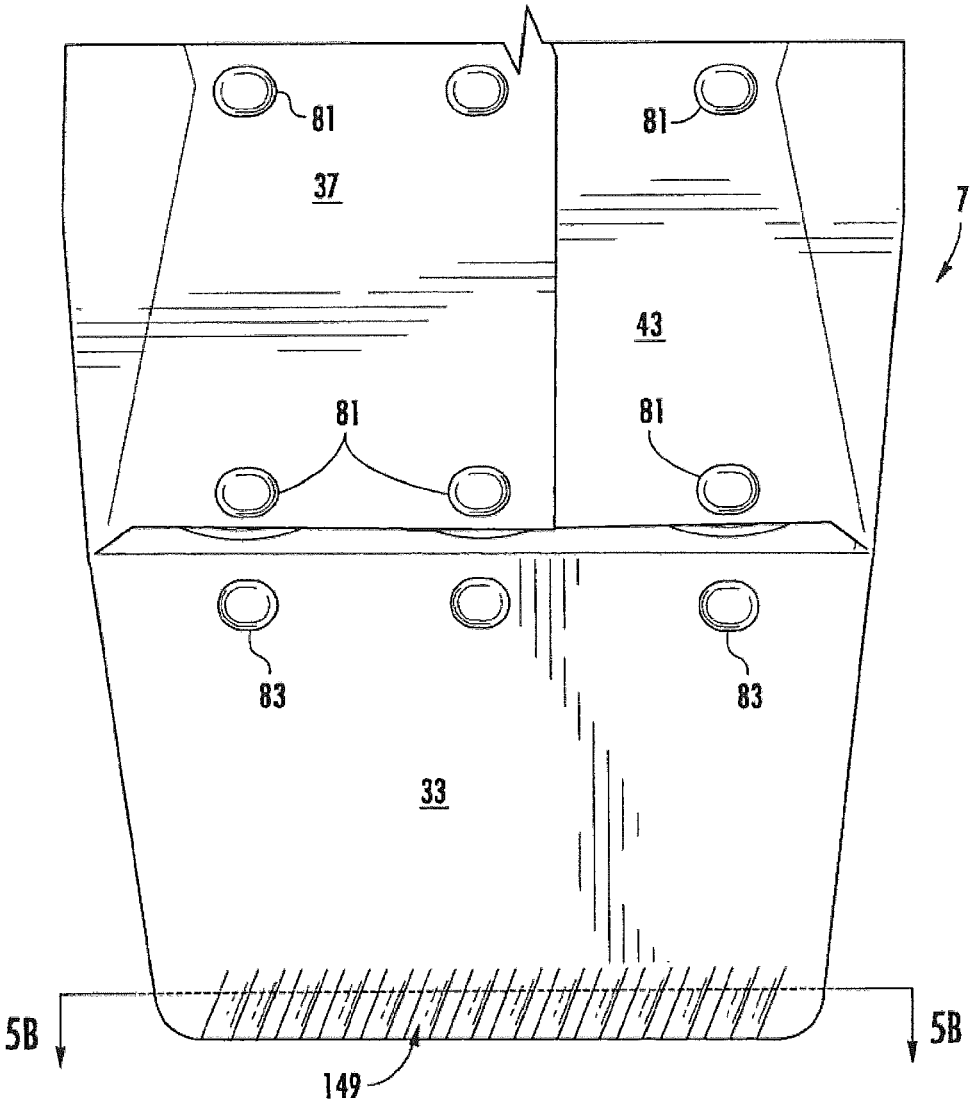
FIG. 5A is a view similar to FIG. 5 but showing alternative features of the carton.
Figure 5B:
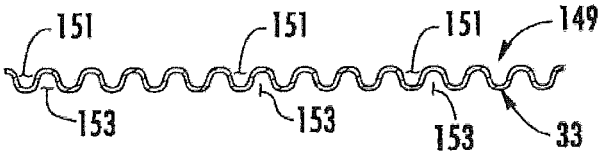
FIG. 5B is a cross-section taken along the plane 5B-5B of FIG. 5A.

FIGS. 5A and 5B show an alternative configuration of the end 7 wherein the bottom end flap 33 is modified from the bottom end flap shown in FIG. 4. In the embodiment of FIGS. 5A and 5B, the indentations 83 on the interior surface near the peripheral edge of the bottom end flap 33 of FIG. 4 are replaced by a deformation 149 at the peripheral edge of the bottom end flap 33. The deformation 149 includes a series of indentations 151 on the interior surface of the bottom end flap 33 that are adjacent to a respective indentation on the exterior surface 153 of the bottom end flap. The indentations 151 on the interior surface of the bottom end flap 33 communicate with the upper indentations 81 on the side end flaps 37, 43 to form a respective pocket or series of pockets. Alternatively, the upper indentations 81 on the side end flaps 37, 43 could be replaced with a deformation similar to the deformation 149 of the bottom end flap, or any other configuration that is suitable for creating a pocket or series of pockets that form the article protection features.

Figure 5C:
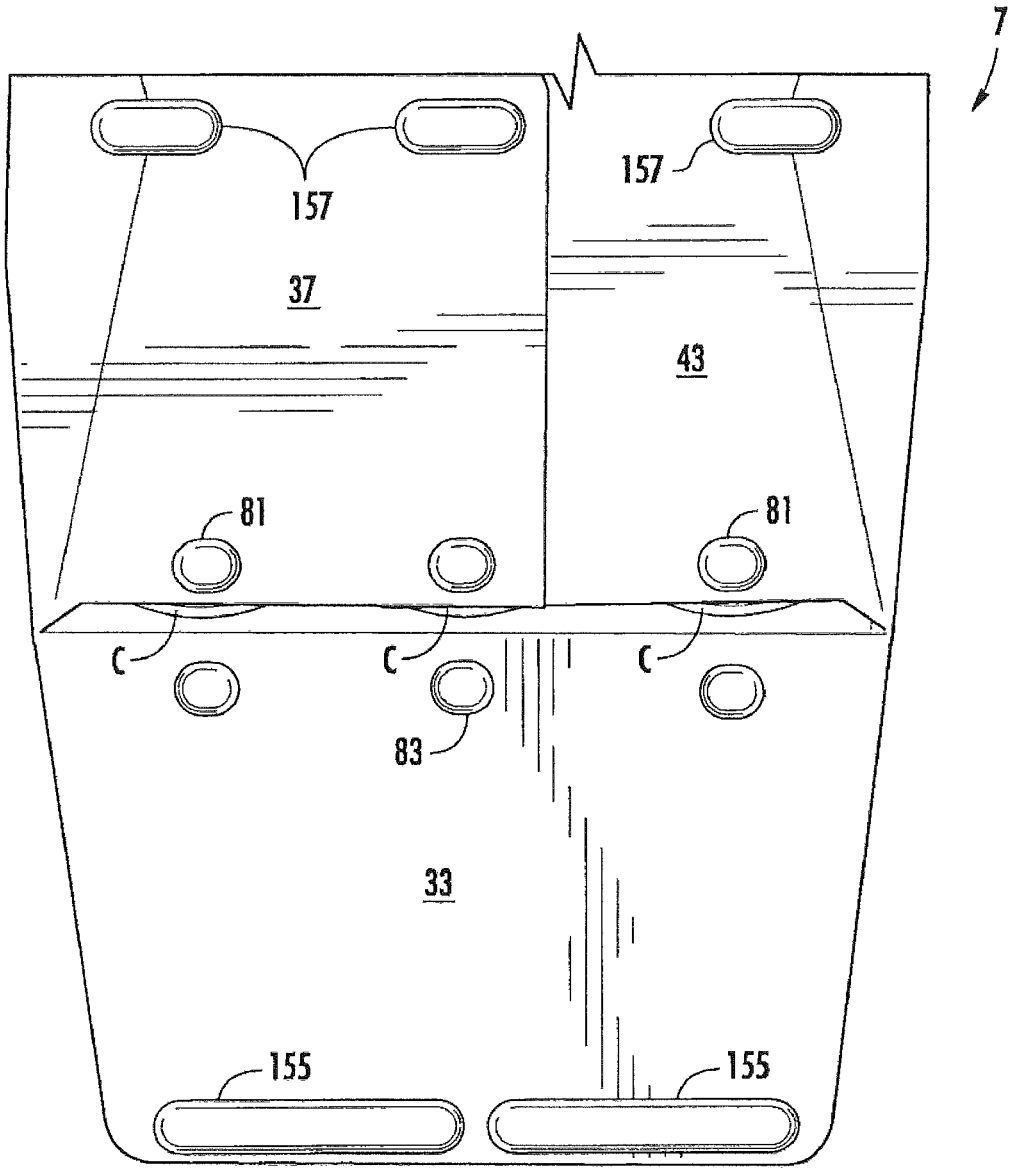
FIG. 5C is a view similar to FIG. 5 but showing alternative features of the carton.

FIG. 5C shows an alternative configuration of the end 7 wherein the side end flaps 37, 43 and bottom end flap 33 are modified from the flaps shown in FIG. 4. In the embodiment of FIG. 5C, the bottom end flap 33 has indentations 155 on the interior surface near the peripheral edge of the bottom end flap that are modified from the embodiment of FIG. 4. Further, the side end flaps 37, 43 each have upper indentations 157 that are modified from the embodiment of FIGS. 4 and 5. Both groups of indentations 155, 157 are elongated from the embodiment of FIGS. 4 and 5, and the indentations 155 on the bottom end flap are each sized to extend between two adjacent indentations 157 on the side end flaps 37, 43. The indentations 155 are in communication with multiple indentations 157 so that the pocket formed by the cooperating indentations forms an article protection feature 11 that is elongated and contacts two adjacent articles C. The elongated article protection feature can be filled with shock absorbing material in a similar manner as described above for the first embodiment. Alternative, the lower indentations on the interior surface of the bottom end flap 33 and the lower indentations 81 on the side end flaps 37, 43 could be similar to the indentations 155, 157 without departing from the disclosure.

Figure 8A:
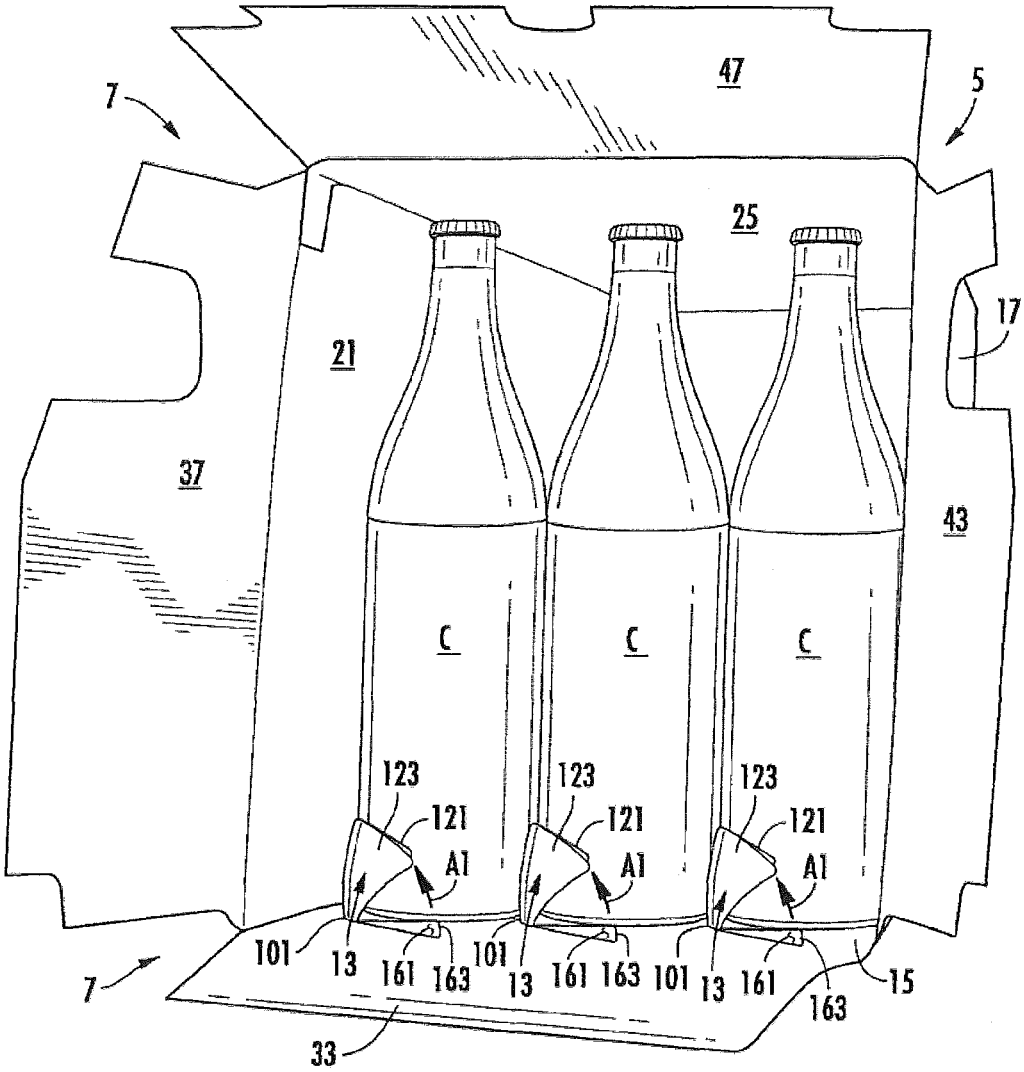
FIG. 8A is an end view of a partially assembled carton of the first embodiment with the article protection flaps in the second position.

In the first embodiment, the loaded and closed carton 5 of FIG. 8 is further processed so that the article protection flaps 13 are activated. The article protection flaps 13 are foldably connected to the bottom panel 15 and moveable between a first position (FIG. 2) that is substantially parallel to the bottom panel and a second position (FIG. 8A) wherein the article protection flaps are folded relative to the bottom panel. In one embodiment, the article protection flaps 13 are raised or activated to the position of FIG. 8A, and the article protection flaps have features for preventing the folding of the article protection flaps from the second position back to the first position. FIG. 8A illustrates an outermost row of containers C removed and the end flaps 33, 37, 43, 47 at the end 7 open so that the article protection flaps 13 are visible. It is understood that the article protection flaps 13 will be activated to the second position (FIG. 8A) after the ends 7, 9 of the carton 5 have been closed. Alternatively, the article protection flaps 13 could be activated prior to closing one or both of the ends 7, 9 of the carton 5 without departing from the disclosure.

Figure 10B:
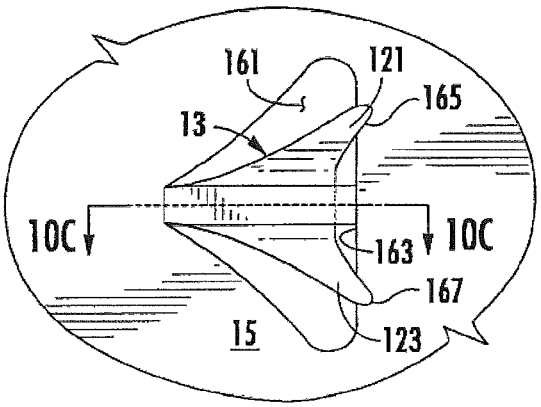
FIG. 10B is a top plan view of the article protection flap of FIG. 10A in a second position.
Figure 10C:
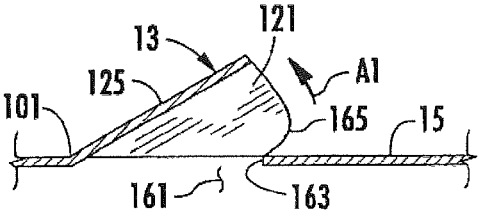
FIG. 10C is a cross-section taken along the plane 10C-10C of FIG. 10B.

The article protection flaps 13 can be activated by various forming apparatus, some of which will be described below in further detail, or any other suitable method. The activation of a single article protection flap 13 will be described in detail herein, but it is understood that the other article protection flaps can be activated in a similar or different manner without departing from the disclosure. FIGS. 10A and 10B are enlarged portions of the interior surface of the bottom panel 15, with FIG. 10A showing the interior surface of the bottom panel prior to activation of the article protection flap 13, and FIG. 10B showing the interior of the bottom panel after activation of the article protection flap. In one embodiment, a finger or other portion of an apparatus for forming the carton 5 presses against the central portion 125 (FIG. 10A) of the article protection flap 13 to initiate separation of the article protection flap from the bottom panel 13 along the cut 103. As shown in FIGS. 8A, 10A, and 10C, the article protection flap 13 is pivoted upward relative to the bottom panel 15 at the fold line 101 in the direction of arrow A1 to create an opening 161 in the bottom panel. As the article protection flap 13 is activated, the first portion 121 and the second portion 123 are folded relative to each other. In one embodiment, the first portion 121 and the second portion 123 of the article protection flap are folded inwardly relative to each other and relative to the central portion 125. As such, the article protection flap 13 provides two layers of material (e.g., the inwardly folded first portion 121 and second portion 123) between adjacent containers C in the carton 5.

In one embodiment, the article protection flaps 13 are upwardly folded to the second (raised) position shown in FIG. 8A, or the article protection flaps can be upwardly folded to a second (raised) position shown in FIG. 10C. In one embodiment, the upwardly folding of the article protection flaps 13 causes the containers C in the carton 5 to move to accommodate the space required for the article protection flaps in the second position with the first portion 121 and second portion 123 folded relative to each other. The movement of the containers C when the article protection flaps 13 are upwardly folded and located between adjacent containers, tightens the packing of the containers in the carton 5 so that the movement of the containers is limited by the positioning of the article protection flaps 13 and the respective end flaps 33, 37, 43, 47 and 35, 39, 45, 49 at the closed ends 7, 9 of the carton. The article protection flaps 13 are pressed against two adjacent containers C to initiate movement of the containers and provide the tightening feature of the article protection flaps.

In one embodiment, the configuration of the first portion 121 and the second portion 123 prevents the article protection flap 13 from being downwardly folded from the second or raised position of FIG. 8 to the first or lowered position of FIG. 2. As shown in FIG. 10B, when the first portion 121 and the second portion 123 of the article protection flap 13 are inwardly folded relative to each other, the first and second portions extend beyond the edge 163 of the opening 161 created at the third portion 113 of the cut 103. In one embodiment, an edge 165 (FIG. 10C) of the first portion 121 of the article protection flap 13, formed by the rounded corner 109 of the cut 103 extends beyond the edge 163 of the opening 161. Also, an edge 167 (FIG. 10C) of the second portion 123 of the article protection flap 13 formed by the rounded corner 111 of the cut 103 extends beyond the edge 163 of the opening 161. The positioning of the distal portions of the first portion 121 and second portion 123, including the edges 165, 167 of the article protection flap 13, relative to the edge 163 of the opening 161 prevents the article protection flaps 13 from being downwardly folded to the first position wherein the article protection flaps are substantially parallel to the bottom panel 15. As such, once the article protection flaps 13 are raised to the second position and positioned between adjacent containers C, the article protection flaps stay in the upwardly folded position providing cushioning and protection between adjacent containers. The article protection flaps 13 could be otherwise shaped, arranged, and/or configured to have other features for preventing the article protection flaps from returning to the first or lowered position without departing from the disclosure.

Figure 10D:
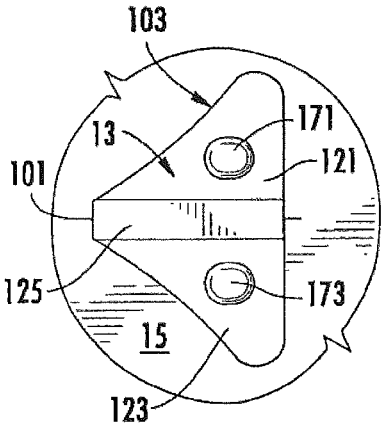
FIG. 10D is a view similar to FIG. 10A but showing alternative features of the article protection flap.
Figure 10E:
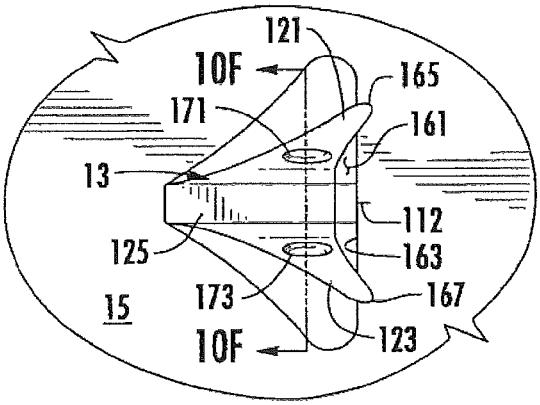
FIG. 10E is a view similar to FIG. 10B but showing the article protection flap of FIG. 10D.
Figure 10F:
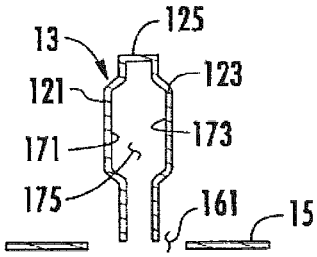
FIG. 10F is a cross-section taken along the plane 10E-10F of FIG. 10E.

FIGS. 10D-10F show an article protection flap 13 having alternative features. In the embodiment of FIGS. 10D-10F, the first portion 121 and the second portion 123 of the article protection flap 13 each have a respective deformation 171, 173 in the form of an indentation on the exterior surface of the article protection flap 13. The article protection flap 13 of the embodiment of FIGS. 10D-10F is activated in a similar manner as described above for the previous embodiment, wherein the first portion 121 is folded relative to the second portion 123 of the article protection flap. As shown in FIG. 10F, the indentations 171, 173 of the respective first and second portions 121, 123 cooperate to form a space 175 between the first portion and the second portion of the article protection flaps 13. The space 175 can comprise shock absorbing material, such as the shock absorbing material 139 discussed above for the article protection features 11, or any other suitable material. The space 175 between the first and second portions 121, 123 of the article protection flap 13 of FIG. 10F provides enhanced article protection and reduction of breakage of the containers C. The deformations 171, 173 could be otherwise shaped, arranged, configured, positioned, and/or omitted without departing from the scope of the disclosure.

Figure 11:
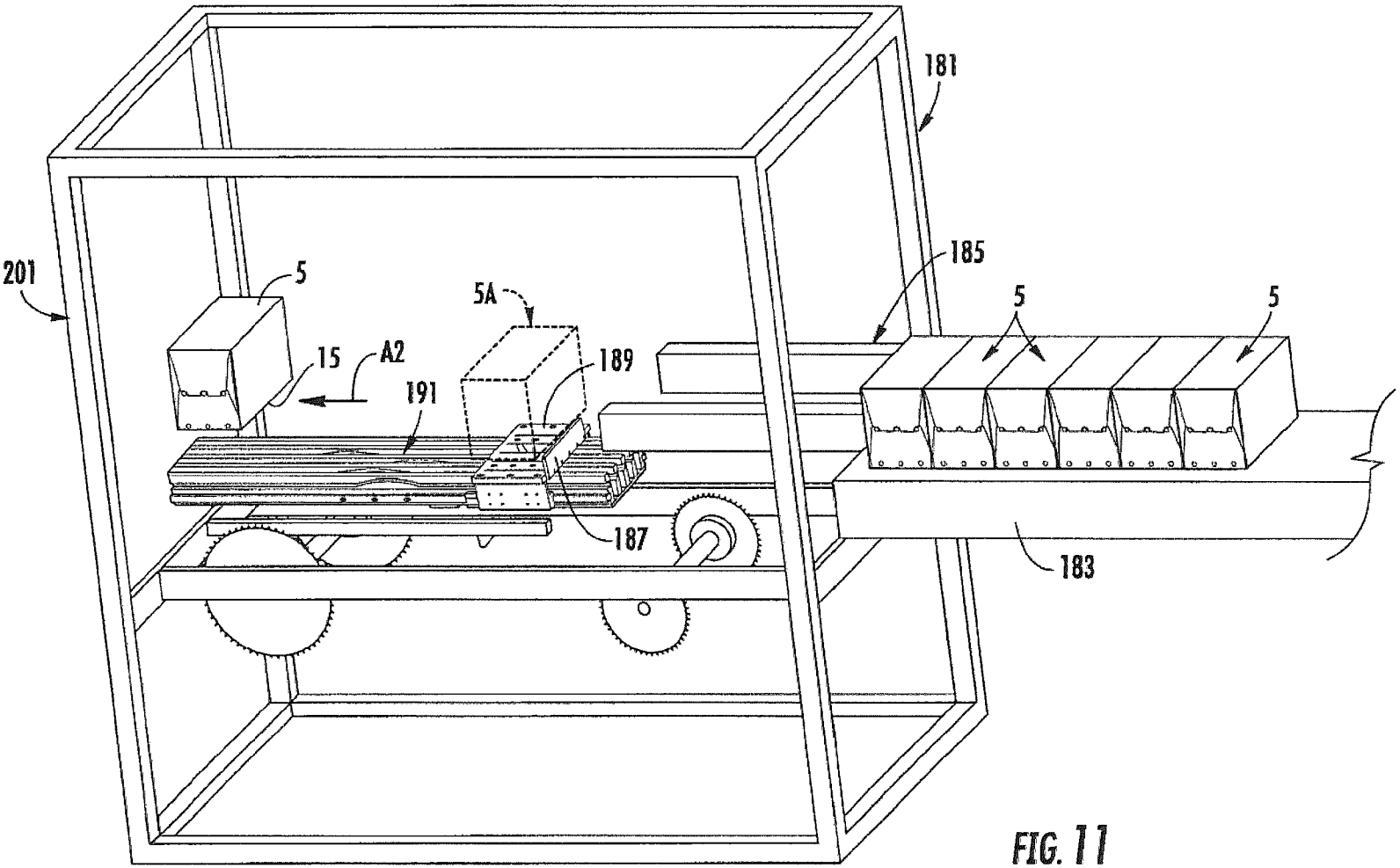
FIG. 11 is a plan view of a system for activating the article protection flaps of one embodiment of the disclosure.
Figure 12:
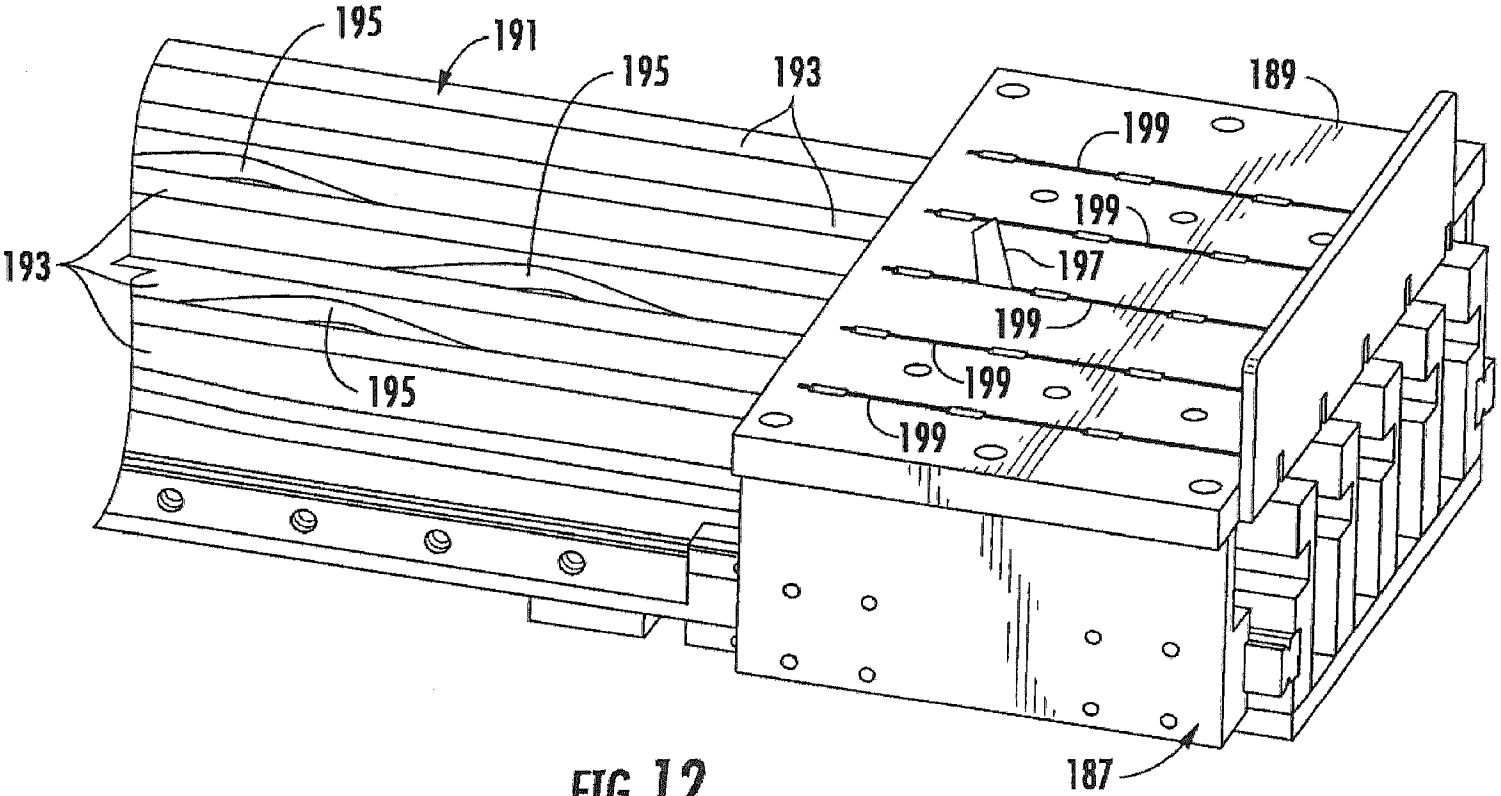
FIG. 12 is an enlarged portion of FIG. 11.

One embodiment of a system 181 for activating the article protection flaps 13 is illustrated in FIGS. 11 and 12. In one embodiment, the cartons 5, having containers C loaded and the ends 7, 9 closed, are conveyed via an inlet conveyor 183 to a first or inlet end 185 of the system 181. However, the system 181 could also be used to activate the article protection flaps 13 of the cartons 5 prior to closing one or both of the ends 7, 9. The system 181 comprises a sled 187 that receives a carton 5 from the inlet conveyor 183 such that the bottom panel 15 of the carton is in contact with the top surface 189 of the sled. The sled 187 is operatively attached to a cam track array or section 191 that includes a series of spaced rails 193 (FIG. 12) with a series of cam tracks 195 mounted therebetween. The sled 187 comprises a series of actuating fingers 197 pivotally mounted to the sled and moveable through a respective slot 199 in the top surface 189 of the sled. The actuating fingers 197 have a lower portion that engages a respective cam track 195 such that the actuating finger 197 is raised or lowered in the slot 199 by the slope of the cam track. As the sled 187 with carton 5 mounted on the top surface 189 moves in the direction of arrow A2 (FIG. 11), the fingers 197 are raised and lowered in the slots 199 to activate the article protection flaps 13 in the bottom panel 15. After the article protection flaps 13 are activated by the system 181, the carton 5 exits an exiting end 201 of the system for further handling and packaging. The system 180 could be alternatively shaped, arranged, and/or configured without departing from the disclosure.

Figure 13:
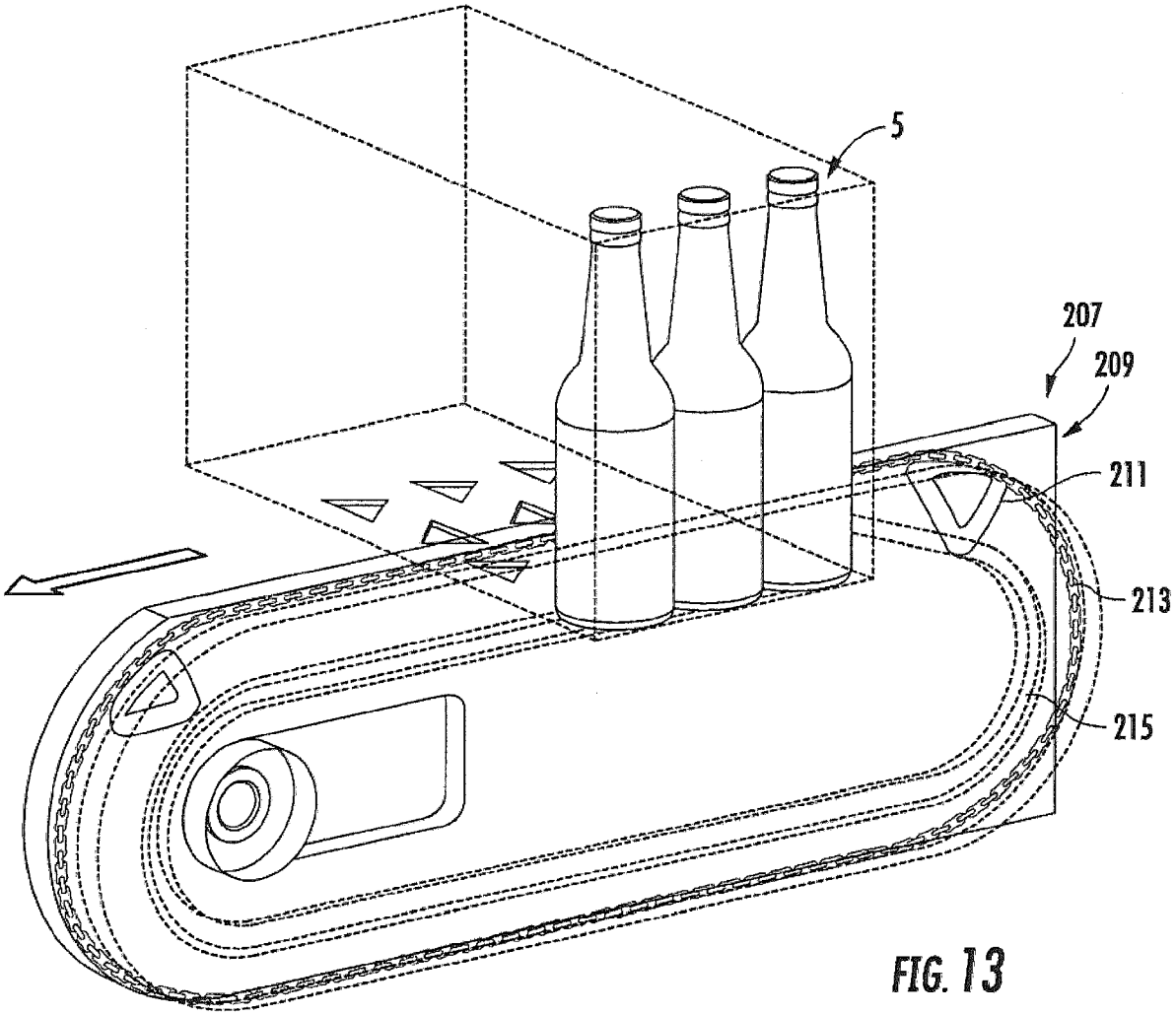
FIG. 13 is a partial schematic view of a system for activating the article protection flaps of an alternative embodiment of the disclosure.

FIG. 13 illustrates an alternative embodiment of a system 207 for activating the article protection flaps 13 of the carton 5. The system 207 comprises a cassette 209 that can be mounted along the path of travel of the carton 5 in a packaging machine. In one embodiment, the cassette 209 comprises a series of actuating fingers 211 mounted to a chain 213. The fingers 211 move along a cam track 215 that receives a portion of the fingers 211 as the fingers are conveyed around the cassette. As the fingers 211 move along the cam track 215, the fingers can be positioned between non-engaging and engaging positions for selectively activating the article protection flaps 13 of the carton 5. The system 207 could be alternatively shaped, arranged, and/or configured without departing from the disclosure.

Figure 14:
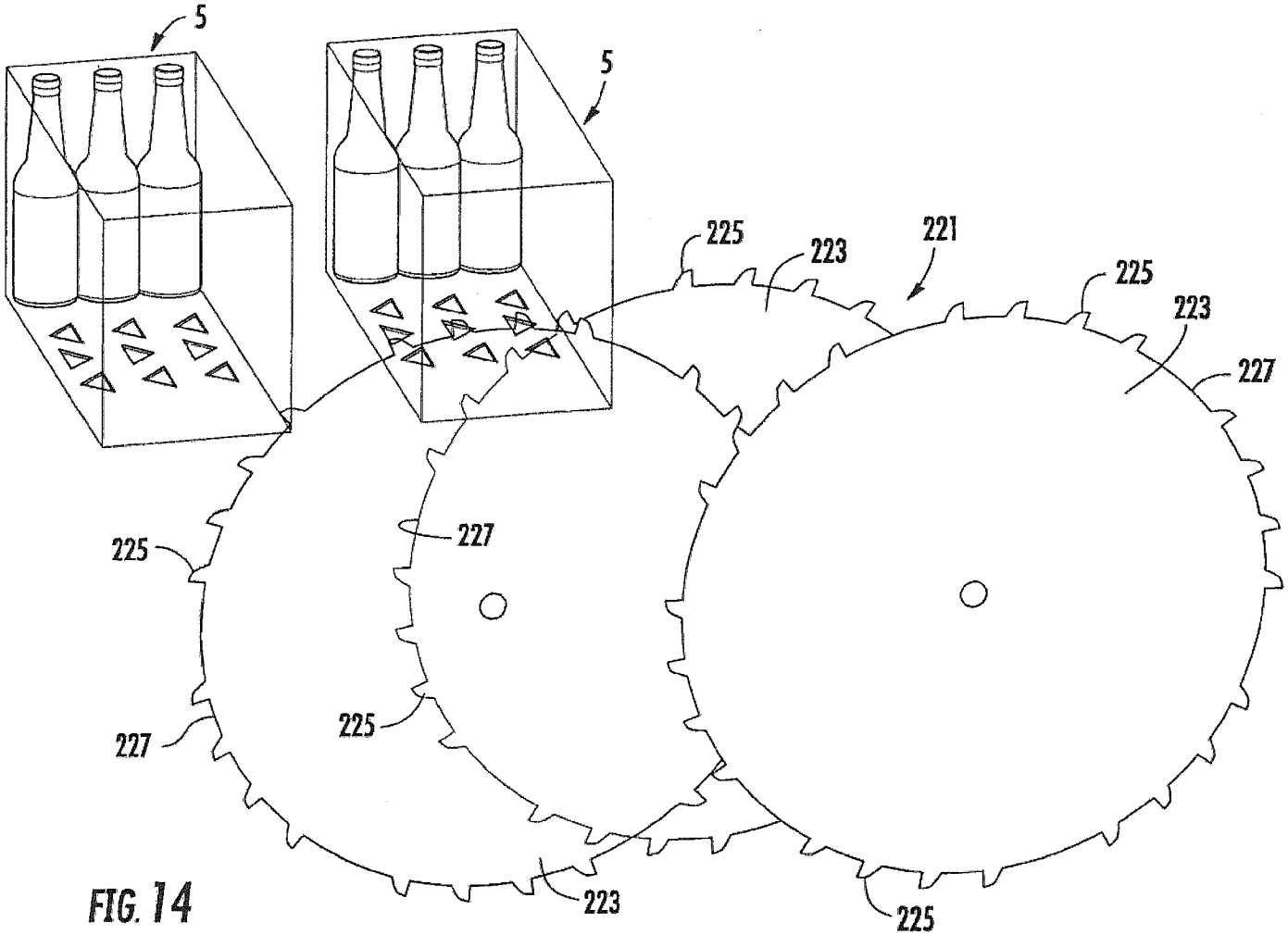
FIG. 14 is a partial schematic view of a system for activating the article protection flaps of an alternative embodiment of the disclosure.

FIG. 14 shows features of an alternative embodiment of a system 221 for activating the article protection flaps 13 of the carton 5. As with the previous embodiments, the system 221 can be mounted along a path of travel of the cartons 5 in a packaging machine. In the embodiment of FIG. 14, the system 221 includes a series of starred wheels or finned discs 223 that will engage and activate the article protection flaps 13 as the cartons move through or along system 221. The star wheels 223 each generally includes a series of actuating fingers 225 arranged in groups or sets spaced about the circumference or periphery 227 of each of the star wheels. In one embodiment, each of the star wheels 223 is positioned to activate a respective row of article protection flaps 13 in the bottom panel 15 of the carton. The actuating fingers 225 engage a respective article protection flap 13 and move the article protection flap from the first (lowered) position that is substantially parallel to the bottom panel 15 to the second (raised) positioned wherein the article protection flap 13 is folded relative to the bottom panel. The system 221 could be alternatively shaped, arranged, and/or configured without departing from the disclosure.

Figure 15:
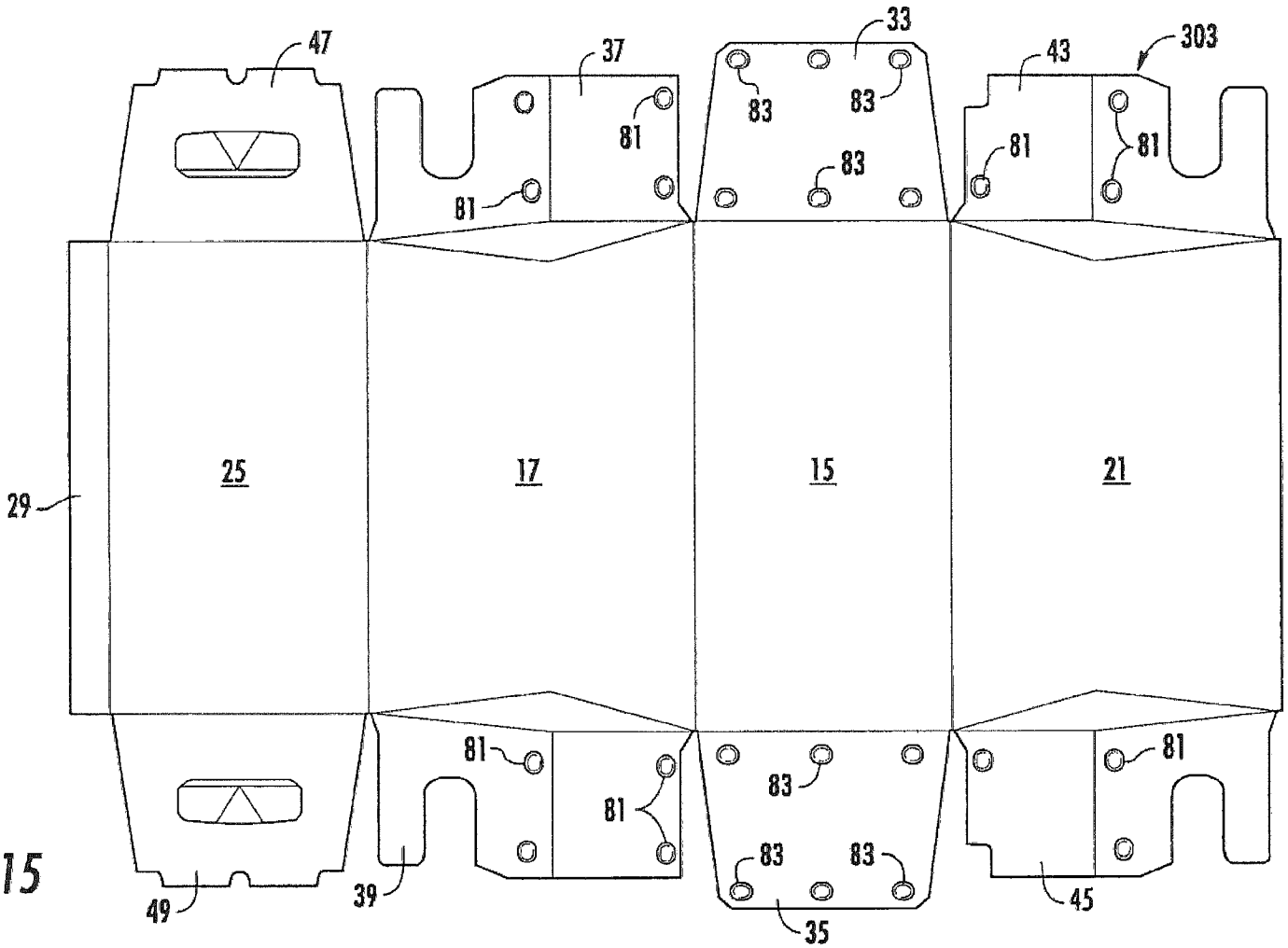
FIG. 15 is a plan view of a blank for forming a carton according to an alternative embodiment of the disclosure.

FIG. 15 is an alternative embodiment of a blank 303 that is similar to the blank 3 of the first embodiment. Accordingly, like or similar features will be indicated with like or similar reference numbers. The blank 303 is for forming a carton 5 having article protection features 11 in respective ends 7, 9 of the carton as discussed above for the first embodiment. As with the embodiment of FIG. 1, the blank 303 has end flaps 33, 37, 43, 47 and 35, 39, 45, 49 that have respective indentations or features 81, 83 that cooperate to form the article protection features 11. In contrast to the first embodiment, the blank 303 has a bottom panel 15 that does not have article protection flaps 13. The blank 303 could have other features and could be otherwise shaped, arranged, and/or configured without departing from the disclosure.

Figure 16:
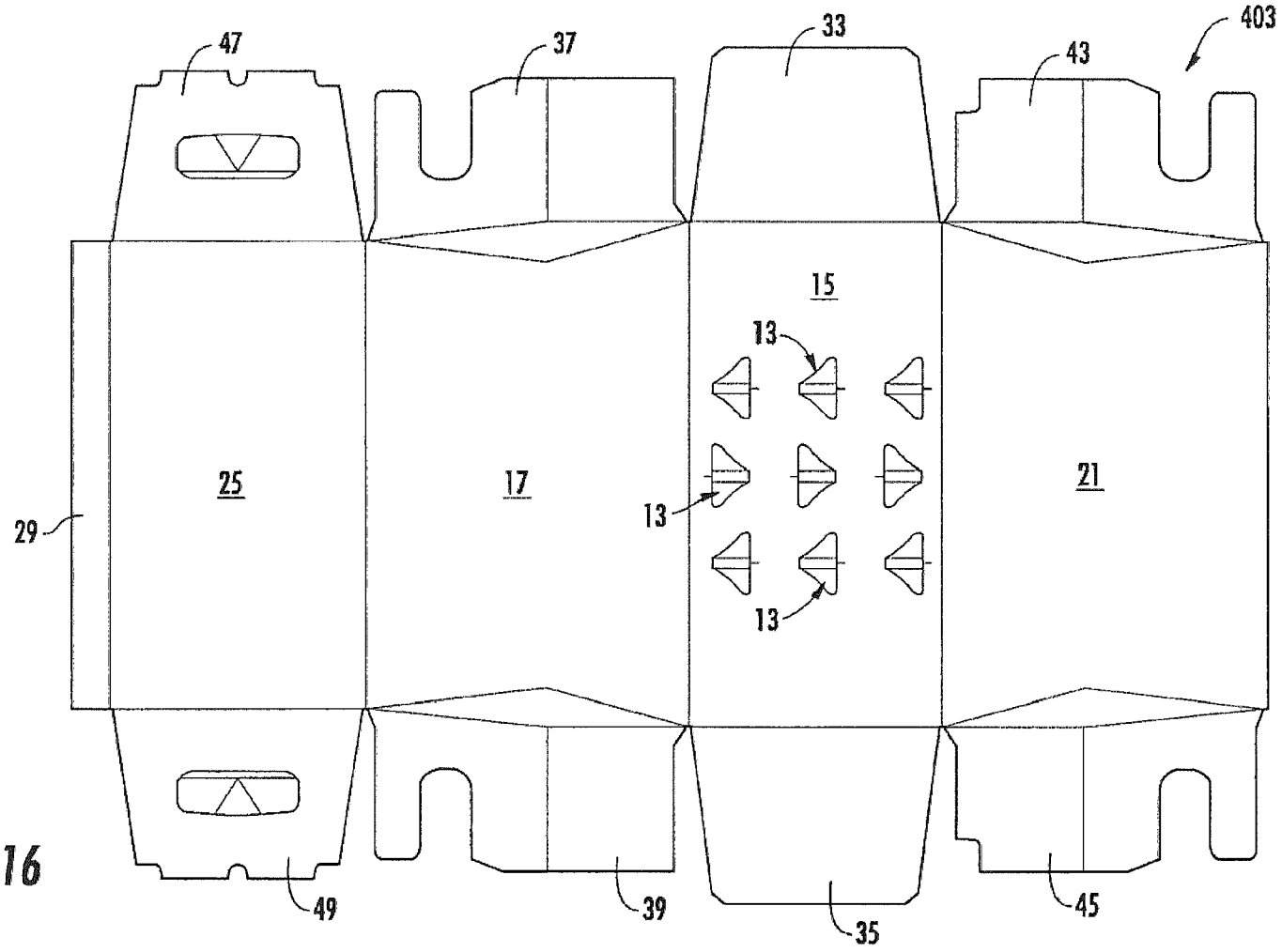
FIG. 16 is a plan view of a blank for forming a carton according to an alternative embodiment of the disclosure.

FIG. 16 is an alternative embodiment of a blank 403 that is similar to the blank 3 of the first embodiment. Accordingly, like or similar features will be indicated with like or similar reference numbers. The blank 403 is for forming a carton 5 having article protection flaps 13 foldably connected to the bottom panel 15 as discussed above for the first embodiment. In contrast to the first embodiment, the blank 403 has end flaps 33, 37, 43, 47 and 35, 39, 45, 49 that are free of respective indentations or features 81, 83 that cooperate to form the article protection features 11 of the carton 5 of the first embodiment. The blank 403 could have other features and could be otherwise shaped, arranged, and/or configured without departing from the disclosure.

Figure 17:
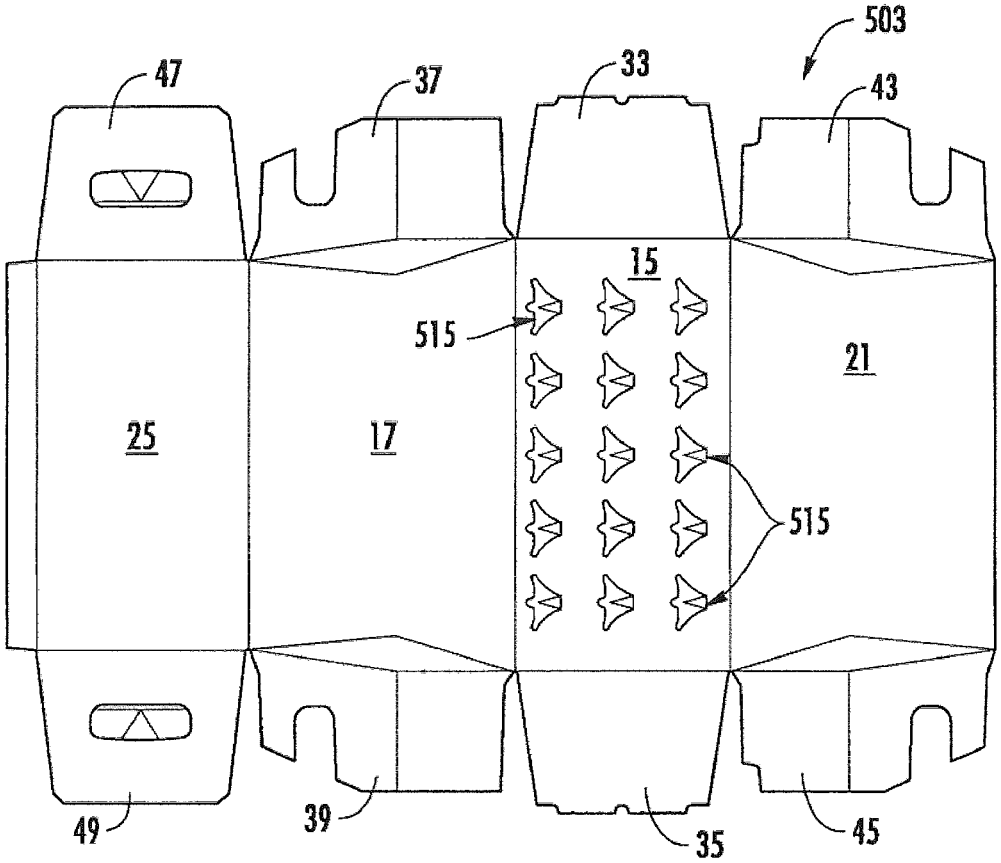
FIG. 17 is a plan view of a blank for forming a carton according to an alternative embodiment of the disclosure.
Figure 17A:
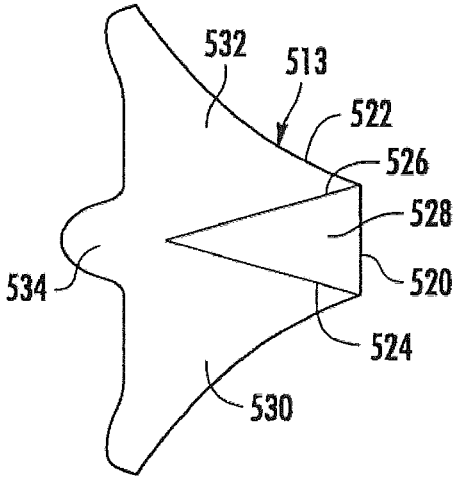
FIG. 17A is an enlarged portion of the bottom panel of FIG. 17 showing an article protection flap.
Figure 18:
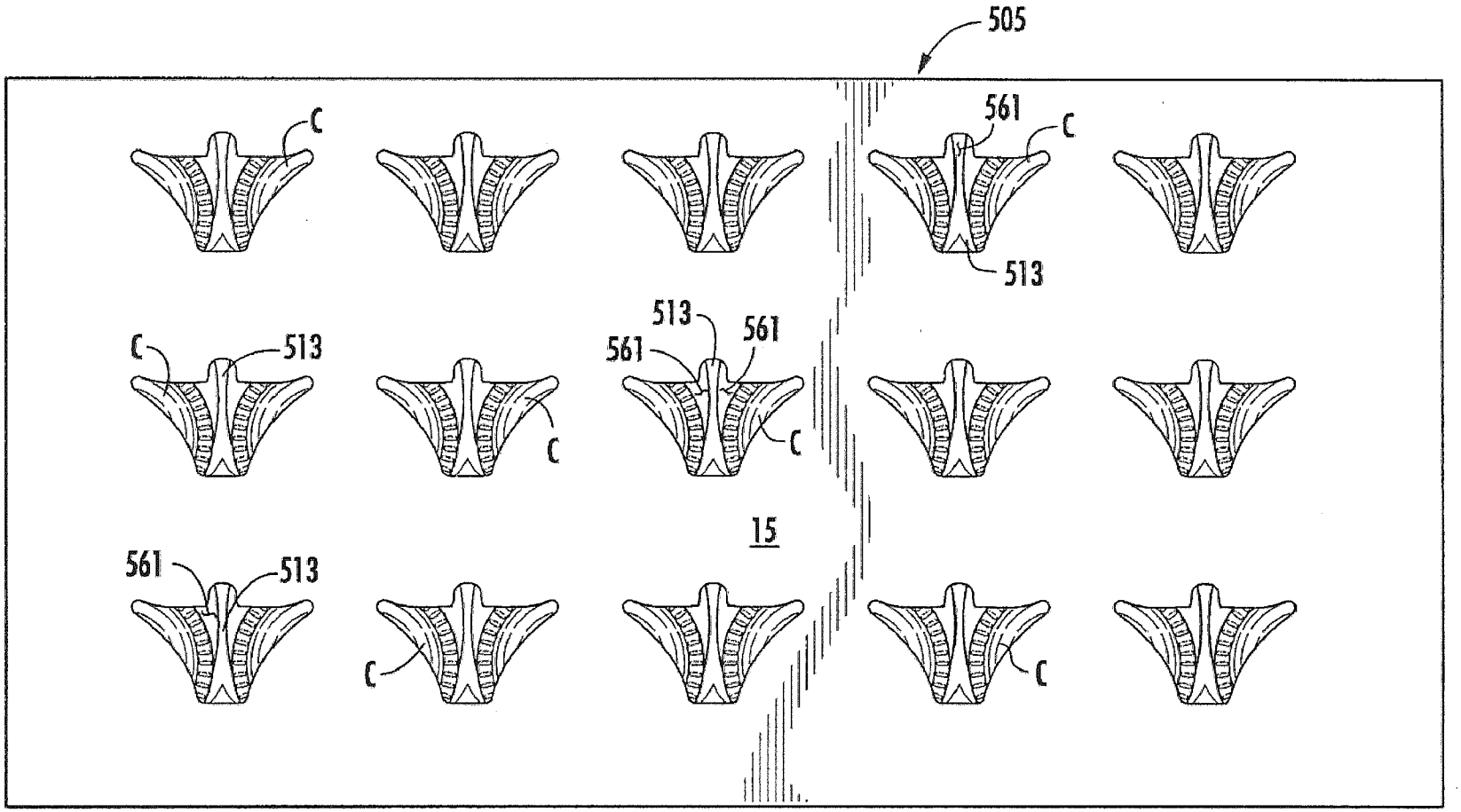
FIG. 18 is a plan view of a bottom panel of the carton of the embodiment of FIG. 17 with the article protection flaps in a second position.
Figure 19:
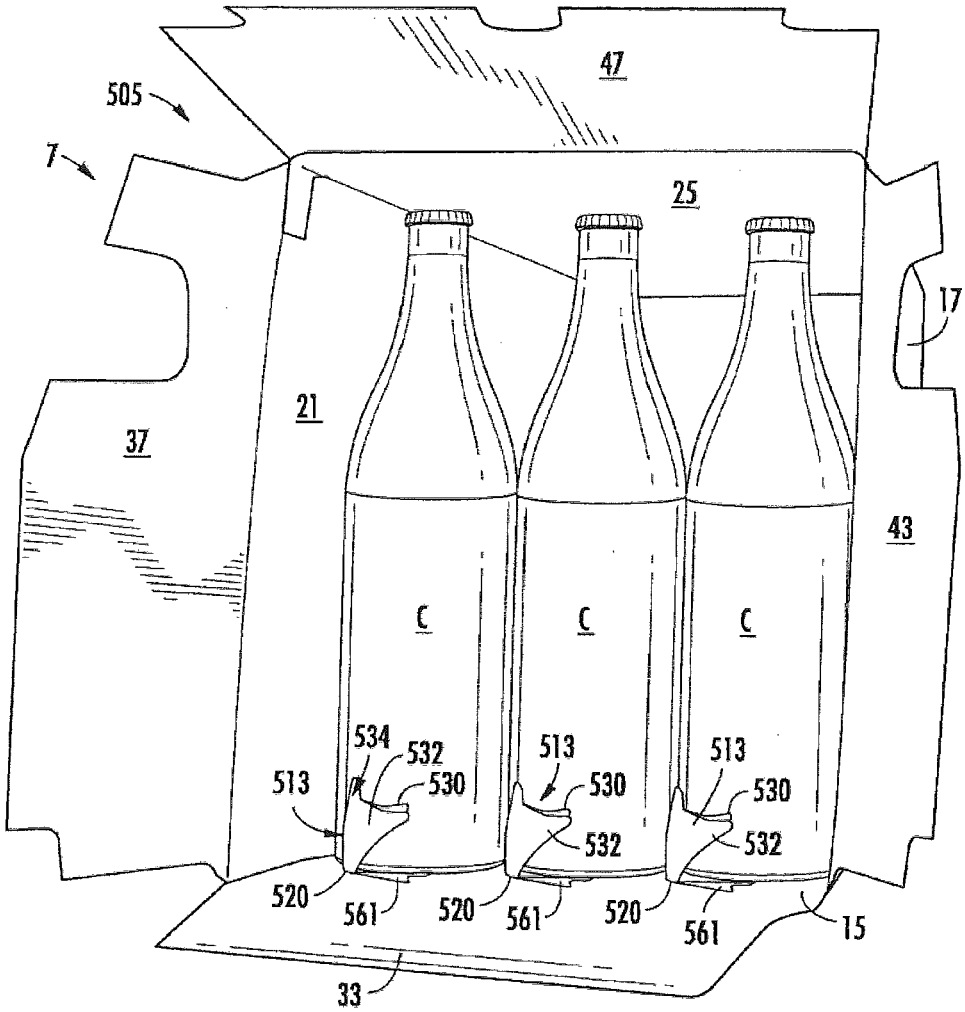
FIG. 19 is an end view of a partially assembled carton of the embodiment of FIG. 17 with the article protection flaps in the second position.

FIGS. 17-19 show an alternative embodiment of a blank 503 for forming a carton 505 that is similar to the blank 3 and carton 5 of the first embodiment. Accordingly, like or similar features will be indicated with like or similar reference numbers. The blank 503 has article protection flaps 513 that are similar to the article protection flaps 13 of the first embodiment. The blank 503 has fifteen article protection flaps 513 arranged in a 5×3 arrangement, but the blank could have more or less than fifteen article protection flaps and the article protection flaps could be otherwise arranged. In the embodiment of FIGS. 17-19, the article protection flaps 513 are foldably connected to the bottom panel 15 at a lateral fold line 520 and are at least partially defined by a cut 522 or other line of weakening in the bottom panel. Two oblique fold lines 524, 526 extend from respective ends of the lateral fold line 520 to define a central portion 528 of the article protection flap 513. A first portion 530 of the article protection flap 513 is foldably connected to the central portion 528 at the oblique fold line 524 and a second portion 532 is foldably connected to the central portion 528 at the oblique fold line 526. In addition to the distal portions of the first portion 530 and second portion 532, the features that prevent the article protection flap 513 from being downwardly folded include a heel 534 formed at a distal portion of the article protection flap. In the illustrated embodiment, the heel 534 is a rounded protrusion that extends beyond the edge of the first and second portions 530, 532.

FIG. 18 illustrates a view of the bottom panel 15 of the carton 505 after the article protection flaps 15 have been activated and positioned in the second (raised) position between adjacent containers C. As shown in FIGS. 18 and 19, the openings 561 is formed in the bottom panel 15 when the article protection flaps 513 are moved to the second position between adjacent containers. As shown in FIG. 19, the first and second portions 530, 532 are folded with respect to one another when a respective article protection flap 513 is positioned in the second position. In the raised position, the first portion 530, second portion 532, and heel 534 of each respective article protection flap 513 interfere with the edges of the bottom panel 15 at the opening 561 to prevent with the article protection flap from being moved to the first position that is substantially parallel to the bottom panel 15. The article protection flaps 513 could be otherwise shaped, arranged, configured, and/or positioned without departing from the disclosure.

Figure 20:
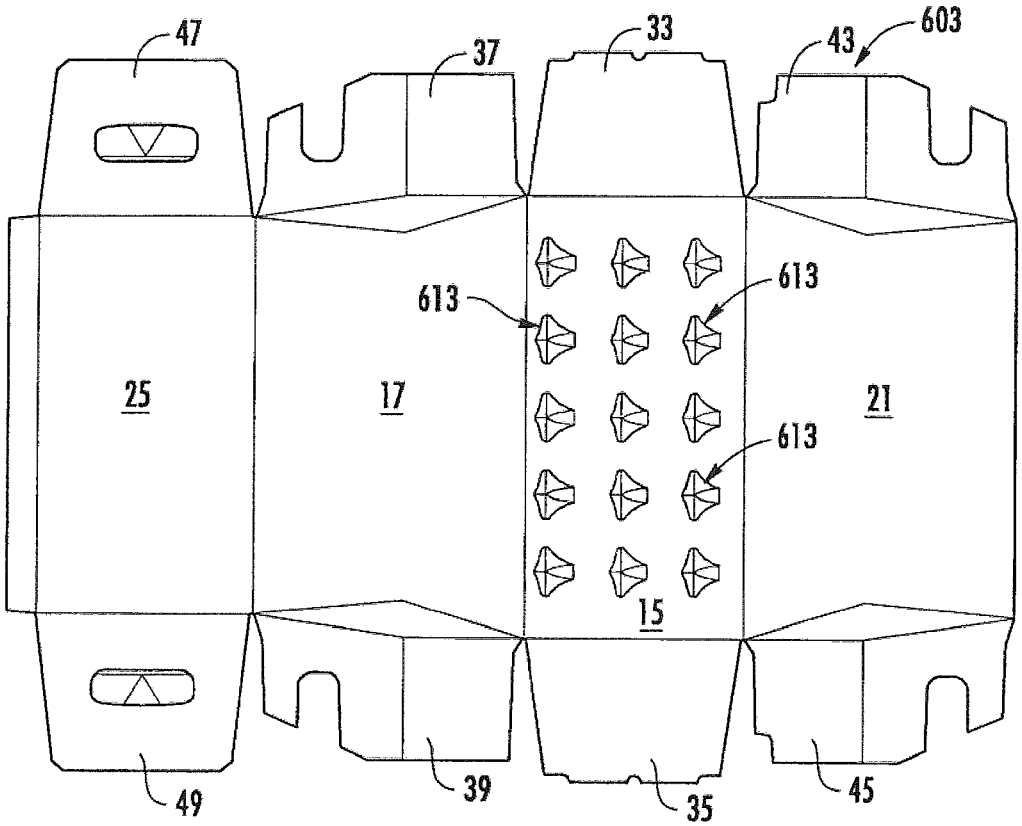
FIG. 20 is a plan view of a blank for forming a carton according to an alternative embodiment of the disclosure.
Figure 20A:
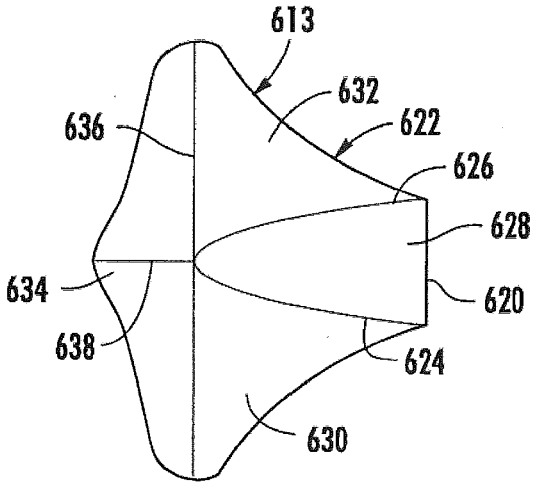
FIG. 20A is an enlarged portion of the bottom panel of FIG. 20 showing an article protection flap.

FIGS. 20 and 20A illustrate various features of a blank 603 according to an alternative embodiment of the disclosure and having similar features of the first embodiment. Accordingly, like or similar features will be indicated with like or similar reference numbers. The blank 603 has article protection flaps 613 that are similar in shape as the article protection flaps 513 of the previous embodiment. In the embodiment of FIGS. 20 and 20A, the article protection flaps 613 are foldably connected to the bottom panel 15 at a lateral fold line 620 and are at least partially defined by a cut 622 or other line of weakening in the bottom panel. Two curved fold lines 624, 626 extend from respective ends of the lateral fold line 620 to define a central portion 628 of the article protection flap 613. A first portion 630 of the article protection flap 613 is foldably connected to the central portion 628 at the curved fold line 624 and a second portion 632 is foldably connected to the central portion 628 at the curved fold line 626. The article protection flap 613 comprises a heel 634 formed at a distal portion of the article protection flap. In the illustrated embodiment, the heel 634 is a rounded protrusion that extends beyond the edge of the first and second portions 630, 632 (e.g., is the farthest portion of the article protection flap 613 from the fold line 620). In the embodiment of FIGS. 20 and 20A, the article protection flap 613 includes a lateral fold line 636 extending across the first portion 630 and the second portion 632 at the widest portion of the article protection flap and a longitudinal fold line 638 extending from the lateral fold line across the heel portion 634 to the cut 622. The fold lines 636, 638 facilitate the activation of the article protection flap 613 and the folding of the first portion 630 relative to the second portion 632. The article protection flaps 613 could be otherwise shaped, arranged, configured, and/or positioned without departing from the disclosure.

Figure 21:
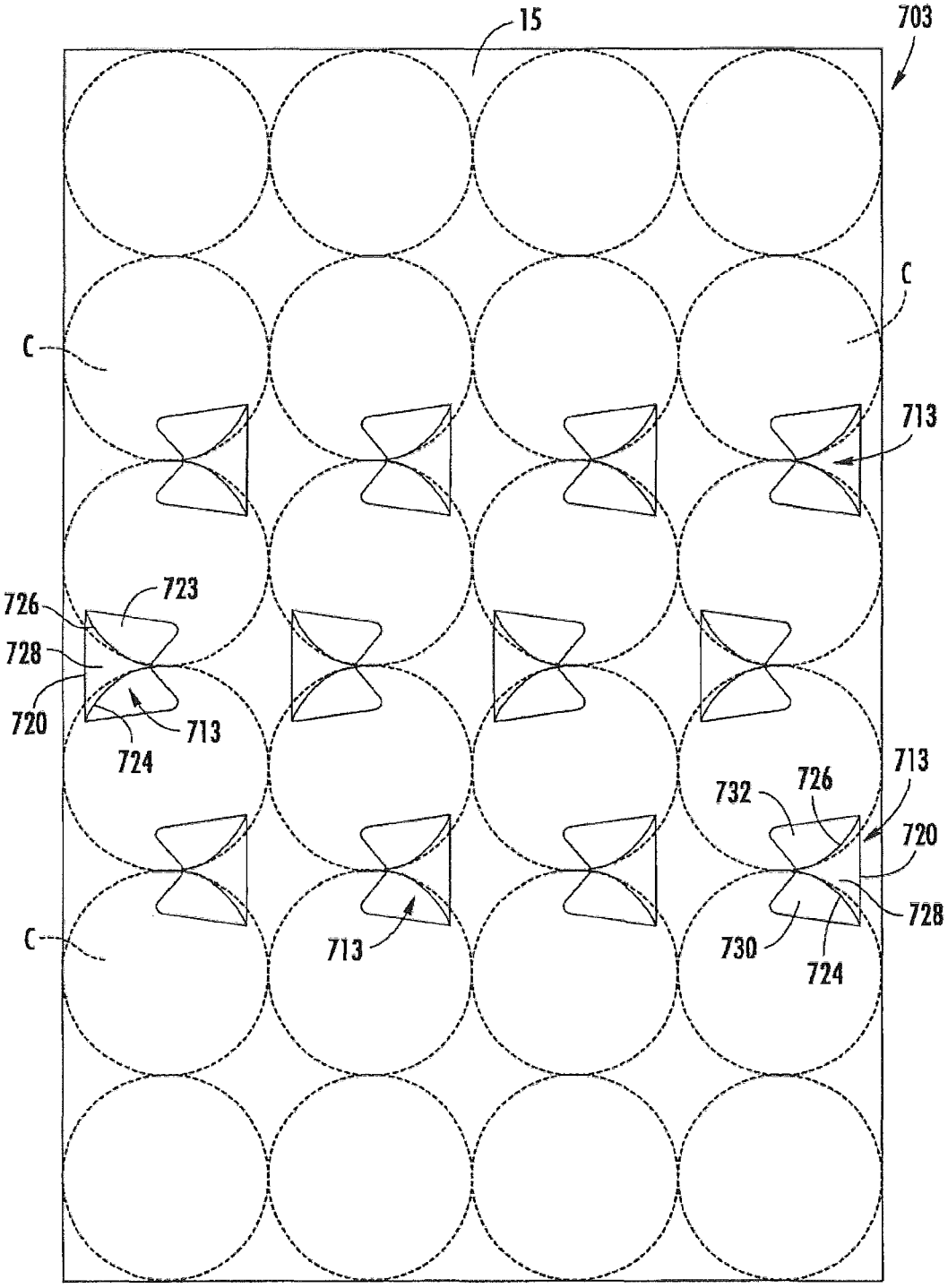
FIG. 21 is a plan view of an exterior surface of a bottom panel of a carton according to an alternative embodiment of the disclosure with articles contained in the carton shown in hidden lines.
Figure 22:
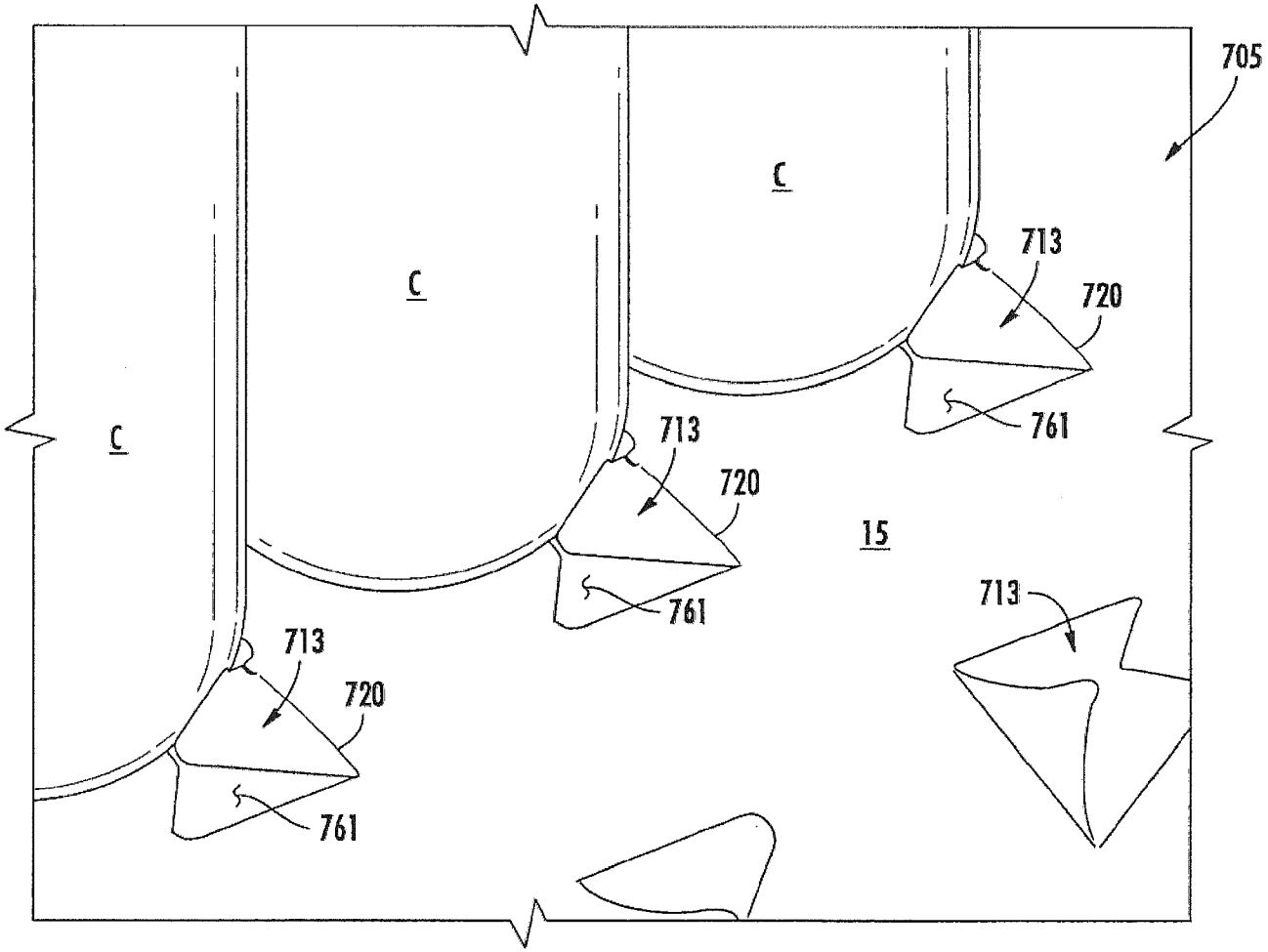
FIG. 22 is a perspective view of an interior surface of the bottom panel of the carton of the embodiment of FIG. 21 showing article protection flaps.
Figure 23:
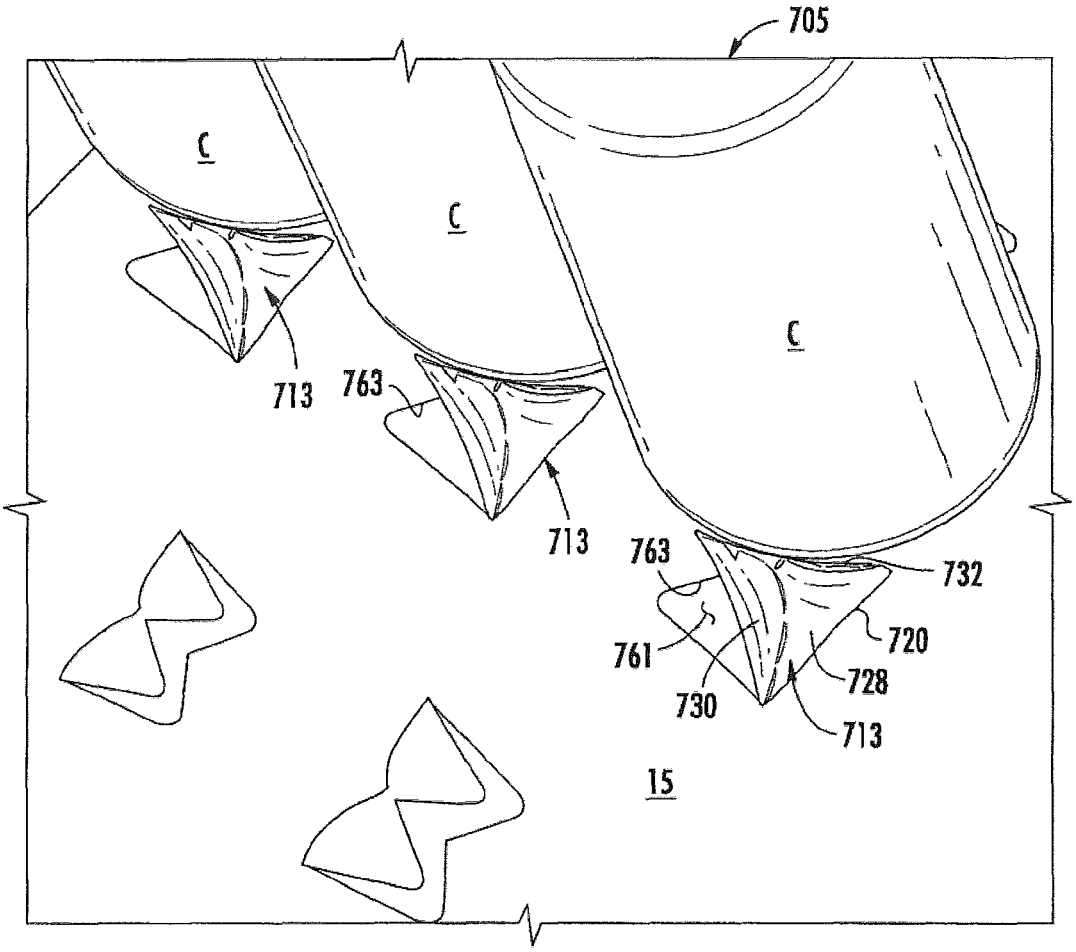
FIG. 23 is a perspective view of the interior surface of the bottom panel of the carton of the embodiment of FIG. 21 showing the article protection flaps in a second position.
Figure 24:
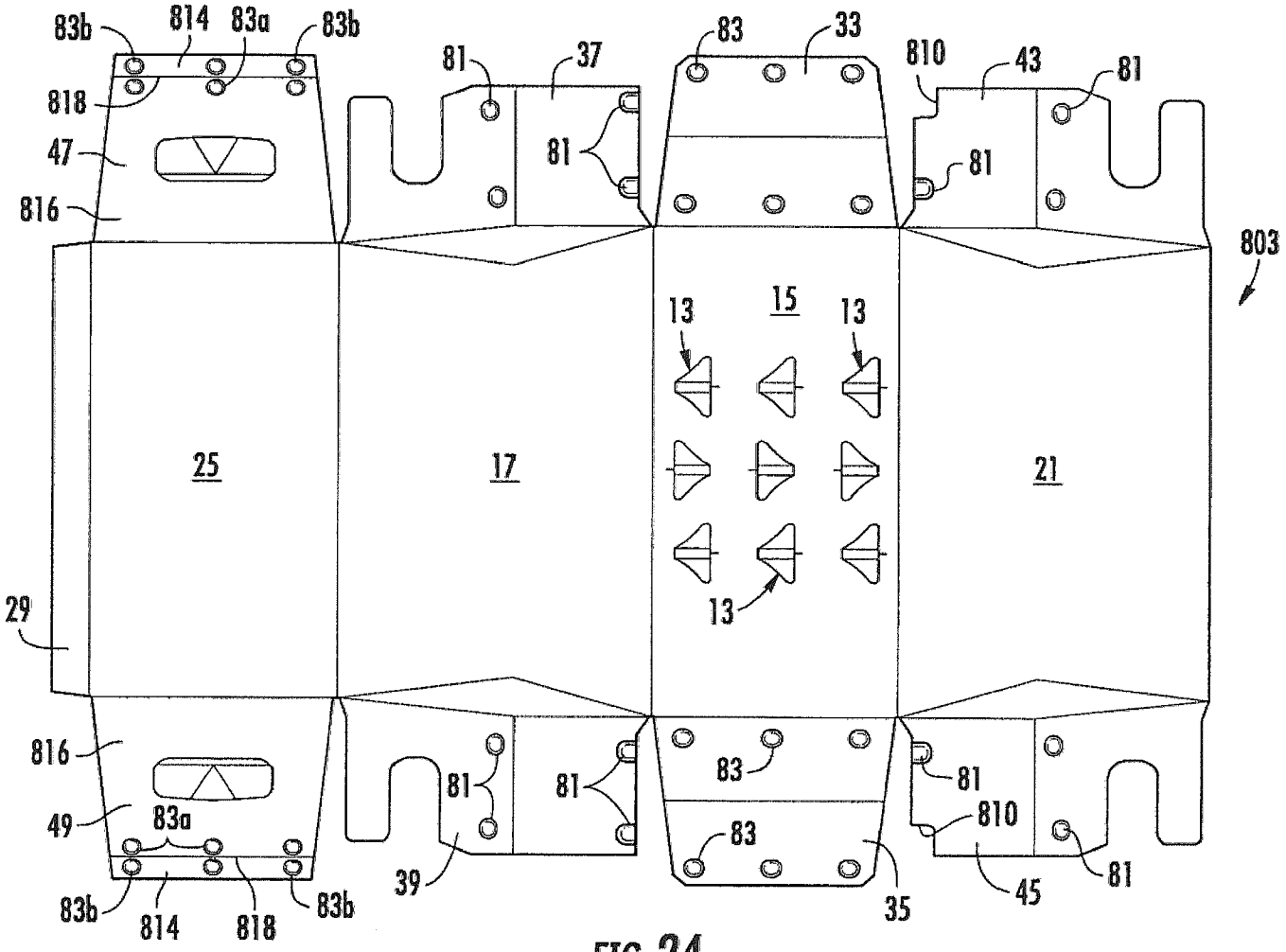
FIG. 24 is a plan view of an exterior surface of a blank for forming a carton according to an alternative embodiment of the disclosure.
Figure 25:
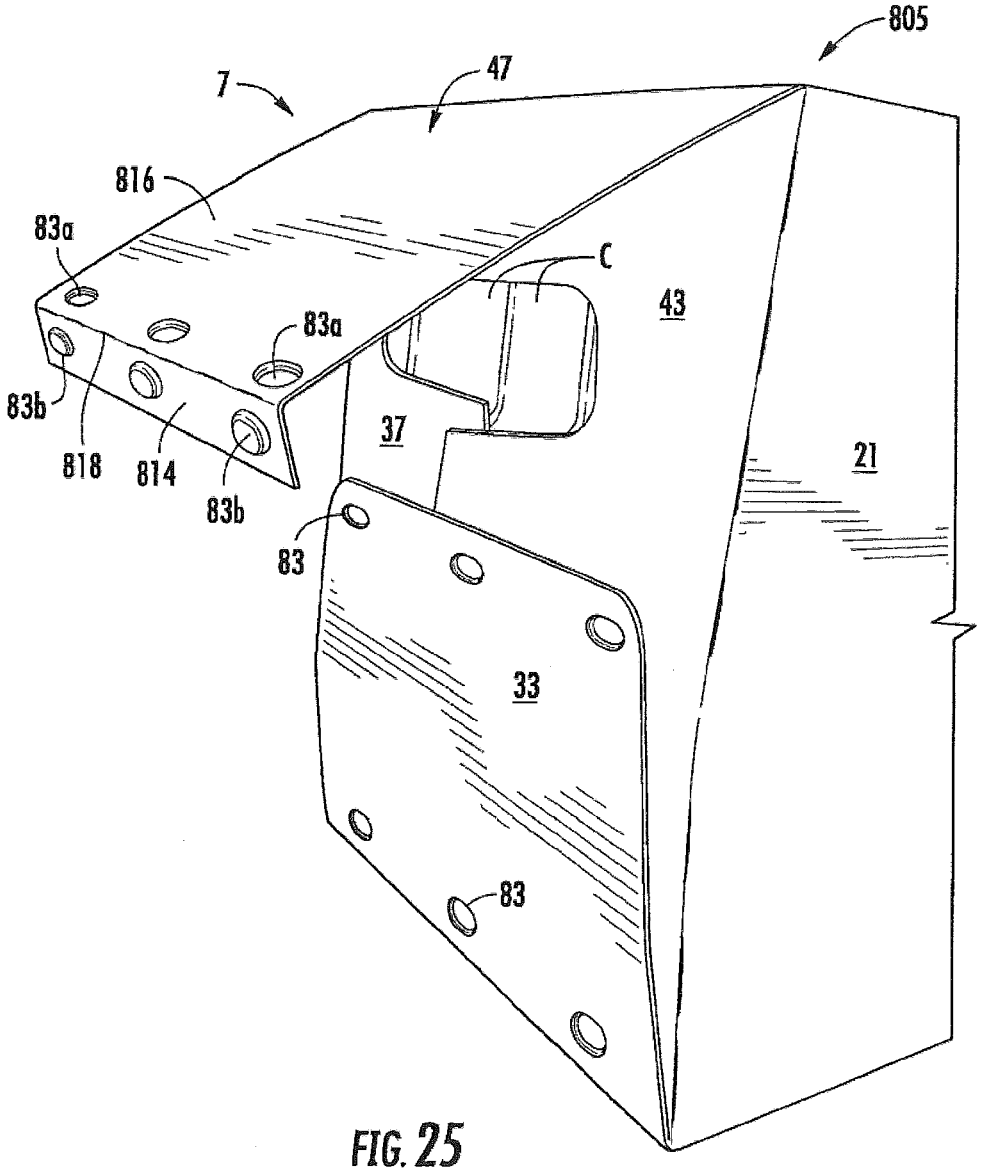
FIGS. 25-27 are various views of forming the carton according to the embodiment of FIG. 24.
Figure 26:
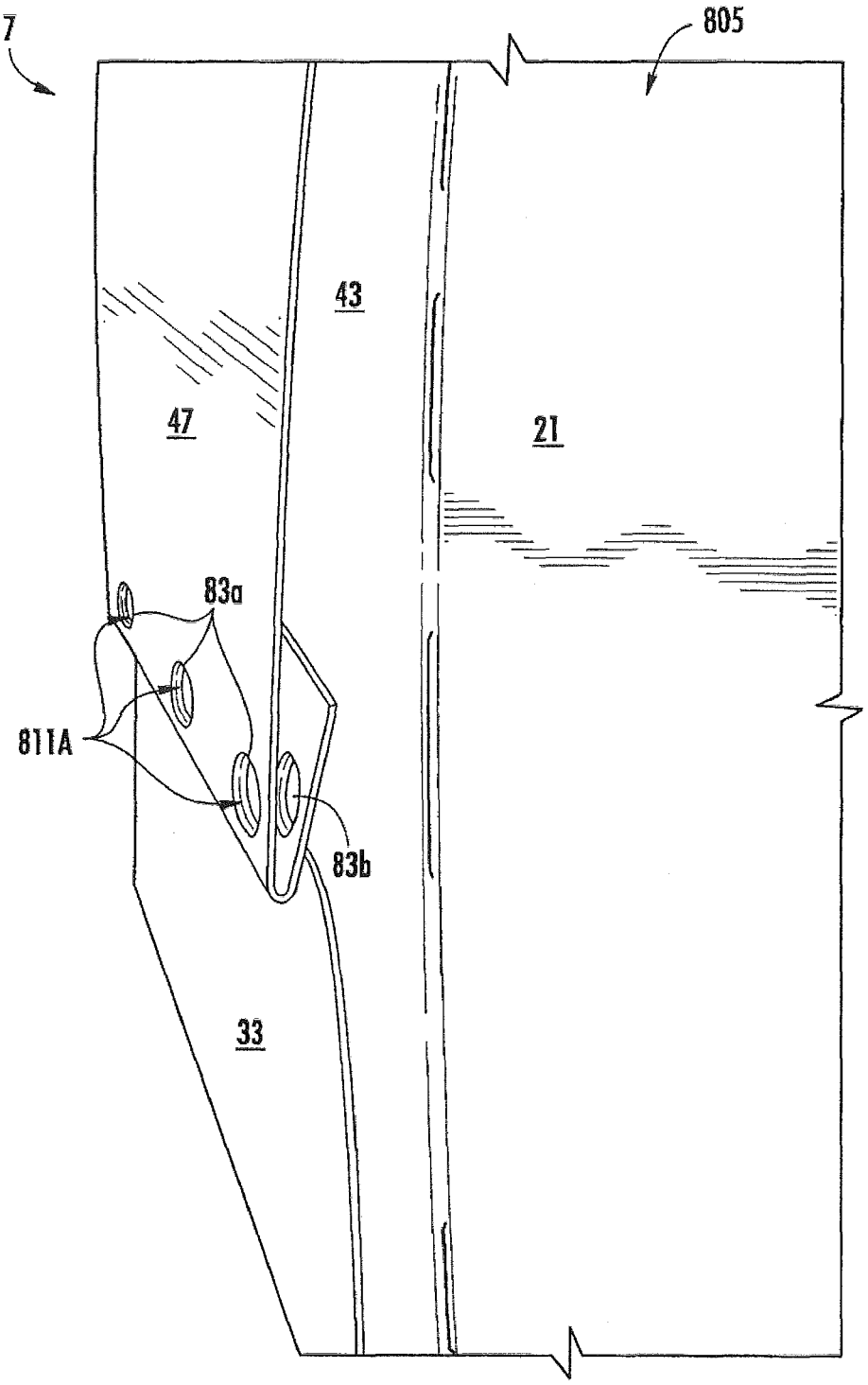

FIGS. 21-23 illustrate various features of a blank 703 and carton 705 of an alternative embodiment having similar features as the first embodiment of the disclosure. Accordingly, like or similar features will be indicated with like or similar reference numbers. The blank 703 has a bottom panel 15 with article protection flaps 713 that are foldably connected to the bottom panel at a lateral fold line 720. In the embodiment of FIGS. 21-23 two curved fold lines 724, 726 extend from respective ends of the lateral fold line 720 and define a central portion 728 of the article protection flap 713. The first portion 730 is foldably connected to the central portion 728 of the article protection flap 713 at the fold line 724 and the second portion 732 is foldably connected to the central portion at the fold line 726. The location of the containers C is shown in hidden lines in FIG. 21, with the article protection flaps 713 in the first (lowered) position wherein the article protection flaps are substantially parallel to the bottom panel.

FIG. 22 shows the article protection flaps 713 being moved to the second position, and FIG. 23 shows the article protection flaps substantially in the second position. In both FIGS. 22 and 23 one row of containers C has been removed to show the positioning of the article protection flaps 713. As with the previous embodiments, an opening 761 is formed in the bottom panel 15 that corresponds with the shape of the article protection flap 713 in the first position. As shown in FIG. 23, the first and second portions 730, 732 are curved or contoured to match the shape of the container C so that the container is held in secure engagement with the article protection flap 713. As with the previous embodiments, the article protection flaps 713 are prevented from being moved from the second (raised) position to the first (lowered) position by the interference of the folded first and second portions 730, 732 with the edge 763 of the bottom panel 15 at the opening 761. The folding of the first and second portions 730, 732 relative to each other and the central portion 730 causes the distal portions of the first and second portions to extend beyond the edge 763 forming the opening. The article protection flaps 713 could be otherwise shaped, arranged, configured, and/or positioned without departing from the disclosure.

FIGS. 24-27 show an alternative embodiment of a blank 803 for forming a carton 805 that is similar to the blank 3 and carton 5 of the first embodiment. Accordingly, like or similar features will be indicated with like or similar reference numbers. The blank 803 has article protection flaps 13 that are the same as the article protection flaps of the first embodiment. The blank 803 has end flaps 33, 37, 43, 47 and 35, 39, 45, 49 that have respective indentations or features 81, 83 that cooperate to form the article protection features 811 that are similar to the article protection features 11, 11A, 11B of the first embodiment. The blank 803 could have other features without departing from the disclosure.

In the embodiment of FIGS. 24-27, each of the top end flaps 47, 49 has a reinforcement flap 814 foldably connected to a base portion 816 of the top end flap at a longitudinal fold line 818. In one embodiment, the base portion 816 of each top end flap 47, 49 has a group of indentations 83*a* on the interior surface of the base portion 816 of the end flap, and the reinforcement flap 814 has a group of indentations 83*b* on the interior surface of the end flap. As with the first embodiment, the side end flaps 37, 39, 43, 45 have indentations 81 on the exterior surface of the side end flaps and the bottom end flaps 33, 35 have indentations 83 on the interior surface of the bottom end flaps. In the embodiment of FIGS. 24-27, each of the side end flaps 43, 45 have only a single indentation 81 on the lower row of indentations and an edge having notches 810 instead of a second indentation on the lower row. The blank 803 could have other arrangements of indentations 81, 83 or other features for forming the article protection features 811 without departing from the disclosure.

As shown in FIGS. 25-27B, when the ends 7, 9 of the carton 805 are closed, the reinforcement flap 814 of each top end flap 47, 49 is folded at the fold line 818 to be in face-to-face contact with the interior surface of the base portion 816 of each end flap. As with the previous embodiments, only the closing of the first end 7 of the carton 805 is shown, but it is understood that the second end 9 could be closed in a similar manner as described for the first end. When the reinforcement flap 814 is folded, the indentations 83*b* on the reinforcement flap 814 are aligned and in contact with the indentations 83*a* on the base portion 816. The indentations 83*a*, 83*b* cooperate to form a pocket 836 (FIG. 27A) in the top end flap 47, 49 that is similar to pockets 135 discussed above for the first embodiment and shown in FIG. 9.

In the embodiment of FIGS. 24-27B, the indentations 81 on the side end flaps 37, 39, 43, 45 and the indentations 83 on the bottom end flaps 33, 35 cooperate to form an upper pocket 135 that is similar to the upper pocket 135 described above for the first embodiment and shown in FIG. 9. The upper article protection feature 811A of the outermost article protection features (e.g., closest to the side panels 17, 21 when viewed from FIG. 27) comprises the pocket 836 formed by the reinforcement flap 814 and the base portion 816 of the top end flaps 47, 49 and the upper pocket 135 that is formed by the bottom end flap 33, 35 and the side end flaps 37, 39, 43, 45. The lower article protection features 811B of the outermost article protection features comprises the lower pocket 135 that is formed by the indentation 83 on the bottom end flaps 33, 35 and the indentation 81 on the side end flaps 37, 39, 43, 45. Either or both of the pockets 836, 135 that form the article protection features 811A, 811B could comprise shock absorbing material as described above for the first embodiment. The article protection features 811A, 811B could be formed by other features of the blank 803 without departing from the disclosure.

Figure 27:
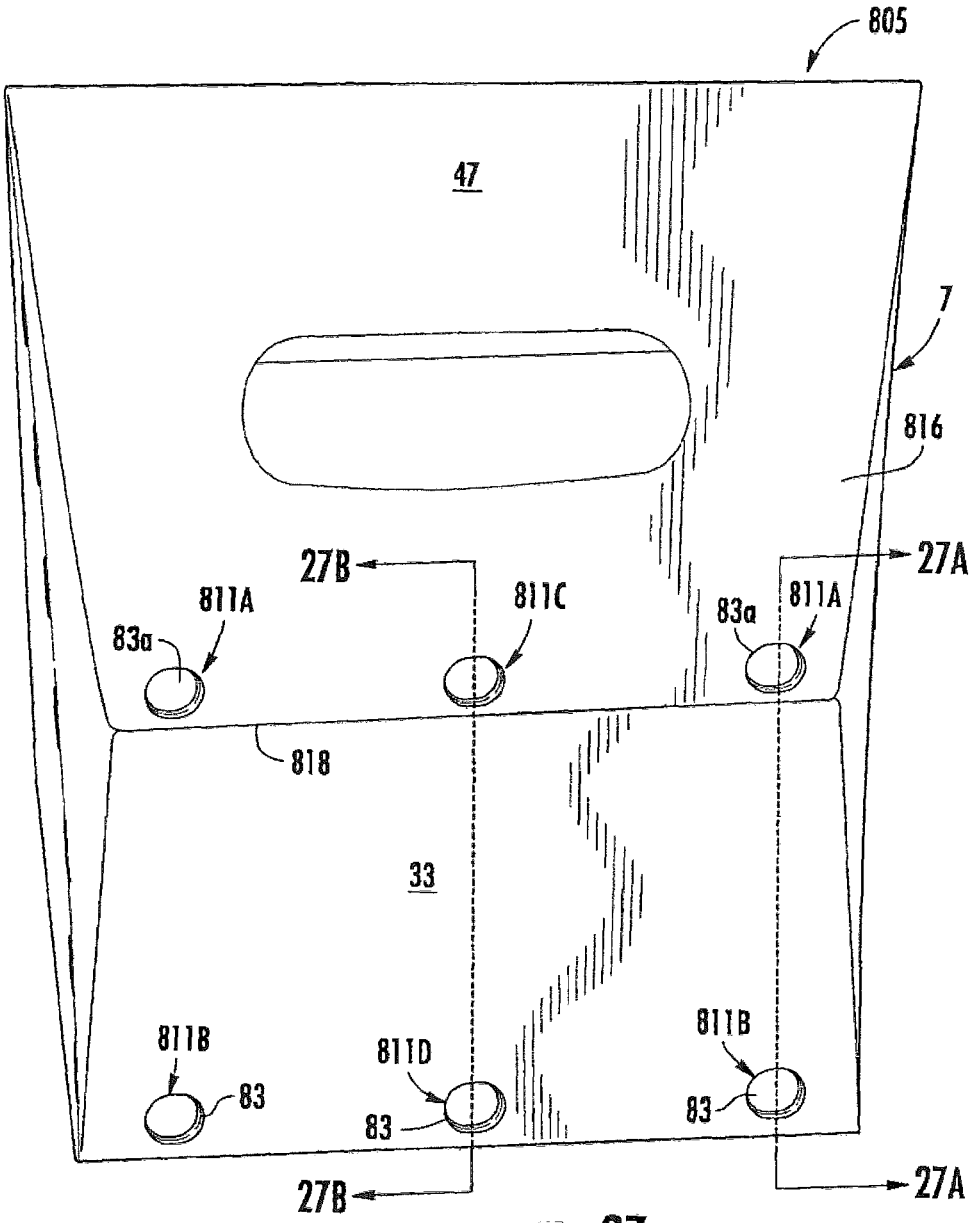
Figure 27A:
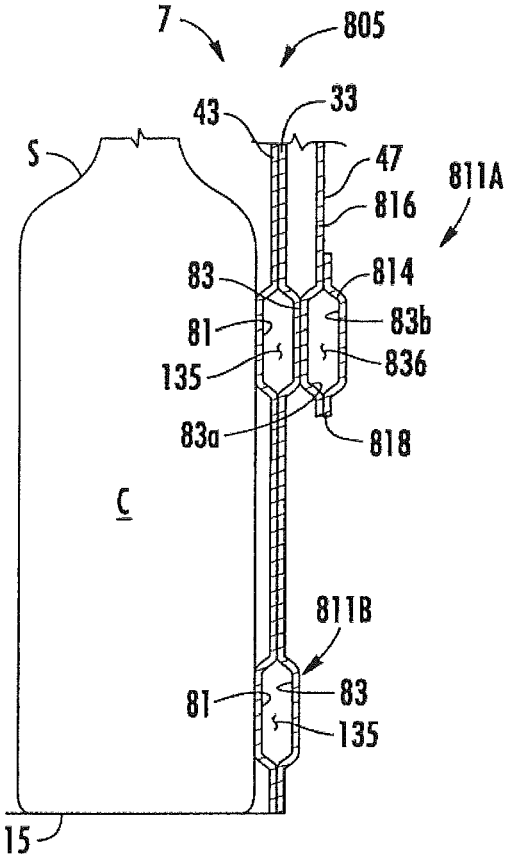
FIG. 27A is a cross-section taken along the plane 27A-27A of FIG. 27.
Figure 27B:
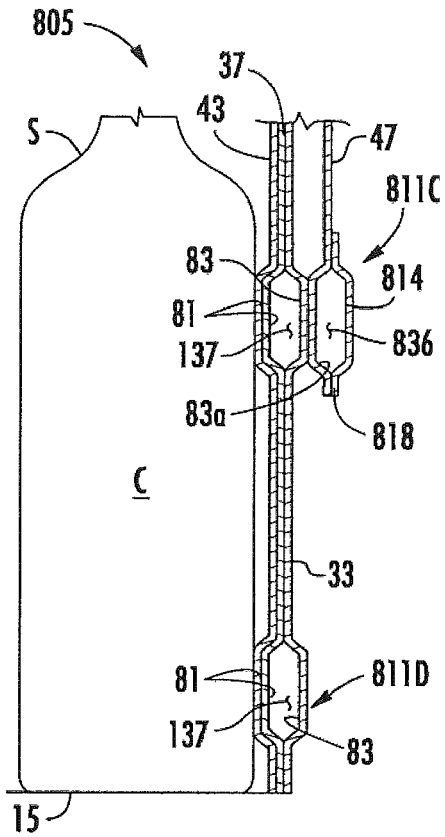
FIG. 27B is a cross-section taken along the plane 27B-27B of FIG. 27.

As shown in FIGS. 27 and 27B, the upper article protection feature 811C of the middle article protection features (e.g., between the two outer article protection features 811A) comprises the pocket 836 in the top end flaps 47, 49 and the upper pocket 137 that is formed by the indentations 81 of bottom end flaps 33, 35 and the overlapped portions of the side end flaps 37, 39, 43, 45. The lower article protection features 811D of the middle article protection features comprises the lower pocket 137 that is formed by the indentations 81 of the overlapped portions of the side end flaps 43. As with the previous embodiments, any or all of the pockets 135, 137, 836 could be filled with shock-absorbing material 139 without departing from the disclosure. The pockets 135, 137 can be similar to the corresponding pockets shown in FIG. 9 for the first embodiment, or the pockets could be otherwise shaped, arranged, configured, and/or omitted. Any of the article protection features 811, 811A, 811B, 811C, 811D could be otherwise shaped, arranged, and/or configured without departing from the disclosure.

In one embodiment, the reinforcement flaps 814 are folded under the base portion 816 to provide an extra layer of material to reinforce and enhance the cushioning and protection of the container C by the article protection features 811A in the closed ends 7, 9 of the carton 805. Alternatively, the reinforcement flap 814 could be folded over and be in contact with the exterior surface of the base portion 816 so that the reinforcement flap is in face-to-face contact with the exterior surface of the base portion. Alternatively, the reinforcement flaps 814 and base portions 816 could be otherwise shaped, arranged, and/or configured without departing from the disclosure.

Figure 28:
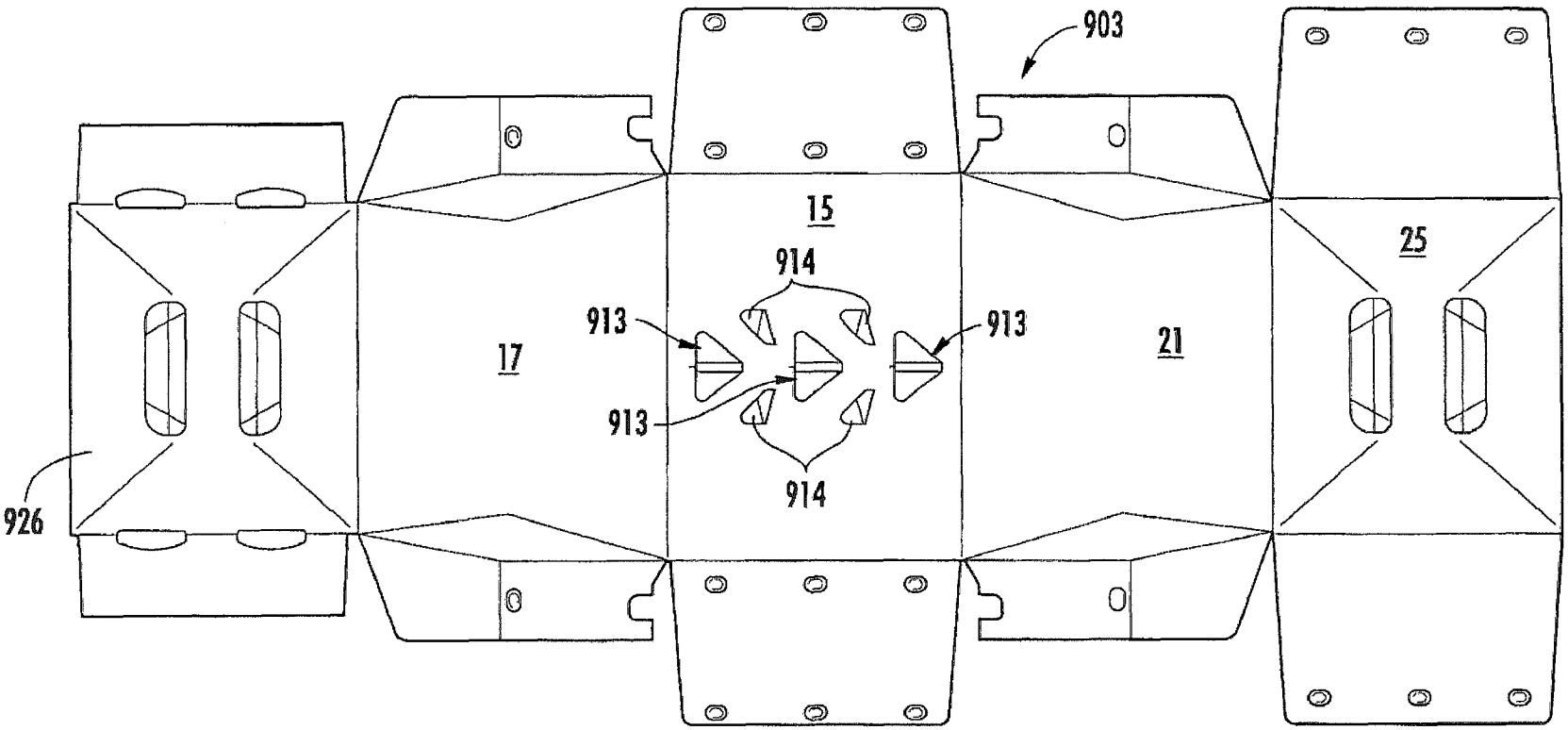
FIG. 28 is a plan view of an exterior surface of a blank for forming a carton according to an alternative embodiment of the disclosure.

FIG. 28 illustrates various features of a blank 903 for forming a carton of an alternative embodiment having similar features as the first embodiment of the disclosure. Accordingly, like or similar features will be indicated with like or similar reference numbers. The blank 903 has a bottom panel 15 with primary article protection flaps 913 that are arranged in a single row of three article protection flaps. Secondary article protection flaps 914 are foldably connected to the bottom panel 15 and are spaced apart from a respective primary article protection flap 913. In the illustrated embodiment, four secondary article protection flaps 914 are included, but more or less than four secondary article protection flaps could be used, or the secondary article protection flaps could be otherwise shaped, arranged, and/or configured without departing from the disclosure. The secondary article protection flaps 914 provide additional cushioning of the containers C and tightening of the carton 5 formed from the blank 903.

In one embodiment, the secondary article protection flaps 914 are smaller than the primary article protection flaps 913, but it is understood that the article protection flaps could be otherwise shaped, arranged, and/or configured. The primary and second article protection flaps 913, 914 can be moved to a second (raised) position in a similar manner as described above for the previous embodiments. In the illustrated embodiment, the blank 903 comprises a second top panel 926 that is placed in face-to-face contact with the first top panel 25 to reinforce the top panel of the carton formed from the blank 903. However, it is understood that the primary article protection flaps 913 and secondary article protection flaps 914 could be included on any other style of blanks (e.g., blanks similar to the blank 3 of FIG. 1 having only a single top panel 25) for use in forming any other style of carton without departing from the disclosure.

Figure 29:
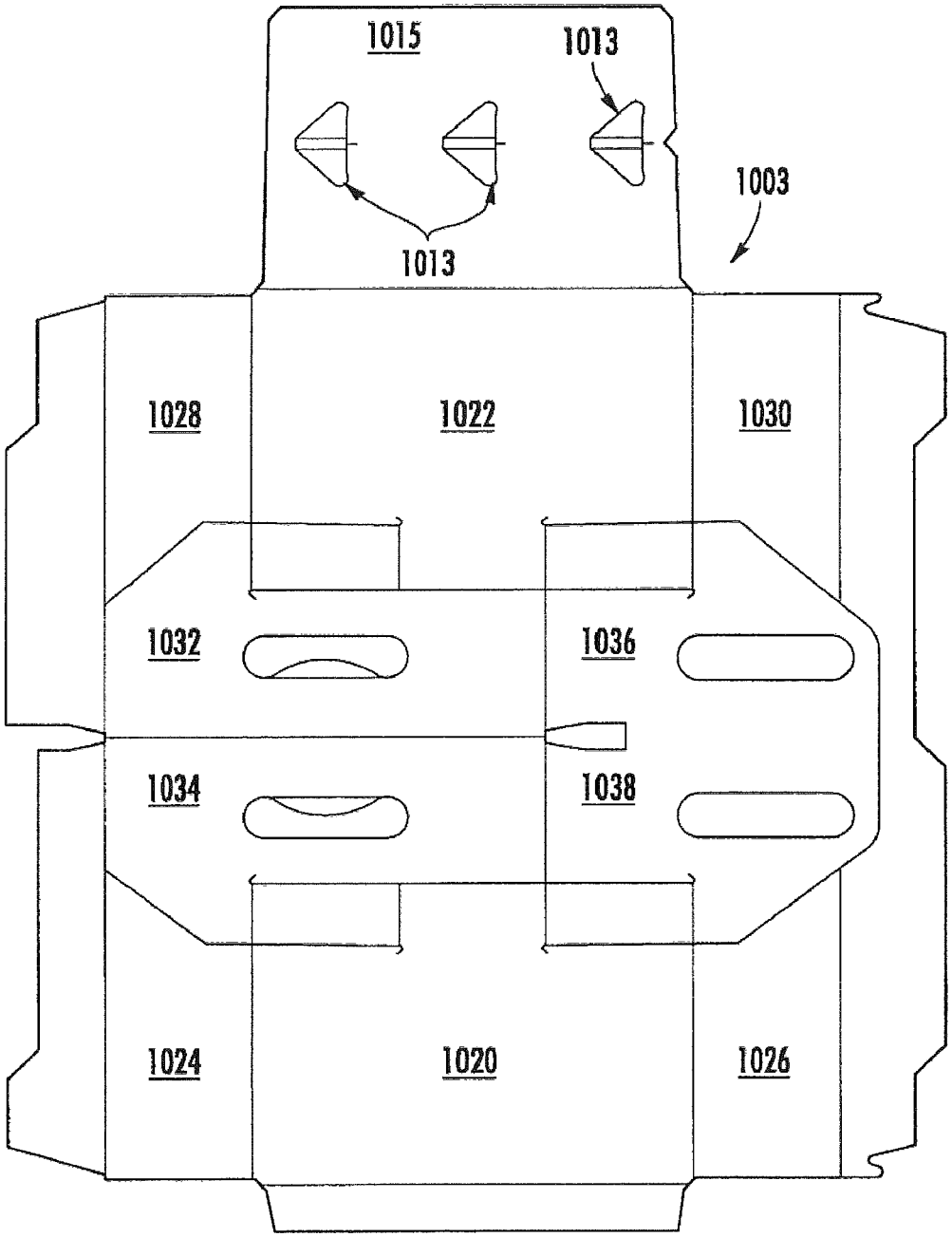
FIG. 29 is a plan view of an exterior surface of a blank for forming a carton according to an alternative embodiment of the disclosure.
Figure 30:
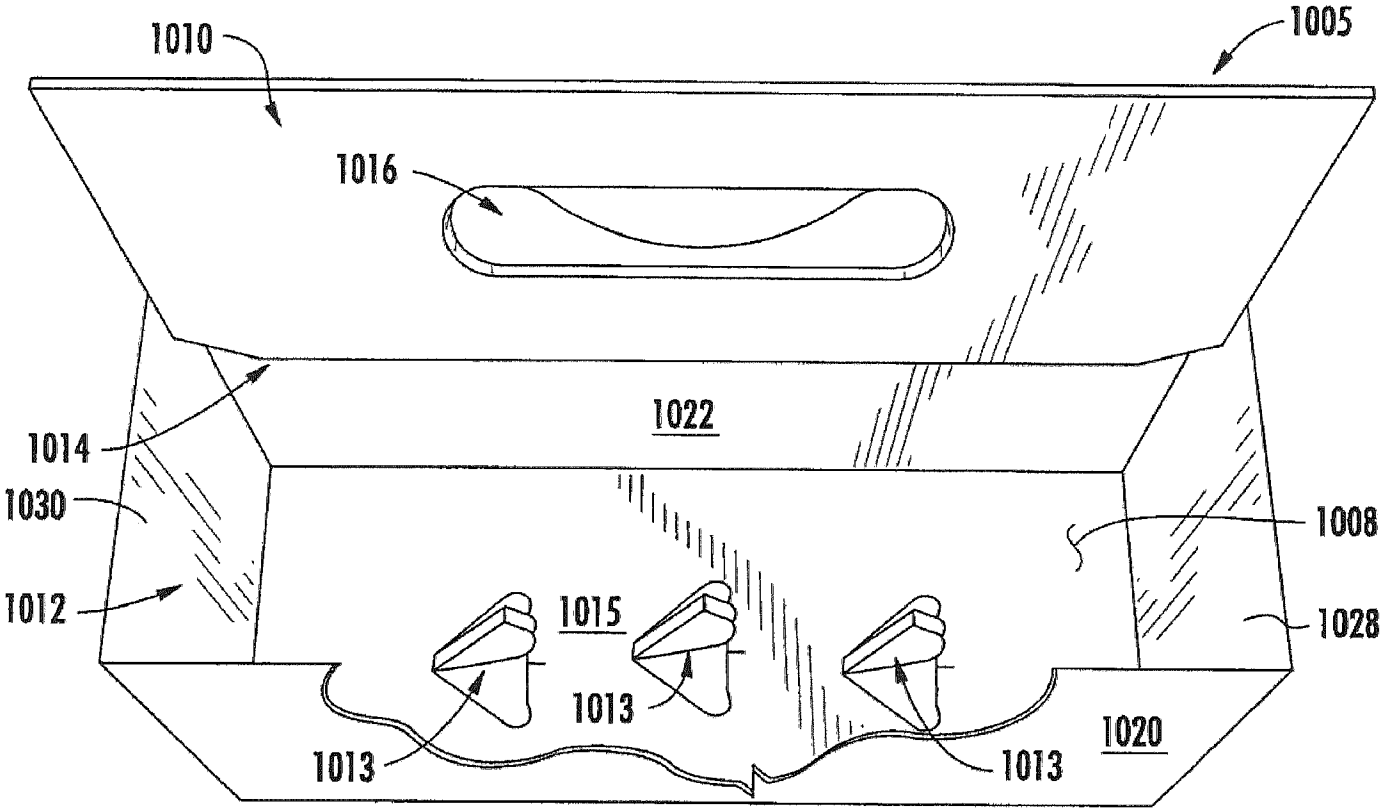
FIG. 30 is a perspective view of a carton according to the embodiment of FIG. 29.

FIGS. 29-30 illustrate various features of a blank 1003 for forming a carton 1005 of an alternative embodiment having similar features as the first embodiment of the disclosure. Accordingly, like or similar features will be indicated with like or similar reference numbers. The blank 1003 is for forming the carton 1005 that is a carrier having an interior space 1008 that has a generally open top with a divider 1010 that at least partially divides the interior space into a front portion 1012 and a back portion 1014. In one embodiment, the divider 1010 comprises a handle 1016 and the divider does not extend down to the bottom panel 1015. The divider 1010 could be otherwise shaped, arranged, and/or configured without departing from the disclosure.

In the illustrated embodiment, the blank 1003 has a front panel 1020, back panel 1022, and respective side panels 1024, 1026, 1028, 1030 for forming the sides of the carton 1005. The blank 1003 has divider panels 1032, 1034, 1036, 1038 that combine to form the divider 1010 of the carton 1005. In one embodiment the bottom panel 1015 is foldably connected to the back panel 1022 but the bottom panel 1015 could be otherwise arranged without departing from the disclosure. The bottom panel 1015 includes article protection flaps 1013 that are similar to the article protection flaps 13 of the first embodiment. The article protection flaps 1013 are foldably connected to the bottom panel 1015 and arranged in a single row of three flaps. In the illustrated embodiment, the article protection flaps 1013 are positioned in the second (raised) position in a similar manner as the previous embodiments. The article protection flaps 1013 are positioned on the bottom panel 1015 so that the flaps are placed between adjacent containers C, with one of the adjacent containers being located in the front portion 1012 of the interior space 1008 and the other of the adjacent containers being located in the back portion 1014 of the interior space. The article protection flaps 1013 could be otherwise shaped, arranged, and/or configured without departing form the disclosure.

Figures 31A, 31B, 31C, 32A, 32B, 32C, 33A, 33B, 33C:
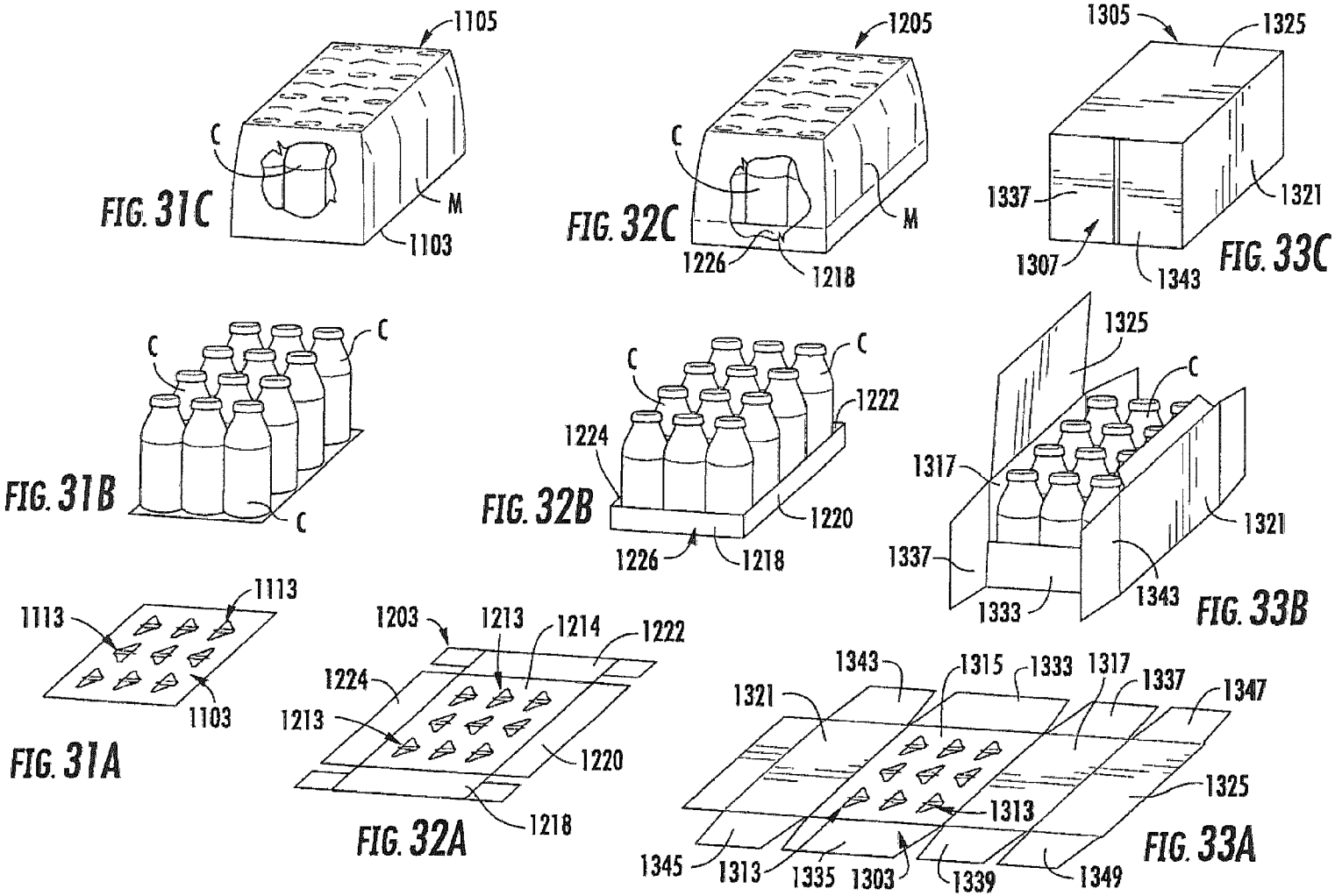
FIGS. 31A-31C are various views of a blank and carton according to an alternative embodiment.
FIGS. 32A-32C are various views of a blank and carton according to an alternative embodiment.
FIGS. 33A-33C are various views of a blank and carton according to an alternative embodiment of the disclosure.

FIGS. 31A-31C illustrate various features of a blank 1103 for forming a carton 1105 of an alternative embodiment having similar features as the previous embodiments of the disclosure. Accordingly, like or similar features will be indicated with like or similar reference numbers. The blank 1103 is a single panel for supporting the plurality of containers C. The blank 1103 comprises article protection flaps 1113 similar to the article protection flaps 13 of the earlier embodiments. The carton 1105 is formed by placing the plurality of containers C on the blank 1103 and then activating the article protection flaps 1113 by moving the article protection flaps from the first position that is substantially parallel to the blank 1103 to the second position wherein the article protection flaps are folded relative to the panel of the blank. In one embodiment, the carton 1105 can be further assembly by applying an overwrap of shrink-wrap (e.g., shrinkable polymer film) or other packaging material M so that the containers are securely attached to the blank 1103. In the embodiment of FIGS. 31A-31C the blank 1103 is a bottom panel, but the blank could be otherwise shaped, arranged, or configured without departing from the disclosure.

In an alternative embodiment, blank 1103 and articles C with activated article protection flaps 113 can be positioned relative to a construct to at least partially enclose the blank and the at least two articles. In one embodiment the construct can be a sleeve similar to the sleeve 131 of FIG. 2. Further the construct can have at least one open end, such as the ends 7, 9 that can be closed by respective end flaps. The blank 1103 and articles C can be positioned in an interior of the sleeve prior to closing both the ends 7, 9, or one of the ends can be closed prior to positioning the blank and articles. Alternatively, the construct could be a lid that fits over the tops of the articles C, and the lid could have one or more side panels extending down from a top panel.

FIGS. 32A-32C illustrate various features of a blank 1203 for forming a carton 1205 of an alternative embodiment having similar features as the previous embodiments of the disclosure. Accordingly, like or similar features will be indicated with like or similar reference numbers. The blank 1203 comprises a bottom panel 1214 and four side panels 1218, 1220, 1222, 1224 for forming a tray 1226 (FIG. 32B) having an interior space for holding the container C. The blank 1203 comprises article protection flaps 1213 similar to the article protection flaps 13 of the earlier embodiments. The carton 1205 is formed by placing the plurality of containers C on the bottom panel 1214 of the blank 1203 and upwardly folding the side panels 1218, 1220, 1222, 1224 to form the tray 1226. The article protection flaps 1213 are activated by moving the article protection flaps from the first position that is substantially parallel to the bottom panel 1214 to the second position wherein the article protection flaps are folded relative to the bottom panel of the blank 1203. In one embodiment, the carton 1205 can be further assembled by applying an overwrap of shrink-wrap (e.g., shrinkable polymer film) or other packaging material M so that the containers are securely attached to the tray 1226. In the embodiment of FIGS. 32A-32C the blank 1203 is configured for forming the tray 1226, but the blank could be otherwise shaped, arranged, or configured without departing from the disclosure.

FIGS. 33A-33C illustrate various features of a blank 1303 for forming a carton 1305 of an alternative embodiment having similar features as the previous embodiments of the disclosure. Accordingly, like or similar features will be indicated with like or similar reference numbers. The blank 1303 is generally similar to the blank 3 of the first embodiment in that the blank of FIGS. 33A-33C comprises a bottom panel 1315 and a first side panel 1317, a second side panel 1321, and a top panel 1325. The blank 1303 comprises article protection flaps 1313 similar to the article protection flaps 13 of the earlier embodiments. The carton 1305 is formed by placing the plurality of containers C on the bottom panel 1214 of the blank 1203 and upwardly folding the side panels 1317, 1321 around the containers on the bottom panel to partially form the carton as shown in FIG. 33B. Next, the top panel 1325 is downwardly folded to close the interior of the carton 1305 and the ends 1307, 1309 are closed by closing respective end flaps 1333, 1337, 1343, 1347 and 1335, 1339, 1345, and 1349. The article protection flaps 1313 are activated by moving the article protection flaps from the first position that is substantially parallel to the bottom panel 1315 to the second position wherein the article protection flaps are folded relative to the bottom panel 1315 of the blank 1303. The blank 1303 could be otherwise shaped, arranged, or configured without departing from the disclosure.

Figure 34:
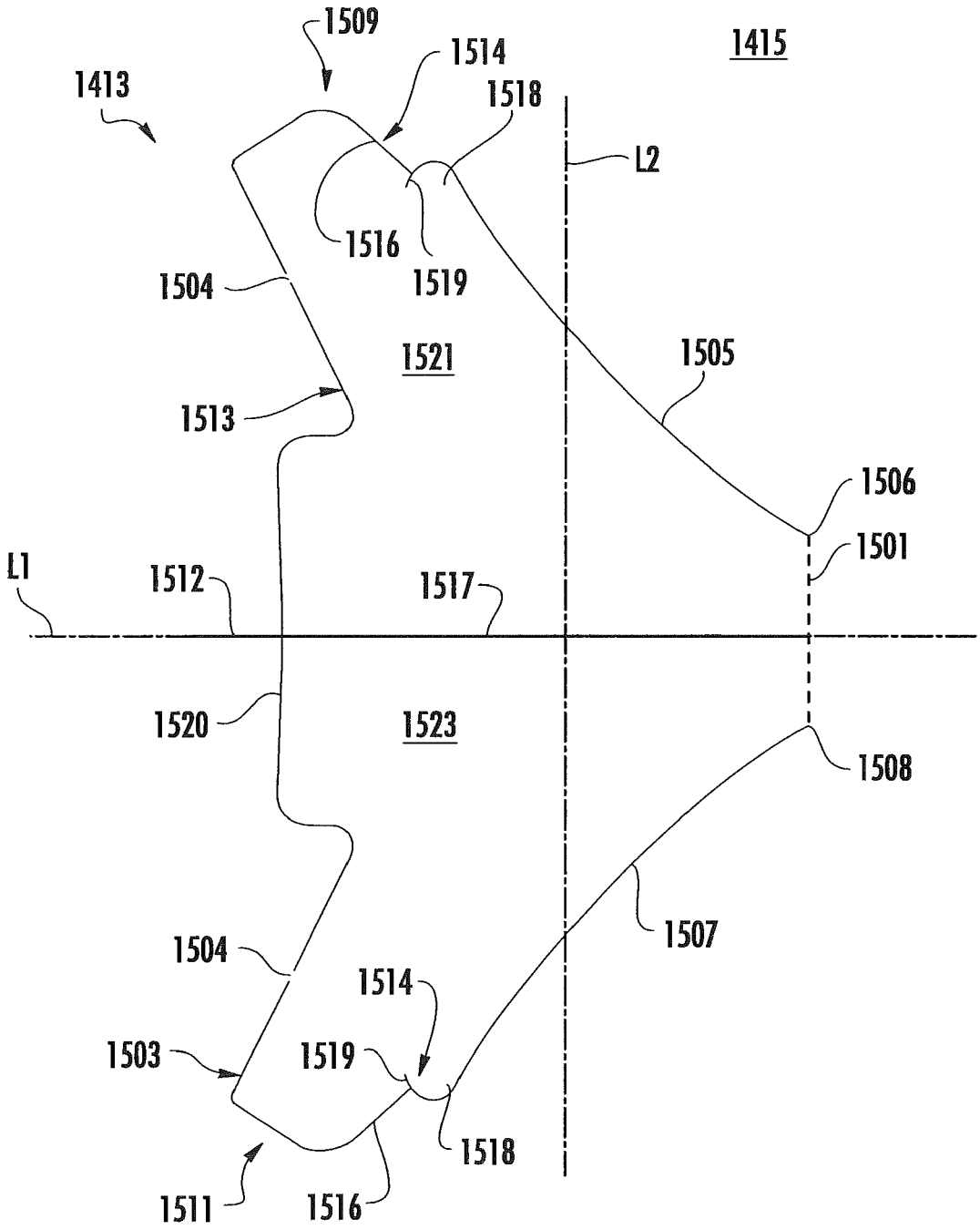
FIG. 34 is a top plan view of an enlarged portion of a bottom panel of a carton showing an article protection flap in a first position according to an alternative embodiment of the disclosure.
Figure 35:
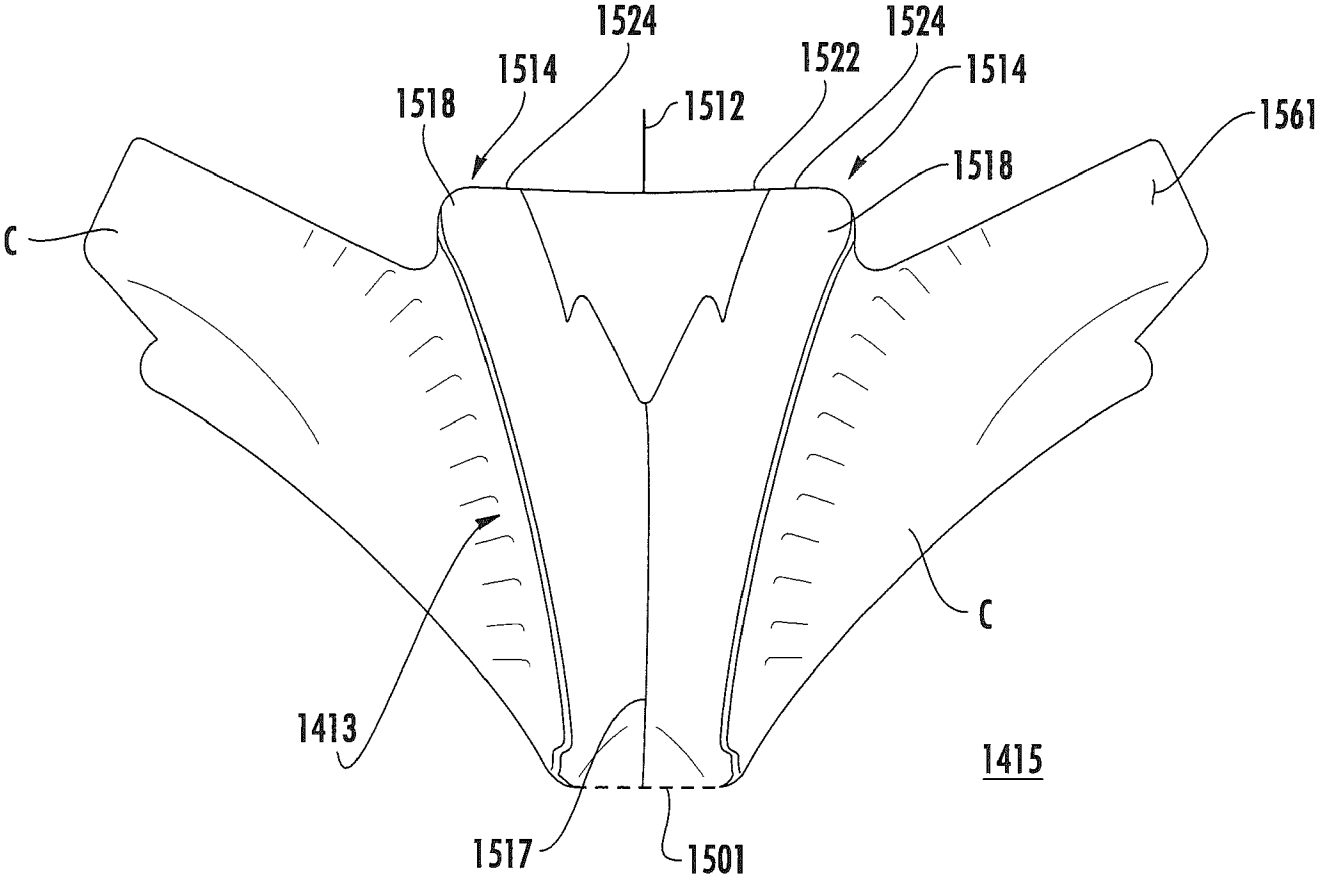
FIG. 35 is a plan view of an enlarged portion of the bottom panel of the carton of the embodiment of FIG. 34 with the article protection flap in a second position.
Figure 36:
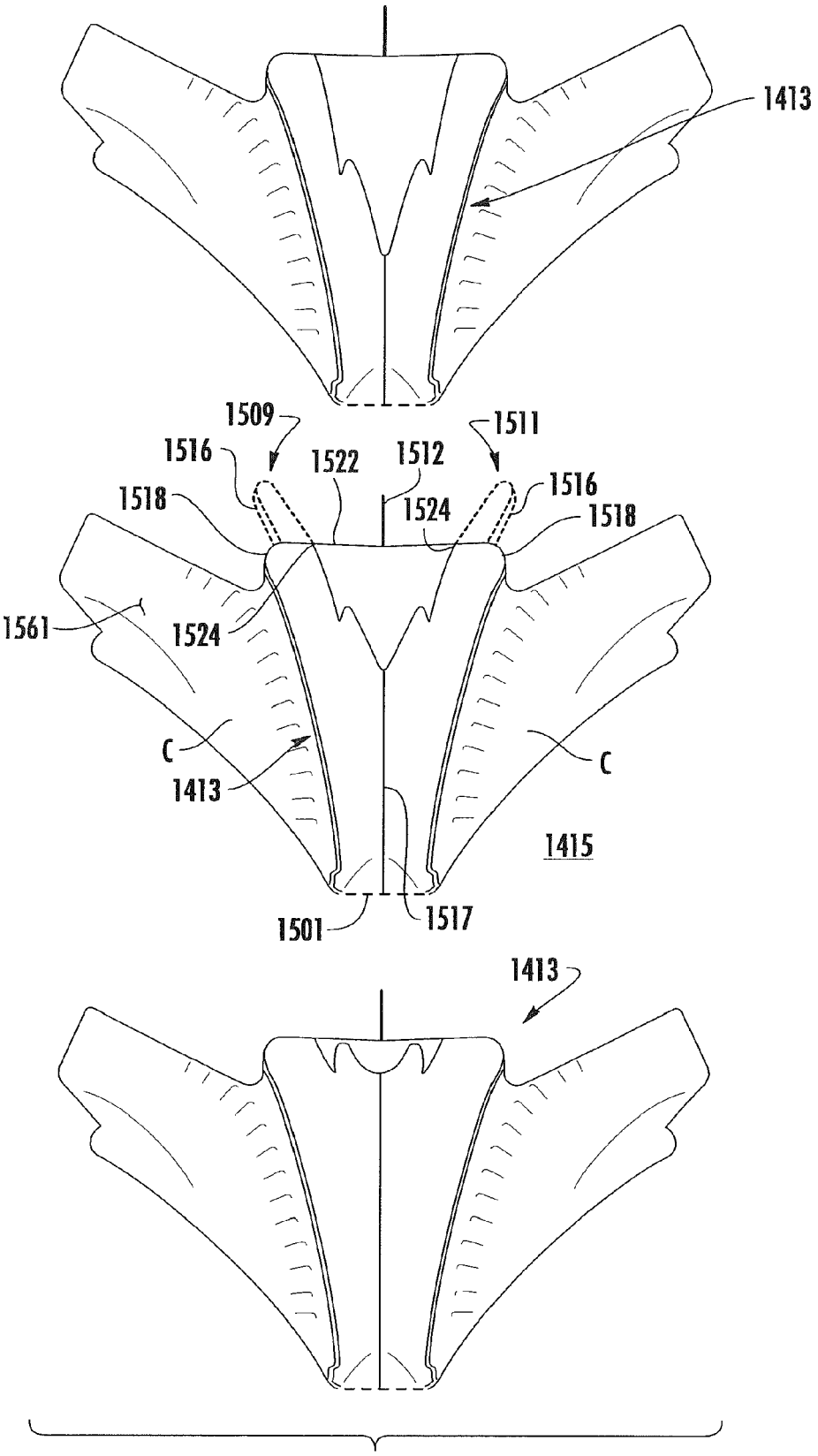
FIG. 36 is a plan view of the bottom panel of FIG. 35 showing three article protection flaps in the second position.

FIGS. 34-36 show article protection flaps in a bottom panel of a carton according to an alternative embodiment having similar features as the previous embodiments of the disclosure. The article protection flap 1413 is generally similar to the article protection flaps 13 of the first embodiment in that the article protection flap of FIGS. 34-36 is foldably connected to the bottom panel 1415 at a respective lateral fold line 1501 and is at least partially defined by a line of weakening 1503 in the bottom panel. In the embodiment of FIGS. 34-36, the blank can include any suitable number of article protection flaps 1413 and/or other article protection flaps. For example, the blank can include three article protection flaps 1413 arranged in a 1×3 arrangement (FIG. 36), but the blank could have more or less than three article protection flaps, and the flaps could be otherwise arranged in other suitable row/column arrangements or in a random configuration on the bottom panel 1415, including a single row or single column configuration, multiple row/column configurations, or any other suitable configuration. The description herein will describe the detailed arrangement and configuration of a single article protection flap 1413; however, the arrangement and configuration of the other article protection flaps will be similar or identical. In an alternative embodiment, one or more article protection flaps 1413 can be used with article protection flaps have different arrangements and configurations. In the illustrated embodiment, the article protection flap 1413 can have a longitudinal axis L1 and a lateral axis L2. In other embodiments, the blank can include article protection flaps that are different, similar, or identical to other article protection flaps without departing from the disclosure. In other embodiments, the article protection flaps 1413 could be otherwise shaped, arranged, and/or configured without departing from the disclosure.

In one embodiment, the line of weakening 1503 is a cut or cut line, but the line of weakening could comprise other forms of weakening (e.g., a tear line that comprises cut lines separated by breakable nicks, a tear line that is formed by a series of spaced apart cuts, etc.) that allows the article protection flap 1413 to separate from the bottom panel 1415 without departing from the disclosure. As shown in FIG. 34, the cut 1503 can include two nicks 1504. In an alternative embodiment, the cut 1503 could include any suitable number of nicks 1504. The cut 1503 has a first portion 1505 that is generally curved and extends from a first end 1506 of the lateral fold line 1501 and a second portion 1507 that is generally curved and extends from a second end 1508 of the lateral fold line. Both the first portion 1505 and the second portion 1507 of the cut 1503 extend away from the fold line 1501 and form a respective corner 1509, 1511 of the cut that transitions to a third portion 1513 of the cut. In the illustrated embodiment, each of the corners 1509, 1511 includes a respective recess or notch 1514 with a stop edge 1516 and a shoulder 1518. As shown in FIG. 34, a cut line 1519 extends from each notch 1514 into the article protection flap 1413 adjacent the respective shoulder 1518.

Figure 35A:
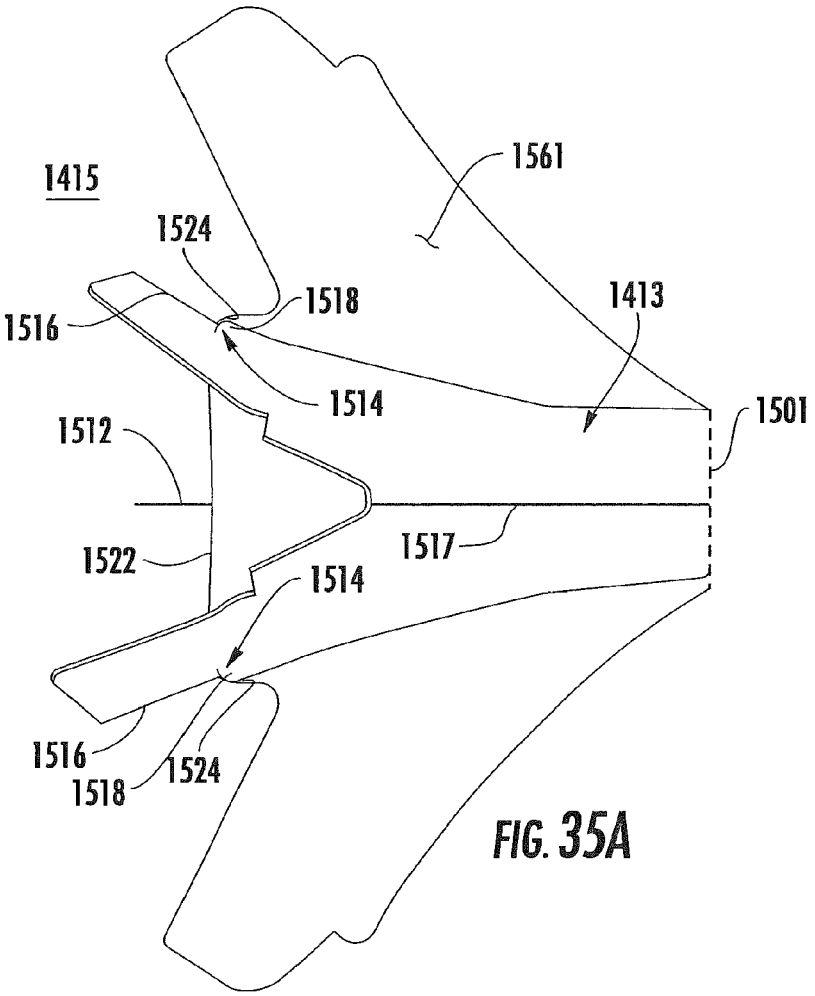
FIG. 35A is a top plan view of the article protection flap of FIG. 35 in the second position.
Figure 35B:
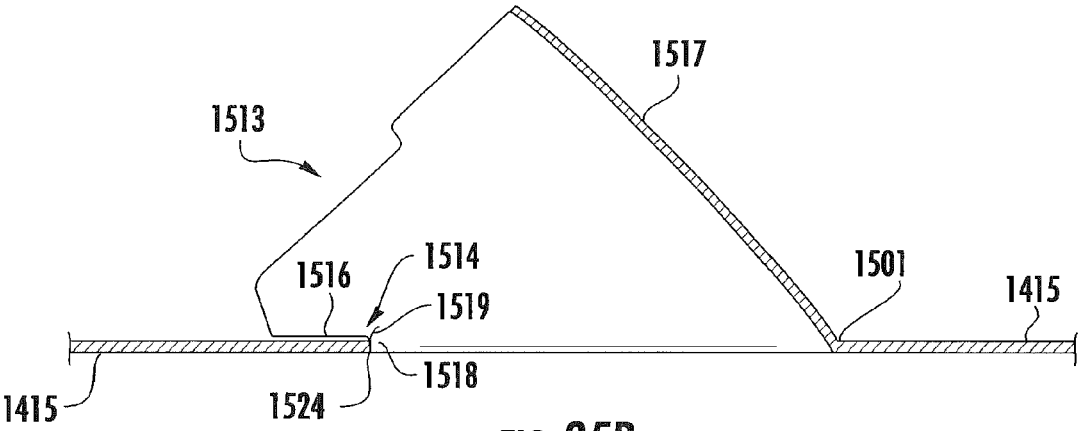
FIG. 35B is a cross-sectional view of the article protection flap of FIG. 35 in the second position.

As shown in FIG. 34, the third portion 1513 of the cut can extend obliquely and inwardly from each of the corners 1509, 1511 to a tab portion 1520 that generally projects outwardly from the article protection flap 1413 and forms a receiving recess 1522 in the bottom panel 1415 when the article protection flap 1413 is folded into the second position (FIGS. 35-35B). In the illustrated embodiment, a slit or cut 1512 is located adjacent the tab portion 1520 of the cut 1503. In one embodiment, the article protection flap 1413 can include a longitudinal fold line 1517 extending along the longitudinal axis L1 from the lateral fold line 1501 to an opposing portion of the cut 1503 (e.g., adjacent the cut 1512). As shown in FIG. 34, the article protection flap 1413 can include a first portion 1521 foldably connected to a second portion 1523 along the longitudinal fold line 1517. The fold lines 1501, 1517 and the cuts 1503, 1512 could be otherwise shaped, arranged, configured, and/or omitted such that the article protection flap 1413 has any other suitable shape or configuration without departing from the disclosure.

In the embodiment of FIGS. 34-36, the article protection flaps 1413 are activated in an at least partially closed carton 5 with containers C loaded therein. The article protection flaps 1413 are foldably connected to the bottom panel 1415 and moveable between a first position (FIG. 34) that is substantially parallel to the bottom panel and a second position (FIGS. 35-35B) wherein the article protection flaps are folded relative to the bottom panel. In one embodiment, the article protection flaps 1413 are raised or activated to the position of FIGS. 35-35B, and the article protection flaps have features for preventing the folding of the article protection flaps from the second position back to the first position. It is understood that the article protection flaps 1413 can be activated to the second position (FIGS. 35-35B) and the carton can be erected and closed similarly or identically to that described for the first embodiment. Alternatively, the article protection flaps 1413 could be otherwise activated and the carton can be otherwise erected and closed without departing from the disclosure.

The article protection flaps 1413 can be activated by various forming apparatus, some of which are described in further detail in the first embodiment, or any other suitable method. The activation of a single article protection flap 1413 will be described in detail herein, but it is understood that the other article protection flaps can be activated in a similar or different manner without departing from the disclosure. FIGS. 34 and 35 are enlarged portions of the bottom panel 1415, with FIG. 34 showing the interior surface of the bottom panel prior to activation of the article protection flap 1413, and FIG. 35 showing the exterior of the bottom panel after activation of the article protection flap. Additionally, FIG. 35A shows an interior view of the enlarged portion of the bottom panel 1415 showing a top view of the article protection flap 1413 in the second position, and FIG. 35B shows a cross-section of the enlarged portion of the bottom panel 1415 with the article protection flap 1413 in the second position. In one embodiment, a finger or other portion of an apparatus for forming the carton presses against a central portion (e.g., at or near the crease 1517) of the article protection flap 1413 to initiate separation of the article protection flap from the bottom panel 1415 along the cut 1503. As shown in FIGS. 35-35B, the article protection flap 1413 is pivoted upward relative to the bottom panel 1415 at the fold line 1501 to create an opening 1561 in the bottom panel.

As the article protection flap 1413 is activated, the corners 1509, 1511 can be folded relative to each other at least partially along the crease 1517. Accordingly, the article protection flap 1413 can provide two layers of material in a general wedge shape between adjacent containers C in the carton. As the article protection flap 1413 is folded into the interior of the carton, the edges of the article protection flap formed at the third portion 1513 of the cut 1503 can move into the receiving recess 1522 of the bottom panel 1415, and the corners 1509, 1511 can be folded together and forced through the cut 1512 into the interior of the carton. The corners 1509, 1511 then can spread out to form the general wedge shape shown in FIGS. 35 and 35A. In one embodiment, with the corners 1509, 1511 in the interior of the carton, the notches 1514 of the article protection flap 1413 can engage an edge or retention portion 1524, which can be at or near a respective corner of the receiving recess 1522 of the bottom panel 1415 (FIGS. 35 and 35A). Accordingly, the stop edges 1516 (shown in phantom in FIG. 36) can engage the interior surface of the bottom panel 1415 (FIGS. 35A and 35B) and the shoulders 1518 can engage the edge of the receiving recess 1522 (FIG. 35B) to help retain the article protection flap 1413 in the interior of the carton. As such, once the article protection flaps 1413 are raised to the second position and positioned between adjacent containers C, the article protection flaps stay in the upwardly folded position providing cushioning and protection between adjacent containers according to one embodiment.

In one embodiment, the upwardly folding of the article protection flaps 1413 causes the containers C in the carton to move to accommodate the space required for the article protection flaps in the second position. The movement of the containers C when the article protection flaps 1413 are upwardly folded and located between adjacent containers, tightens the packing of the containers in the carton so that the movement of the containers is limited by the positioning of the article protection flaps 1413, the side panels, and the closed ends of the carton. The article protection flaps 1413 are pressed against two adjacent containers C to initiate movement of the containers and provide the tightening feature of the article protection flaps. The article protection flaps 1413 could be otherwise shaped, arranged, and/or configured to have other features for preventing the article protection flaps from returning to the first or lowered position without departing from the disclosure.

Figure 37:
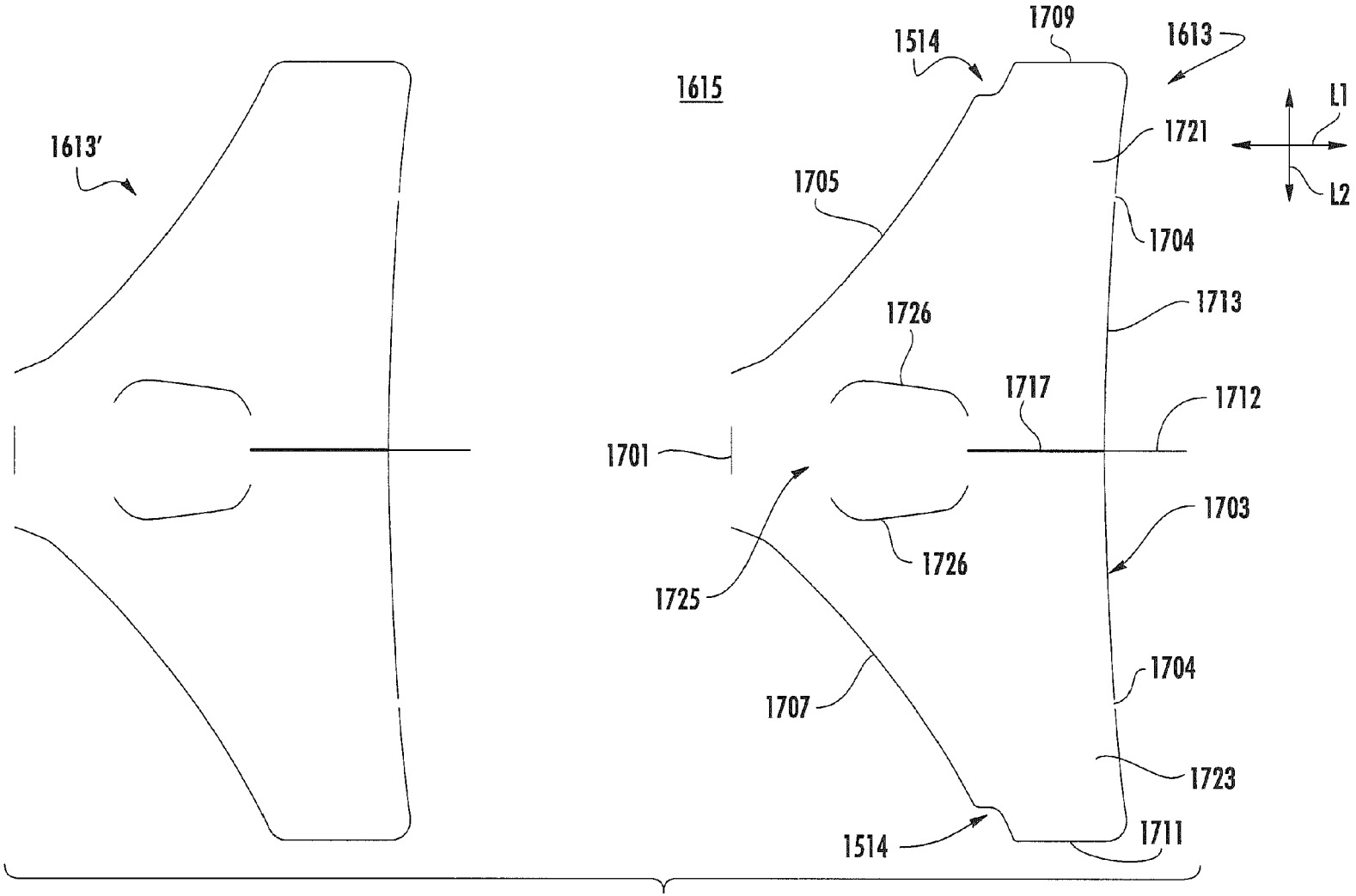
FIG. 37 is a top plan view of an enlarged portion of a bottom panel of a carton showing two article protection flaps in a first position according to two alternative embodiments of the disclosure.

FIGS. 37-40 show two article protection flaps in a bottom panel of a carton according to alternative embodiments having similar features as the previous embodiments of the disclosure. The article protection flaps 1613, 1613' are generally similar to the article protection flaps 13 of the first embodiment and/or the article protection flap 1413 of the embodiment of FIGS. 34-36. As shown in FIG. 37, the article protection flap 1613 includes notches 1514 that are similar to the notches of the article protection flap 1413 shown in FIG. 34. The notches are omitted in the article protection flap 1613' as shown in FIG. 37.

As shown in FIG. 37, the fold line 1701 comprises a lateral cut that is aligned with and spaced apart from the ends of the line of weakening 1703. The fold line 1701 could be any suitable fold line (e.g., a crease, a score, a cut-crease line, etc.) or other line of weakening without departing from the disclosure. In one embodiment, the line of weakening 1703 is a cut, but the line of weakening could comprise other forms of weakening (e.g., a tear line that comprises cut lines separated by breakable nicks, a tear line that is formed by a series of spaced apart cuts, etc.) that allows the article protection flap 1613 to separate from the bottom panel 1615 without departing from the disclosure. As shown in FIG. 37, the cut 1703 can include two nicks 1704. In an alternative embodiment, the cut 1703 could include any suitable number of nicks 1704. The cut 1703 has first and second portions 1705, 1707 that are generally curved. Both the first portion 1705 and the second portion 1707 of the cut 1703 extend away from the fold line 1701 and form a respective corner 1709, 1711 of the cut that transitions to a third portion 1713 of the cut. In one embodiment, the corners 1709, 1711 can include notches 1514 as described above with respect to FIGS. 34-36. In the embodiment shown in FIGS. 37-40, the recess in the bottom panel is omitted, and the notches 1514 can engage the edge of the bottom panel formed by the third portion 1713 of the cut 1703. The corners 1709, 1711 could be otherwise shaped, arranged, configured, and/or omitted without departing from the disclosure. In the illustrated embodiment, the third portion 1713 is generally straight or slightly curved and extends in the lateral direction L2 between the two corners 1709, 1711. In one embodiment, a slit or cut 1712 is located adjacent the third portion 1713 of the cut 1703, and the article protection flap 1613 comprises a longitudinal crease or fold line 1717.

Figure 38:
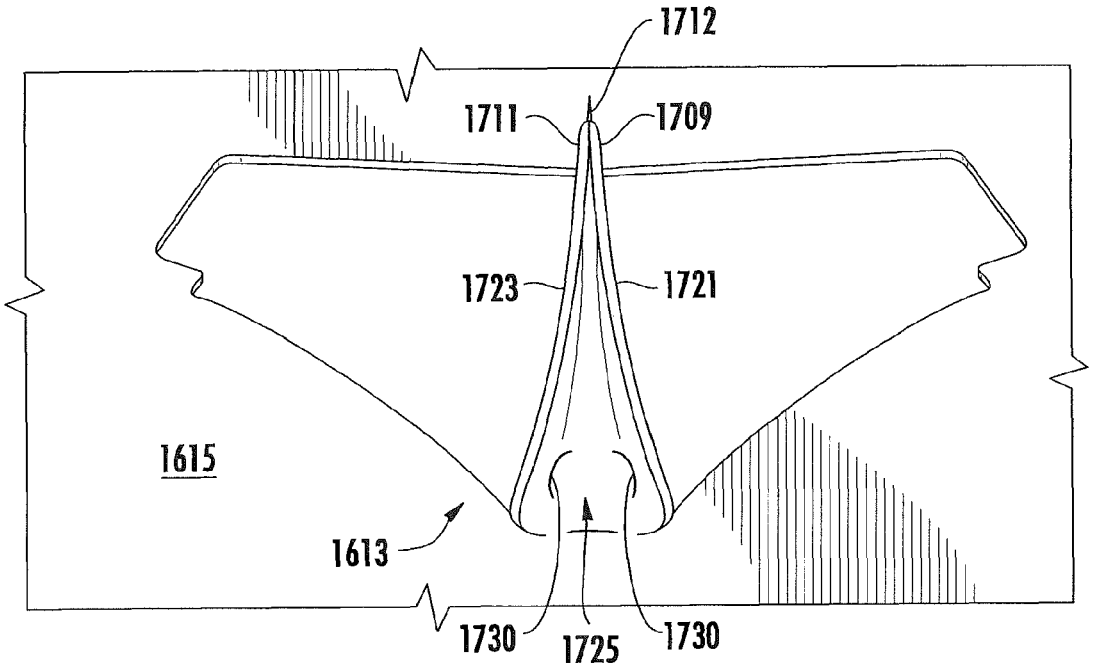
FIG. 38 is a bottom view of the enlarged portion of the bottom panel of FIG. 37 with the article protection flap partially folded into a second position.
Figure 39:
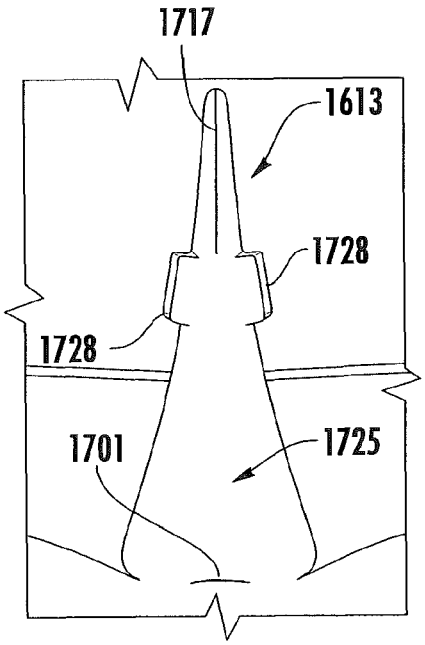
FIGS. 39 and 40 are perspective views of the article protection flap of FIG. 37 with the article protection flap in the second position.
Figure 40:
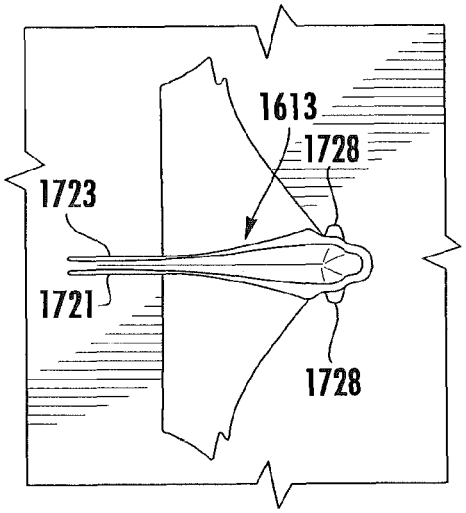

As shown in FIG. 37, the article protection flap 1613 can include two generally arcuate cuts 1726 that are spaced apart from one another in a central portion 1725 of the article protection flap between the longitudinal fold line 1717 and the lateral fold line 1701. The generally arcuate cuts 1726 can form projections or tabs 1728 (FIGS. 39 and 40) when the article protection flap 1613 is activated. The tabs 1728 can resist folding of the central portion of the article protection flap as the article protection flap is activated and can lock against and/or abut the heels of adjacent containers C in the carton to help maintain the wedge shape of the article protection flap in the second position. FIG. 38 shows that the corners 1709, 1711 can be brought together during activation of the article protection flap, with the corners sliding though the slit 1712. FIGS. 39 and 40 show the article protection flap 1613 folded to the interior of the carton and illustrate the tabs 1728 extending outward from the central portion of the article protection flap. As shown in FIGS. 39 and 40, the tabs 1728 can separate from the outer portions 1721, 1723 of the article protection flap 1613 as the corners 1709, 1711 are folded together to help maintain the width of the central portion 1725 of the article protection flap. As shown in FIG. 38, the arcuate cuts 1726 can form edges 1730 of the respective outer portions 1721, 1723 adjacent respective openings in the article protection flap 1613. The fold lines 1701, 1717 and cuts 1703, 1705, 1712, 1726 could be otherwise shaped, arranged, configured, and/or omitted such that the article protection flap 1613 has any other suitable shape or configuration without departing from the disclosure. Additionally, the generally arcuate cuts 1726 and/or the tabs 1728 could be incorporated into any suitable article protection flap.

Figure 41:
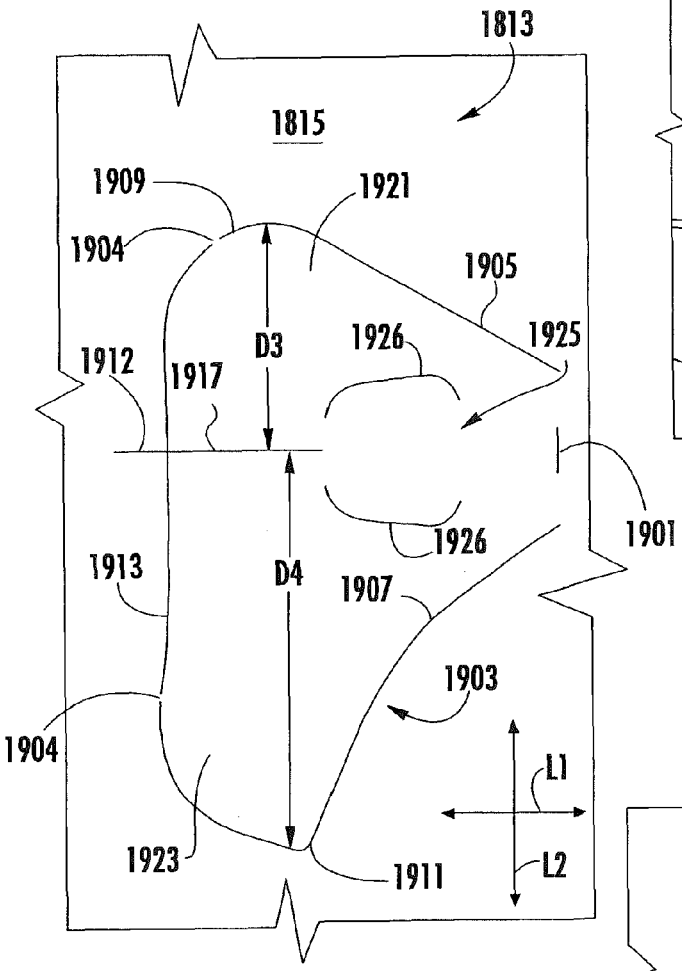
FIG. 41 is a top plan view of an enlarged portion of a bottom panel of a carton showing an article protection flap in a first position according to an alternative embodiment of the disclosure.
Figure 42:
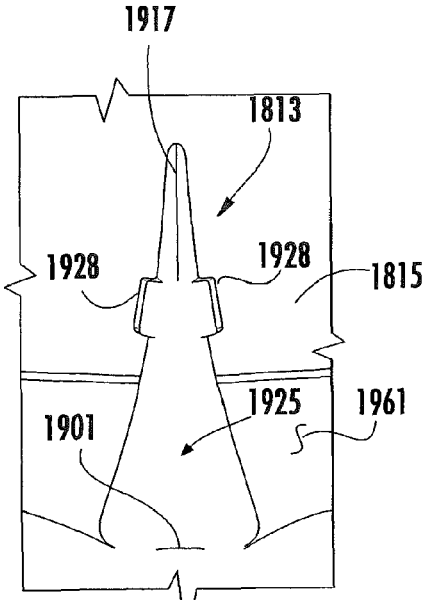
FIGS. 42 and 43 are perspective views of the article protection flap of FIG. 41 with the article protection flap in the second position.
Figure 43:
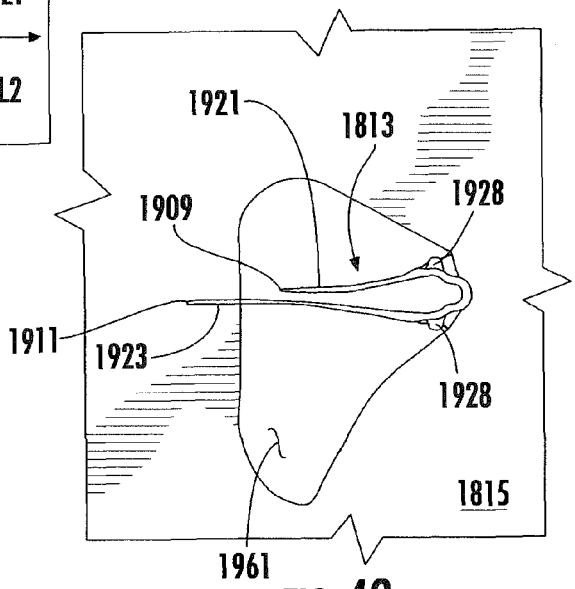

FIGS. 41-43 show an article protection flap in a bottom panel of a carton according to an alternative embodiment having similar features as the previous embodiments of the disclosure. The article protection flap 1813 is generally similar to the article protection flaps 1613 of the embodiment shown in FIGS. 37-40. In the illustrated embodiment, the article protection flap 1813 is foldably connected to the bottom panel 1815 at a respective lateral fold line 1901 and is at least partially defined by a line of weakening 1903 in the bottom panel. The blank can include any suitable number of article protection flaps 1813 and/or other article protection flaps. For example, the blank can include three article protection flaps 1813 arranged in a 1×3 arrangement, but the blank could have more or less than three article protection flaps, and the flaps could be otherwise arranged in other suitable row/column arrangements or in a random configuration on the bottom panel 1815, including a single row or single column configuration, multiple row/column configurations, or any other suitable configuration. In the illustrated embodiment, the article protection flap 1813 can have a longitudinal axis L1 and a lateral axis L2. The article protection flaps 1813 could be otherwise shaped, arranged, and/or configured without departing from the disclosure.

As shown in FIG. 41, the fold line 1901 comprises a lateral cut that is aligned with and spaced apart from the ends of the line of weakening 1903. The fold line 1901 could be any suitable fold line (e.g., a crease, a score, a cut-crease line, etc.) or other line of weakening without departing from the disclosure. In one embodiment, the line of weakening 1903 is a cut, but the line of weakening could comprise other forms of weakening (e.g., a tear line that comprises cut lines separated by breakable nicks, a tear line that is formed by a series of spaced apart cuts, etc.) that allows the article protection flap 1813 to separate from the bottom panel 1815 without departing from the disclosure. For example, as shown in FIG. 41, two nicks 1904 are formed in the line of weakening 1903 to help retain the article protection flap 1813 in the first position until it is actuated. The cut 1903 has first and second portions 1905, 1907 that extend away from the fold line 1901 and form a respective corner 1909, 1911 of the cut that transitions to a third portion 1913 of the cut. In the illustrated embodiment, the first portion 1905 of the cut is generally straight and oblique with respect to the longitudinal direction L1 and the lateral direction L2. The second portion 1907 can be generally curved in the exemplary embodiment.

As shown in FIG. 41, the first corner 1909 is spaced apart from a longitudinal crease or fold line 1917 in the article protection flap by a distance D3, and the second corner is spaced apart from the longitudinal fold line 1917 by a distance D4. In one embodiment, the distance D4 is greater than the distance D3. Accordingly, the article protection flap 1813 is asymmetrical and can include a smaller first portion or flap 1921 and a larger second portion or flap 1923 as shown in FIG. 41. The corners 1909, 1911 could be otherwise shaped, arranged, configured, and/or omitted without departing from the disclosure. In the illustrated embodiment, the third portion 1913 is generally straight or slightly curved and extends in the lateral direction L2 between the two corners 1909, 1911. In one embodiment, a slit or cut 1912 is located adjacent the third portion 1913 of the cut 1903.

As shown in FIG. 41, the article protection flap 1813 can include two generally arcuate cuts 1926 that are spaced apart from one another in a central portion 1925 of the article protection flap between the longitudinal fold line 1917 and the lateral fold line 1901. The generally arcuate cuts 1926 can form projections or tabs 1928 (FIGS. 42 and 43) when the article protection flap 1913 is activated. The cuts 1926 and the tabs 1928 can be similar to the cuts 1726 and the tabs 1728 in the embodiment shown in FIGS. 37-40. The tabs can resist folding of the central portion of the article protection flap as the article protection flap is activated and can lock against and/or abut the heels of adjacent containers C in the carton to help maintain the wedge shape of the article protection flap in the second position.

In the embodiment of FIG. 41-43, the article protection flaps 1813 are activated in an at least partially closed carton with containers C loaded therein. The article protection flaps 1813 are moveable between a first position (FIG. 41) that is substantially parallel to the bottom panel 1815 and a second position (FIGS. 42 and 43) wherein the article protection flaps are folded relative to the bottom panel. In one embodiment, the article protection flaps 1813 have features for preventing the folding of the article protection flaps from the second position back to the first position. It is understood that the article protection flaps 1813 can be activated to the second position and the carton can be erected and closed similarly or identically to that described in the embodiment including FIGS. 37-40. Alternatively, the article protection flaps 1813 could be otherwise activated and the carton can be otherwise erected and closed without departing from the disclosure.

The article protection flaps 1813 can be activated by various forming apparatus, some of which are described in further detail in the prior embodiments and/or the incorporated by reference applications, or any other suitable method. The activation of a single article protection flap 1813 will be described in detail herein, but it is understood that the other article protection flaps can be activated in a similar or different manner without departing from the disclosure. In one embodiment, a finger or other portion of an apparatus for forming the carton presses against a central portion (e.g., at or near the crease 1917) of the article protection flap 1813 to initiate separation of the article protection flap from the bottom panel 1815 along the cut 1903, breaking the nicks 1904. In one embodiment, the article protection flap 1813 is pivoted upward relative to the bottom panel 1815 at the fold line 1901 to create an opening 1961 (FIGS. 42 and 43) in the bottom panel.

As the article protection flap 1813 is activated, the portions 1921, 1923 can be folded relative to each other at least partially along the crease 1917 so that the corner 1909 is folded against the portion 1923 as shown in FIG. 43. Accordingly, the article protection flap 1913 can provide two layers of material in a general wedge shape between adjacent containers C in the carton. As the article protection flap 1913 is folded into the interior of the carton, at least the corner 1911 can be forced through the cut 1912 into the interior of the carton. The tabs 1928 formed from the arcuate cuts 1926 can separate from the portions 1921, 1923 as the portions are folded together to help maintain the width of the central portion 1925 of the article protection flap. The fold lines 1901, 1917 and cuts 1903, 1912, 1926 could be otherwise shaped, arranged, configured, and/or omitted such that the article protection flap 1813 has any other suitable shape or configuration without departing from the disclosure.

In one embodiment, the upwardly folding of the article protection flaps 1813 causes the containers C in the carton to move to accommodate the space required for the article protection flaps in the second position. The movement of the containers C when the article protection flaps 1813 are upwardly folded and located between adjacent containers, tightens the packing of the containers in the carton so that the movement of the containers is limited by the positioning of the article protection flaps 1813, the side panels, the closed ends of the carton, and/or suitable features. The article protection flaps 1813 are pressed against two adjacent containers C to initiate movement of the containers and provide the tightening feature of the article protection flaps.

The asymmetric shape of the article protection flap 1813 has the benefit of forming a smaller hole 1961 in the bottom panel 1815 than a symmetric flap because of the smaller portion 1921. However, the larger portion 1923 can still engage the interior surface of the bottom panel 1815 to help prevent the article protection flap 1813 from folding through the opening 1961 from the second position. For example, in one embodiment, the hole 1961 formed by each article protection flap 1813 could be about nine percent smaller than if the portion 1921 were the same size as the portion 1923 (e.g., a symmetrical flap). Accordingly, the asymmetric article protection flap 1813 is able to provide two plies of material between adjacent containers C and to resist folding from the second position while, at the same time, reducing weakening of the bottom panel 1815.

Figure 44:
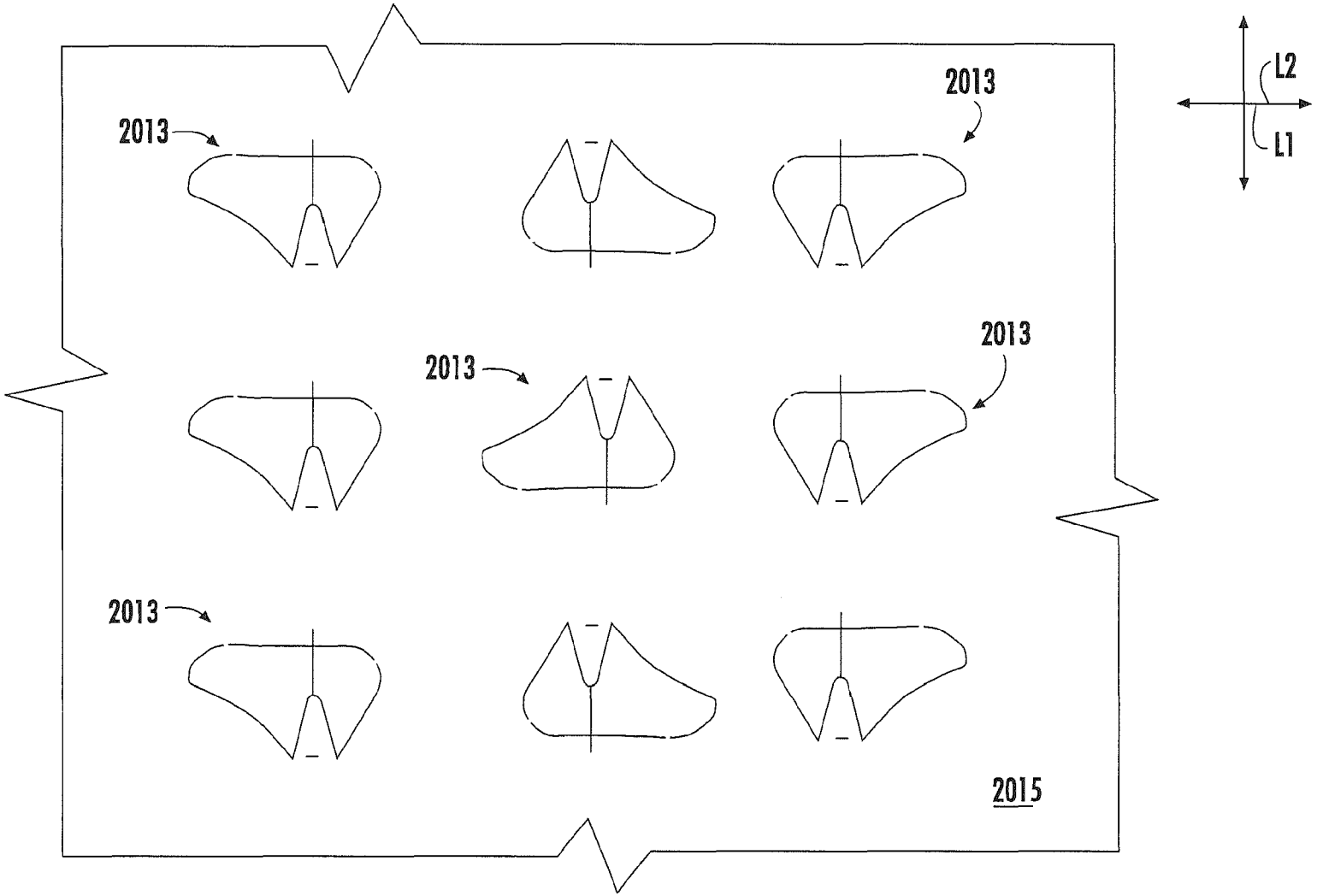
FIG. 44 is a top plan view of a bottom panel of a carton showing an arrangement of article protection flaps in a first position according to an alternative embodiment of the disclosure.
Figure 45:
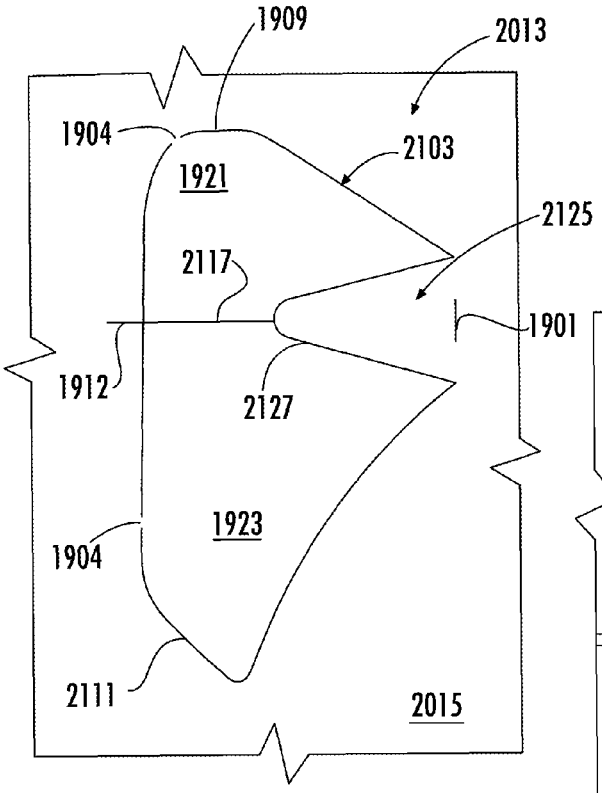
FIG. 45 is a top plan view of an enlarged portion of the bottom panel of FIG. 44 showing one of the article protection flaps of FIG. 44.
Figure 46:
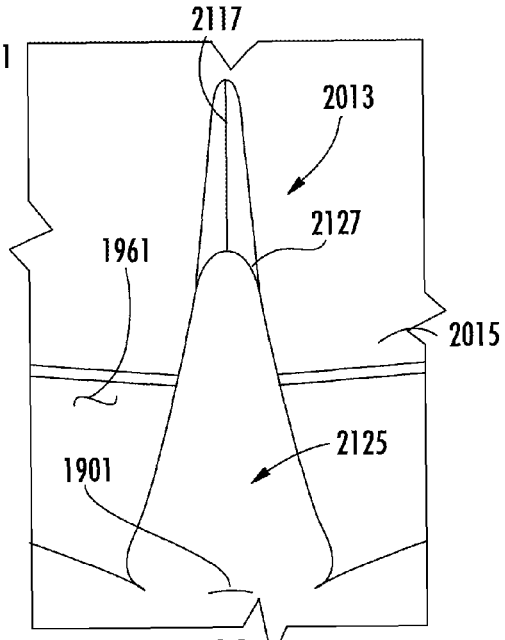
FIGS. 46 and 47 are perspective views of the article protection flap of FIG. 45 with the article protection flap in the second position.
Figure 47:
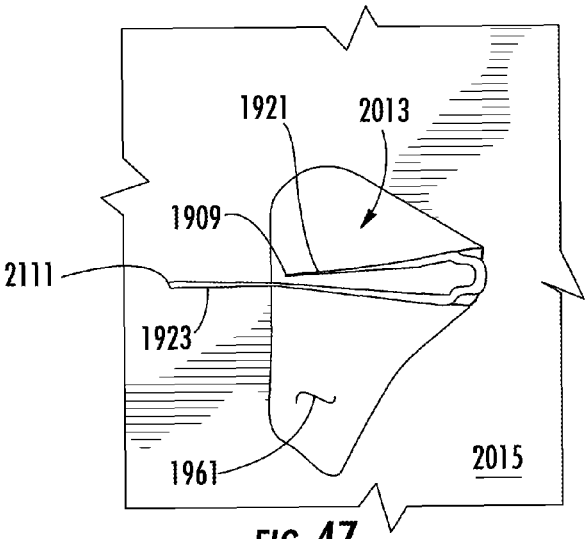

FIGS. 44-47 show an article protection flap in a bottom panel of a carton according to an alternative embodiment having similar features as the previous embodiments of the disclosure. The article protection flap 2013 is generally similar to the article protection flap 1813 of the embodiment shown in FIGS. 41-43. The article protection flap 2013 lacks the arcuate cuts 1926 and the tabs 1928 formed from the arcuate cuts of the embodiment shown in FIGS. 41-43, Instead, the article protection flap 2013 can include a generally U- or V-shaped crease or fold line 2127, wherein the fold line 2117 extends from the vertex of the V-shaped crease 2127 and the line of weakening 2103 extends from the ends of the V-shaped crease 2127. Accordingly, the V-shaped crease 2127 can help retain the width of the central portion 2125, which is generally triangular, as shown in FIG. 46. Additionally, the corner 2111 of the article protection flap 2013 has a more pronounced point than the article protection flap 1813 of the embodiment of FIGS. 41-43. As shown in FIG. 44, nine article protection flaps 2013 can be arranged in a 3×3 configuration with alternating orientations. However, the blank could have more or less than nine article protection flaps, and the flaps could be otherwise arranged in other suitable row/column arrangements or in a random configuration on the bottom panel 2015, including a single row or single column configuration, multiple row/column configurations, or any other suitable configuration. The article protection flaps 2013 could be otherwise shaped, arranged, and/or configured without departing from the disclosure.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, or configured and the cartons could be configured to hold articles other than beverage containers C without departing from the disclosure.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing at least one article, the carton comprising:

at least one panel at least partially forming an interior of the carton; and at least one article protection flap for protecting the at least one article, the at least one article protection flap being foldably connected to the at least one panel along a lateral fold line and moveable between a first position that is substantially parallel to the at least one panel and a second position wherein the at least one article protection flap is folded relative to the at least one panel;

wherein the at least one article protection flap comprises a longitudinal crease, a first corner spaced apart from the longitudinal crease by a first distance, and a second corner spaced apart from the longitudinal crease by a second distance, the second distance being greater than the first distance.

2. The carton of claim 1, wherein the second corner is for engaging the at least one panel for preventing folding of the at least one article protection flap from the second position to the first position.

3. The carton of claim 1, wherein the at least one article protection flap comprises a first portion foldably connected to a second portion along the longitudinal crease, the first portion comprising the first corner, and the second portion comprising the second corner.

4. The carton of claim 3, wherein the first portion and the second portion are respectively foldably connected to a central portion of the at least one article protection flap along a generally V-shaped crease, the longitudinal crease extending from the generally V-shaped crease.

5. The carton of claim 1, wherein the at least one article protection flap comprises a central portion at least partially defined by a generally V-shaped crease and the lateral fold line.

6. The carton of claim 5, wherein the longitudinal crease extends from a vertex of the generally V-shaped crease to a free edge of the article protection flap.

7. The carton of claim 5, wherein the generally V-shaped crease is for at least partially maintaining the at least one article protection flap in a general wedge shape in the second position.

8. The carton of claim 1, further comprising at least one tab extending laterally from a central portion of the at least one article protection flap, wherein the at least one tab is formed from at least one cut extending in the at least one article protection flap.

9. The carton of claim 8, wherein the at least one cut is at least partially arcuate.

10. The carton of claim 8, wherein the at least one tab at least partially engages the at least one article in the second position of the at least one article protection flap for at least partially maintaining the at least one article protection flap in a general wedge shape in the second position.

11. The carton of claim 8, wherein the at least one tab comprises a first tab and an opposing second tab extending from the central portion of the at least one article protection flap.

12. The carton of claim 11, wherein the at least one article protection flap comprises a first outer portion foldably connected to a second outer portion along the longitudinal crease, the longitudinal crease extending from the central portion of the at least one article protection flap, the first outer portion and the second outer portion extending away from the first tab and the second tab in the second position of the at least one article protection flap.

13. A blank for forming a carton for containing at least one article, the blank comprising:

at least one panel for at least partially forming an interior of the carton formed from the blank; and at least one article protection flap for protecting the at least one article, the at least one article protection flap being foldably connected to the at least one panel along a lateral fold line and moveable between a first position that is substantially parallel to the at least one panel and a second position wherein the at least one article protection flap is folded relative to the at least one panel;

wherein the at least one article protection flap comprises a longitudinal crease, a first corner spaced apart from the longitudinal crease by a first distance, and a second corner spaced apart from the longitudinal crease by a second distance, the second distance being greater than the first distance.

14. The blank of claim 13, wherein the second corner is for engaging the at least one panel for preventing folding of the at least one article protection flap from the second position to the first position.

15. The blank of claim 13, wherein the at least one article protection flap comprises a first portion foldably connected to a second portion along the longitudinal crease, the first portion comprising the first corner, and the second portion comprising the second corner.

16. The blank of claim 15, wherein the first portion and the second portion are respectively foldably connected to a central portion of the at least one article protection flap along a generally V-shaped crease, the longitudinal crease extending from the generally V-shaped crease.

17. The blank of claim 13, wherein the at least one article protection flap comprises a central portion at least partially defined by a generally V-shaped crease and the lateral fold line.

18. The blank of claim 17, wherein the longitudinal crease extends from a vertex of the generally V-shaped crease to a free edge of the article protection flap.

19. The blank of claim 17, wherein the generally V-shaped crease is for at least partially maintaining the at least one article protection flap in a general wedge shape in the second position.

20. The blank of claim 13, wherein the at least one article protection flap comprises at least one cut for forming at least one tab extending laterally from a central portion of the at least one article protection flap in the second position of the at least one article protection flap.

21. The blank of claim 20, wherein the at least one cut is at least partially arcuate.

22. The blank of claim 20, wherein the at least one cut comprises a first cut and a second cut, and the at least one tab comprises a first tab and an opposing second tab extending from the central portion of the at least one article protection flap in the second position of the at least one article protection flap.

23. A method of forming a carton, the method comprising:

obtaining a blank comprising at least one panel and at least one article protection flap foldably connected to the at least one panel along a lateral fold line, wherein the at least one article protection flap comprises a longitudinal crease, a first corner spaced apart from the longitudinal crease by a first distance, and a second corner spaced apart from the longitudinal crease by a second distance, the second distance being greater than the first distance;

positioning the at least one panel to at least partially form an interior space of the carton; and folding the at least one article protection flap relative to the at least one panel, the folding comprises moving the at least one article protection flap from a first position that is substantially parallel to the at least one panel to a second position wherein the at least one article protection flap is folded relative to the at least one panel.

24. The method of claim 23, wherein the at least one article protection flap comprises a first portion foldably connected to a second portion along the longitudinal crease, the first portion comprising the first corner, and the second portion comprising the second corner, the folding the at least one article protection flap relative to the at least one panel comprises folding the first portion and the second portion along the longitudinal crease.

25. The method of claim 24, wherein the first portion and the second portion are respectively foldably connected to a central portion of the at least one article protection flap along a generally V-shaped crease, the longitudinal crease extending from the generally V-shaped crease, the folding the at least one article protection flap relative to the at least one panel comprises folding the first portion and the second portion along the generally V-shaped crease.

26. The method of claim 23, wherein the at least one article protection flap comprises at least one cut in a central portion of the at least one article protection flap, and the folding comprises forming at least one tab extending laterally from the central portion.

* * * * *